US011752768B2

(12) United States Patent
Watanabe

(10) Patent No.: US 11,752,768 B2
(45) Date of Patent: Sep. 12, 2023

(54) LIQUID EJECTING HEAD AND LIQUID EJECTING APPARATUS

(71) Applicant: Seiko Epson Corporation, Tokyo (JP)

(72) Inventor: Eiichiro Watanabe, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/385,541

(22) Filed: Jul. 26, 2021

(65) Prior Publication Data

US 2022/0024207 A1 Jan. 27, 2022

(30) Foreign Application Priority Data

Jul. 27, 2020 (JP) ..... 2020-126544

(51) Int. Cl.
*B41J 2/145* (2006.01)
*B41J 2/14* (2006.01)

(52) U.S. Cl.
CPC ..... *B41J 2/145* (2013.01); *B41J 2/1433* (2013.01); *B41J 2/14201* (2013.01); *B41J 2002/14491* (2013.01)

(58) Field of Classification Search
CPC ..... B41J 2/145; B41J 2/14201; B41J 2/1433; B41J 2002/14491; B41J 2/14233; B41J 2002/14419; B41J 2202/12; B41J 2202/20; B41J 2/01; B41J 2/175; B41J 2/17503; B41J 29/393
See application file for complete search history.

(56) References Cited

U.S. PATENT DOCUMENTS

| | | | |
|---|---|---|---|
| 2013/0169717 | A1 | 7/2013 | Domae et al. |
| 2017/0282553 | A1 | 10/2017 | Hayashi et al. |
| 2017/0282562 | A1 | 10/2017 | Mizuno et al. |
| 2018/0009218 | A1 | 1/2018 | Tamura et al. |
| 2020/0079086 | A1 | 3/2020 | Asai et al. |

FOREIGN PATENT DOCUMENTS

| | | |
|---|---|---|
| EP | 3686013 | 7/2020 |
| JP | 2013-144430 | 7/2013 |
| JP | 2015-030181 | 2/2015 |

OTHER PUBLICATIONS

IP.com search (Year: 2022).*

* cited by examiner

*Primary Examiner* — Lisa Solomon
(74) *Attorney, Agent, or Firm* — WORKMAN NYDEGGER

(57) ABSTRACT

A liquid ejecting head that has substrates stacked, includes individual flow paths respectively communicating with nozzles, a supply common liquid chamber and a discharge common liquid chamber that communicate with the individual flow paths, and a bypass flow path coupling the supply common liquid chamber to the discharge common liquid chamber, in which the supply common liquid chamber and the discharge common liquid chamber are formed in the same layer among the substrates, and the bypass flow path has a portion formed in a layer different from the supply common liquid chamber and the discharge common liquid chamber, among the substrates.

20 Claims, 22 Drawing Sheets

LIQUID EJECTING HEAD AND LIQUID EJECTING APPARATUS

The present application is based on, and claims priority from JP Application Serial Number 2020-126544, filed Jul. 27, 2020, the disclosure of which is hereby incorporated by reference herein in its entirety.

BACKGROUND

1. Technical Field

The present disclosure relates to a liquid ejecting head and a liquid ejecting apparatus.

2. Related Art

In the related art, as represented by an ink jet printer, a liquid ejecting apparatus having a liquid ejecting head for ejecting a liquid such as ink has been known. For example, JP-A-2013-144430 discloses a liquid ejecting apparatus having a bypass flow path that couples a supply common liquid chamber to a discharge common liquid chamber at a longitudinal end of the supply common liquid chamber and the discharge common liquid chamber. This bypass flow path is formed in the same layer as the supply common liquid chamber and the discharge common liquid chamber.

However, since the bypass flow path is formed in the same layer as the supply common liquid chamber and the discharge common liquid chamber in the liquid ejecting apparatus described above, it is likely that the liquid ejecting head becomes larger in the direction parallel to the nozzle surface.

SUMMARY

According to an aspect of the present disclosure, there is provided a liquid ejecting head that has a plurality of substrates stacked in a first direction, the liquid ejecting head including a plurality of individual flow paths that communicate with a plurality of nozzles for ejecting liquid in the first direction, respectively, a supply common liquid chamber that extends in a direction intersecting the first direction and communicates with the plurality of individual flow paths to supply liquid to the plurality of individual flow paths, a discharge common liquid chamber that extends in a direction intersecting the first direction and communicates with the plurality of individual flow paths and through which liquid discharged from the plurality of individual flow paths flows, and a bypass flow path that couples the supply common liquid chamber to the discharge common liquid chamber, in which the supply common liquid chamber and the discharge common liquid chamber are formed in the same layer among the plurality of substrates, and the bypass flow path has a first portion formed in a layer different from the supply common liquid chamber and the discharge common liquid chamber, among the plurality of substrates.

According to another aspect of the present disclosure, there is provided a liquid ejecting apparatus including the liquid ejecting head according to the aspect.

DESCRIPTION OF EXEMPLARY EMBODIMENTS

Hereinafter, embodiments for carrying out the present disclosure will be described with reference to the drawings. However, in each drawing, the dimensions and scale of each part are appropriately different from the actual ones. Further, since embodiments described below are preferred specific examples of the present disclosure, various technically preferable limitations are added; however, the scope of the present disclosure is not limited to these forms unless otherwise stated to limit the present disclosure in the following description.

1. First Embodiment

Hereinafter, a liquid ejecting apparatus 100 according to a first embodiment will be described.

1.1. Outline of Liquid Ejecting Apparatus 100

Figure 1:
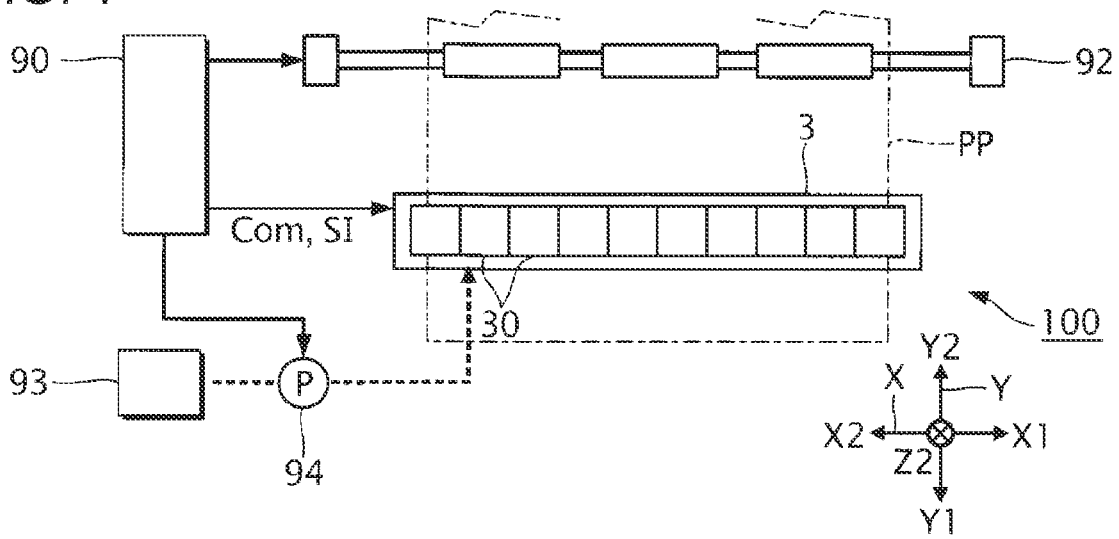
FIG. 1 is an explanatory view showing an example of a liquid ejecting apparatus according to a first embodiment.

FIG. 1 is an explanatory view showing an example of a liquid ejecting apparatus 100 according to a first embodiment. The liquid ejecting apparatus 100 according to the present embodiment is an ink jet-type printing apparatus that ejects ink, which is an example of a liquid, as droplets onto a medium PP. The liquid ejecting apparatus 100 of the present embodiment is a so-called line-type printing apparatus in which a plurality of nozzles N for ejecting ink are distributed over the entire range in the width direction of the medium PP. The medium PP is, for example, printing paper, but any print target such as a resin film or cloth can be used as the medium PP.

As illustrated in FIG. 1, the liquid ejecting apparatus 100 includes a liquid container 93 for storing ink. As the liquid container 93, for example, a cartridge that can be attached to and detached from the liquid ejecting apparatus 100, a bag-shaped ink pack made of a flexible film, an ink tank that can be refilled with ink, or the like can be employed. A plurality of types of ink having different colors are stored in the liquid container 93.

Although not shown, the liquid container 93 of the present embodiment includes a first liquid container and a second liquid container. A first ink is stored in the first liquid container. A second ink of a type different from that of the first ink is stored in the second liquid container. For example, the first ink and the second ink are inks of different colors from each other. The first ink and the second ink may be the same type of ink.

As illustrated in FIG. 1, the liquid ejecting apparatus 100 includes a head module 3 having a plurality of liquid ejecting heads 30, a control device 90, a transport mechanism 92, and a circulation mechanism 94.

The control device 90 includes, for example, a processing circuit such as a CPU or FPGA and a storage circuit such as a semiconductor memory, and controls each element of the liquid ejecting apparatus 100. Here, CPU is an abbreviation for central processing unit, and FPGA is an abbreviation for field programmable gate array.

The transport mechanism 92 transports the medium PP in a Y1 direction under the control of the control device 90. Hereinafter, the Y1 direction and a Y2 direction, which is the direction opposite to the Y1 direction, are collectively referred to as the Y-axis direction.

The head module 3 ejects the ink supplied from the liquid container 93 in a Z2 direction under the control of the control device 90. The Z2 direction is a direction orthogonal to the Y1 direction. Hereinafter, the Z2 direction and a Z1 direction, which is a direction opposite to the Z2 direction, may be collectively referred to as a Z-axis direction. The head module 3 will be described with reference to FIG. 2.

1.2. Head Module 3

Figure 2:
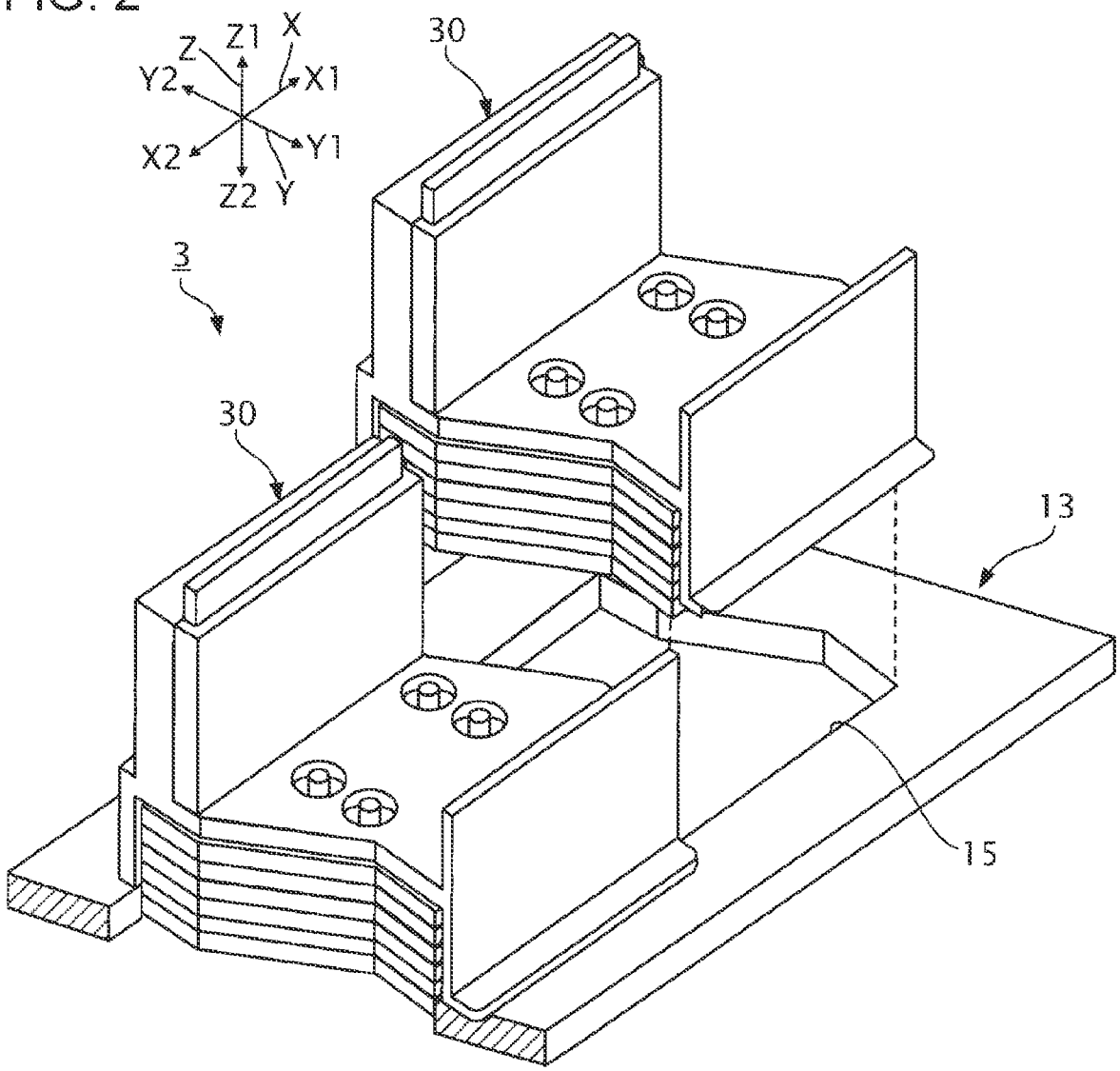
FIG. 2 is a perspective view of a head module.

FIG. 2 is a perspective view of the head module 3. The head module 3 includes the plurality of liquid ejecting heads 30 and a head fixing substrate 13 that holds the plurality of liquid ejecting heads 30. The plurality of liquid ejecting heads 30 are arranged side by side in an X1 direction and an X2 direction, which are directions orthogonal to the Y1 direction which is the transport direction, and are fixed to the head fixing substrate 13. The X2 direction is opposite to the X1 direction. Hereinafter, the X1 direction and the X2 direction may be collectively referred to as an X-axis direction. The head module 3 is a line head having the plurality of liquid ejecting heads 30 arranged so that a plurality of nozzles N are distributed over the entire range of the medium PP in the X-axis direction. That is, the plurality of liquid ejecting heads 30 constitute a long line head in the X-axis direction. By ejecting ink from the plurality of liquid ejecting heads 30 in parallel with the transport of the medium PP by the transport mechanism 92, an image by ink is formed on the surface of the medium PP. The head module 3 may be a long line head in an extending direction of the X axis, which includes only a single liquid ejecting head 30 disposed so that a plurality of nozzles N are distributed over the entire range of the medium PP in the X-axis direction. The head fixing substrate 13 has a plurality of mounting holes 15 for mounting the liquid ejecting head 30. The liquid ejecting head 30 is supported by the head fixing substrate 13 in a state of being inserted into the mounting hole 15.

Description will be made referring back to FIG. 1. The XYZ coordinate system shown in FIG. 1 is a local coordinate system showing coordinates with reference to the head module 3. When the attitude of the head module 3 changes, the orientation in the X-axis direction, the orientation in the Y-axis direction, and the orientation in the Z-axis direction change.

The transport mechanism 92 transports the medium PP to the head module 3 in the Y-axis direction. In the example shown in FIG. 1, the liquid container 93 is coupled to the head module 3 via the circulation mechanism 94. The circulation mechanism 94 is a mechanism for supplying ink to each of the plurality of liquid ejecting heads 30 and collecting the ink discharged from each of the plurality of liquid ejecting heads 30 for resupply to the liquid ejecting heads 30. The circulation mechanism 94 includes, for example, a sub tank for storing ink, a flow path for supplying ink from the sub tank to the liquid ejecting heads 30, a flow path for collecting ink from the liquid ejecting heads 30 to the sub tank, and a pump for appropriately flowing ink. By the operation of the circulation mechanism 94, it is possible to suppress an increase in the viscosity of the ink and reduce the retention of air bubbles in the ink.

As illustrated in FIG. 1, the control device 90 supplies the liquid ejecting heads 30 with a drive signal Com for driving the liquid ejecting heads 30 and a control signal SI for controlling the liquid ejecting heads 30. Then, the liquid ejecting heads 30 are driven by the drive signal Com under the control of the control signal SI, and ejects ink in the Z2 direction from a part or all of the plurality of nozzles N provided in the liquid ejecting heads 30. The nozzle N will be described later in FIGS. 7 and 8.

1.3. Liquid Ejecting Head 30

Figure 3:
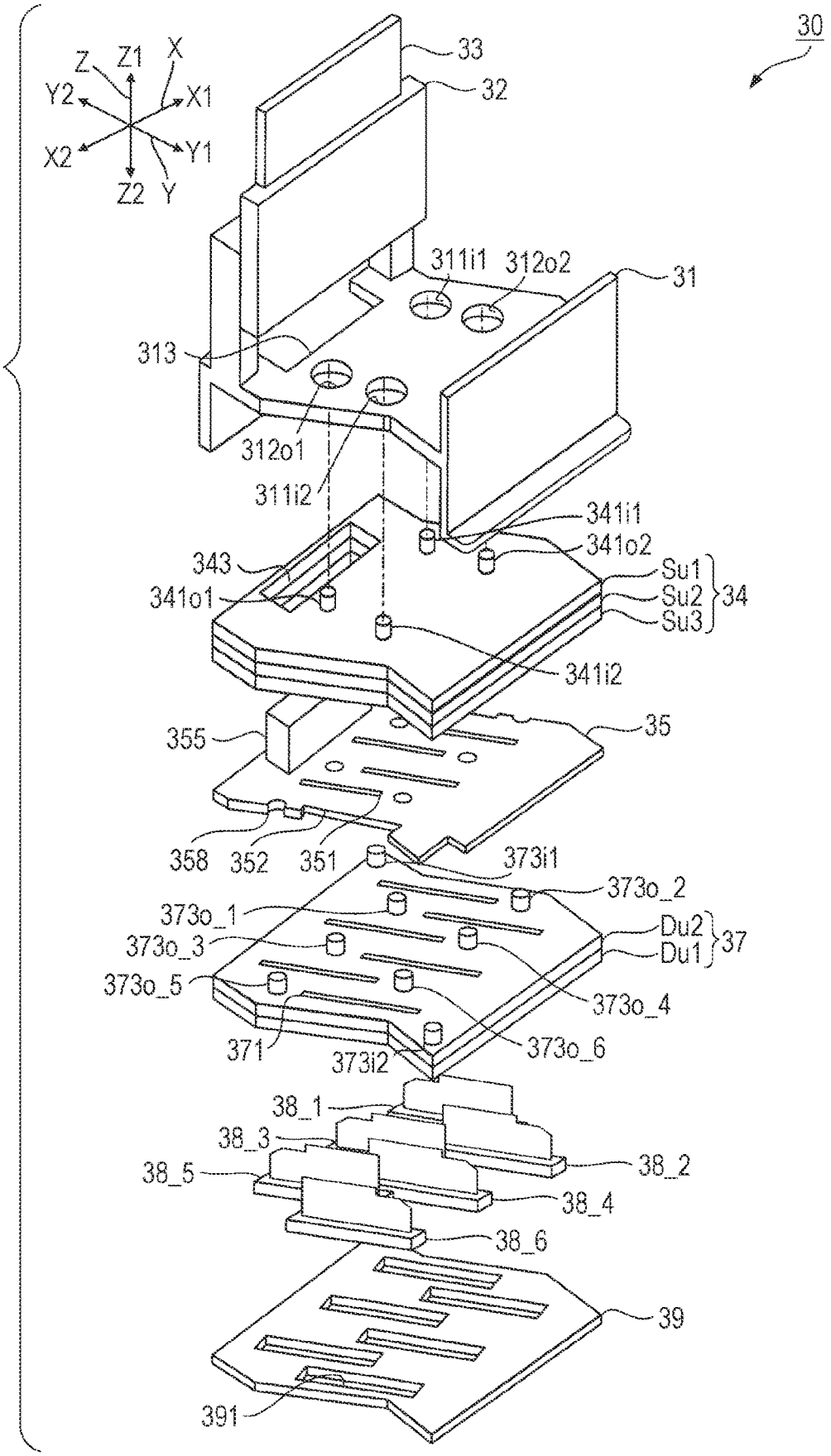
FIG. 3 is an exploded perspective view of a liquid ejecting head shown in FIG. 2.

FIG. 3 is an exploded perspective view of the liquid ejecting head 30 shown in FIG. 2. As shown in FIG. 3, the liquid ejecting head 30 has a housing 31, a cover substrate 32, an aggregate substrate 33, a flow path structure 34, a wiring substrate 35, a flow path distribution portion 37, and the fixing plate 39. Further, the liquid ejecting head 30 has head units 38_1, 38_2, 38_3, 38_4, 38_5, and 38_6. When the head units 38_1, 38_2, 38_3, 38_4, and 38_5, and the head unit 38_6 are not distinguished, they are referred to as the head units 38. In addition, the flow path structure 34 includes a flow path plate Su1, a flow path plate Su2, a flow path plate Su3, a coupling pipe 341*i*1, a coupling pipe 341*i*2, a coupling pipe 341*o*1, a coupling pipe 341*o*2, and a connector hole 343. The flow path distribution portion 37 includes a first flow path member Du1, a second flow path member Du2, a coupling pipe 373*i*1, a coupling pipe 373*i*2, a coupling pipe 373*o*_1, a coupling pipe 373*o*_2, a coupling pipe 373o_3, a coupling pipe 373o_4, a coupling pipe 373o_5, and a coupling pipe 373o_6. In the following description, the coupling pipe 373i1, the coupling pipe 373i2, the coupling pipe 373o_1, the coupling pipe 373o_2, the coupling pipe 373o_3, the coupling pipe 373o_4, the coupling pipe 373o_5, and the coupling pipe 373o_6 are collectively referred to as a coupling pipe 373. The first flow path member Du1 is an example of the "first flow path member", and the second flow path member Du2 is an example of the "second flow path member".

The housing 31 supports the flow path structure 34, the wiring substrate 35, the flow path distribution portion 37, and the fixing plate 39. Further, the housing 31 has a supply hole 311i1, a supply hole 311i2, a discharge hole 312o1, a discharge hole 312o2, and an aggregate substrate hole 313. The coupling pipe 341i1 is inserted into and fitted into the supply hole 311i1. The coupling pipe 341i2 is inserted into and fitted into the supply hole 311i2. The coupling pipe 341o1 is inserted into and fitted into the discharge hole 312o1. The coupling pipe 341o2 is inserted into and fitted into the discharge hole 312o2. The aggregate substrate 33 is inserted into the aggregate substrate hole 313. The housing 31 is made of metal or resin. Alternatively, the housing 31 may be made of a member of which the resin surface is covered with a metal film.

The cover substrate 32 holds the aggregate substrate 33 with a portion of the housing 31 extending in the Z1 direction. The aggregate substrate 33 is a substrate on which wiring is formed for transmitting the drive signal Com and the control signal SI supplied from the control device 90 to the head units 38. The aggregate substrate 33 is a plate-shaped member extending parallel to the XZ plane. Here, the concept of "parallel" includes, in addition to being completely parallel, being regarded as parallel, for example, considering the error generated due to the manufacturing error of the liquid ejecting head 30 even though designed to be parallel.

The flow path structure 34 is a structure with a flow path provided inside for flowing ink between the circulation mechanism 94 and each of the plurality of head units 38. The flow path structure 34 is disposed between the housing 31 and the wiring substrate 35. The flow path plate Su1, the flow path plate Su2, and the flow path plate Su3 included in the flow path structure 34 are stacked in this order in the Z1 direction. The flow path plate Su1, the flow path plate Su2, and the flow path plate Su3 are joined to each other by an adhesive or the like. The flow path plate Su1, the flow path plate Su2, and the flow path plate Su3 are formed, for example, by injection molding of a resin.

Figure 4:
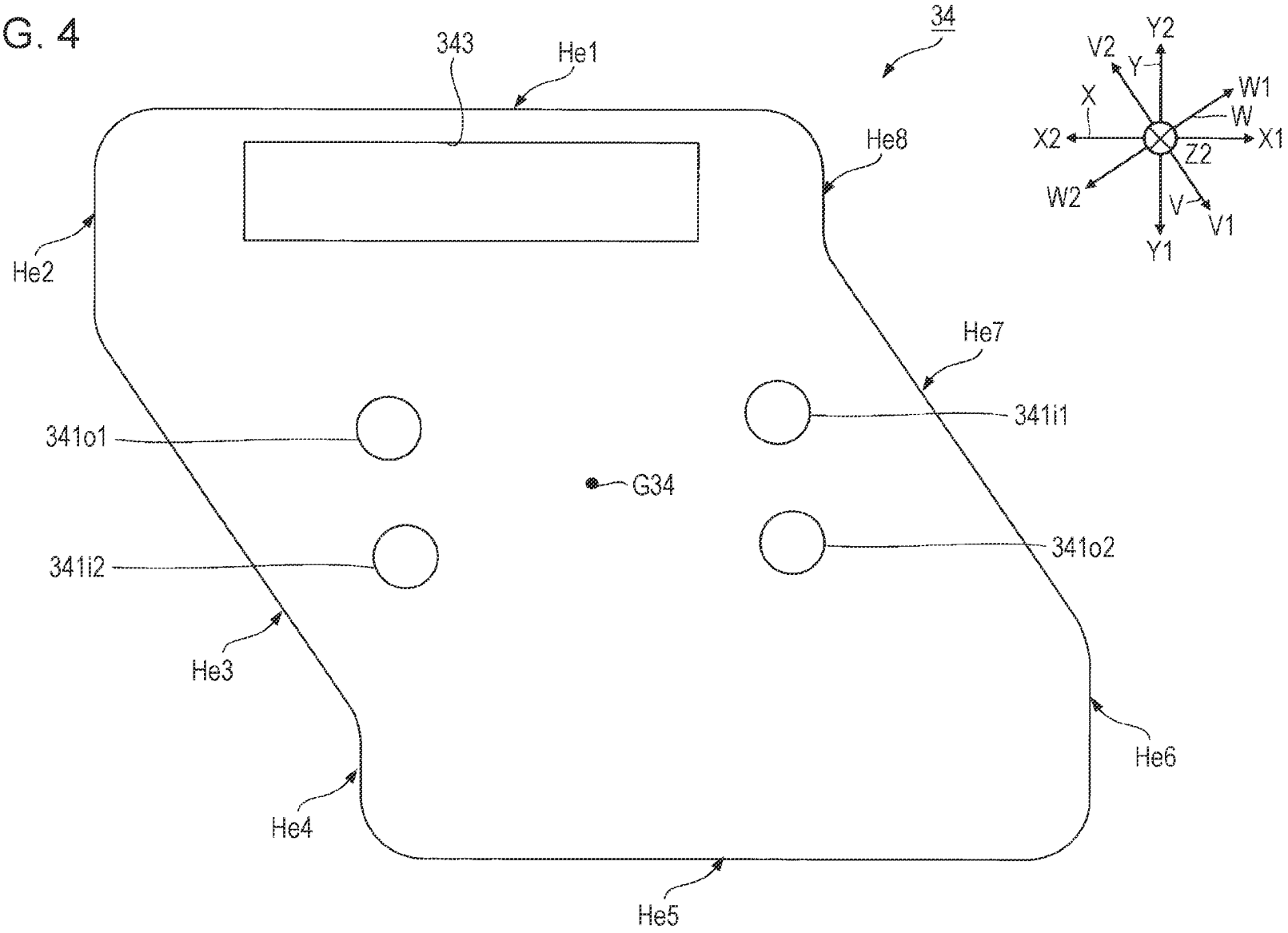
FIG. 4 is a plan view of a flow path structure when viewed in a Z2 direction.

FIG. 4 is a plan view of the flow path structure 34 when viewed in the Z2 direction. As illustrated in FIG. 4, the outer shape of the flow path structure 34 is an octagon with rounded corners in a plan view as seen in the Z2 direction. Hereinafter, the plan view as seen in the Z2 direction is simply referred to as the "plan view". As a specific shape of the flow path structure 34, the flow path structure 34 has a side He1, a side He2, a side He3, a side He4, a side He5, a side He6, a side He7, and a side He8. In the plan view, the outer shape of the flow path structure 34 is substantially point-symmetrical with respect to the center of gravity G34 of the flow path structure 34. Here, the center of gravity is a point at which the sum of the primary moments is zero in a target shape when seen in the plan view, and is an intersection of diagonal lines in the case of a rectangular shape.

The side He1 is a side parallel to the X axis, is adjacent to the side He8 and the side He2, and is positioned foremost in the Y2 direction. The side He2 is a side parallel to the Y-axis direction, is adjacent to the side He1 and the side He3, and is positioned foremost in the X2 direction. The side He3 is adjacent to the side He2 and the side He4, and is a side parallel to a V-axis direction. The V-axis direction is a general term for a V1 direction and a V2 direction. The V1 direction intersects the X1 direction and the Y1 direction. More specifically, the V1 direction is a direction obtained by rotating the X1 direction clockwise by approximately 56 degrees. The V2 direction is the opposite direction of the V1 direction. The side He4 is adjacent to the side He3 and the side He5, and is a side parallel to the Y-axis direction. The side He5 is adjacent to the side He4 and the side He6, is a side parallel to the X-axis direction, and is positioned foremost in the Y1 direction. The side He6 is adjacent to the side He5 and the side He7, is a side parallel to the Y-axis direction, and is positioned foremost in the X1 direction. The side He7 is adjacent to the side He6 and the side He8, and is a side parallel to the V-axis direction. The side He8 is adjacent to the side He7 and the side He1 and is a side parallel to the Y-axis direction.

Description will be made referring back to FIG. 3. The wiring substrate 35 is a mounting component for electrically coupling the liquid ejecting head 30 to the control device 90. The wiring substrate 35 is a substrate on which wiring is formed for transmitting various control signals and power supply voltages to the head units 38. The wiring substrate 35 is a plate-shaped member extending parallel to the XY plane, and is disposed between the flow path structure 34 and the flow path distribution portion 37. The wiring substrate 35 is a rigid substrate. The wiring substrate 35 will be described in detail with reference to FIG. 5.

1.3.1. Wiring Substrate 35

Figure 5:
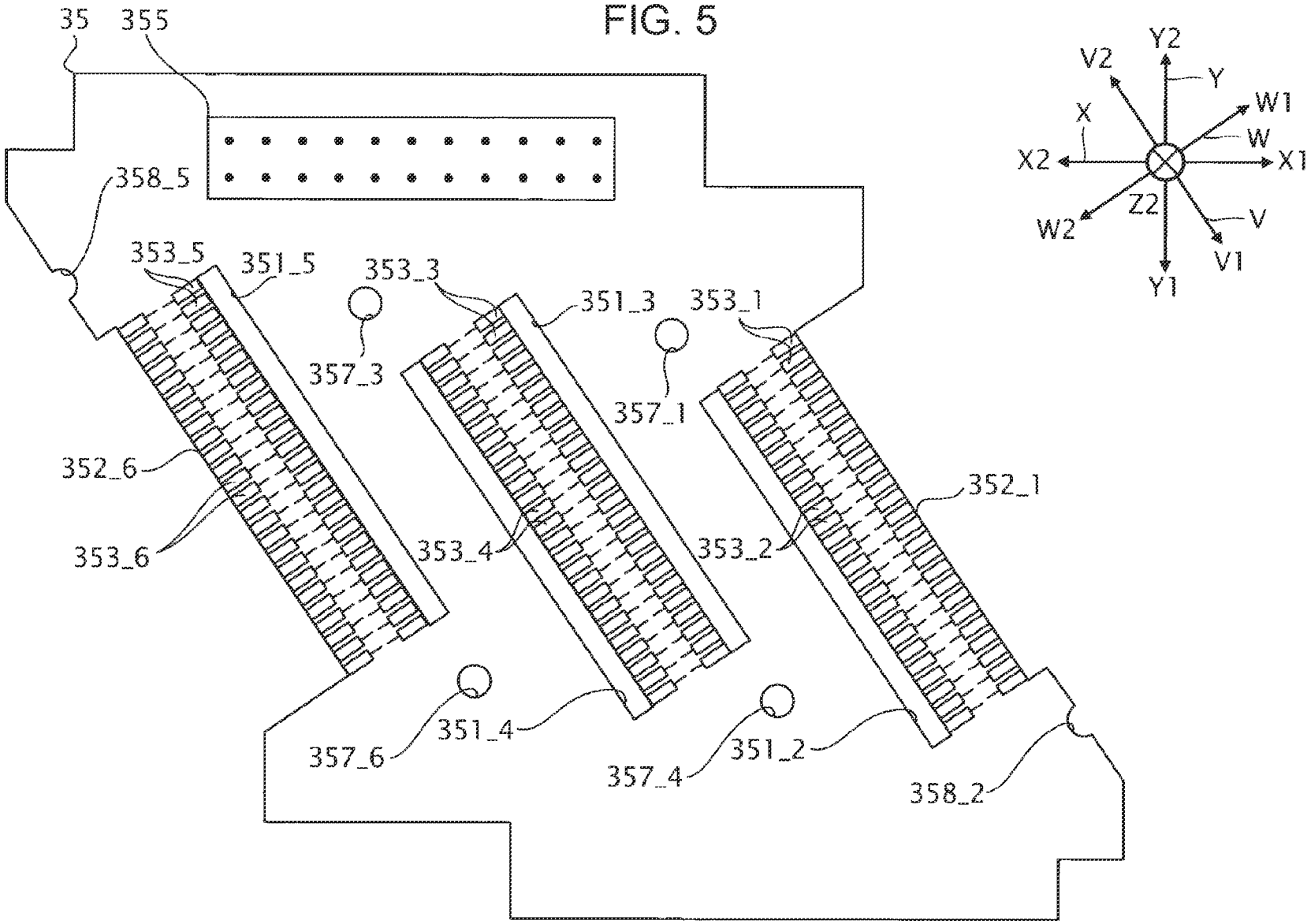
FIG. 5 is a plan view of a wiring substrate when viewed in the Z2 direction.

FIG. 5 is a plan view of the wiring substrate 35 when viewed in the Z2 direction. The wiring substrate 35 includes a notch 352_1, openings 351_2, 351_3, 351_4, and 351_5, a notch 352_6, a plurality of terminals 353_1, a plurality of terminals 353_2, a plurality of terminals 353_3, a plurality of terminals 353_4, a plurality of terminals 353_5, a plurality of terminals 353_6, a connector 355, openings 357_1, 357_3, 357_4, and 357_6, and notches 358_2 and 358_5.

When the openings 351_2, 351_3, 351_4, and 351_5 are not distinguished, they are referred to as the openings 351. Similarly, when the notches 352_1 and 352_6 are not distinguished, they are referred to as the notch 352. Similarly, when the plurality of terminals 353_1, the plurality of terminals 353_2, the plurality of terminals 353_3, the plurality of terminals 353_4, the plurality of terminals 353_5, and the plurality of terminals 353_6 are not distinguished, they are referred to as terminals 353. Similarly, when the openings 357_1, 357_3, 357_4, and 357_6 are not distinguished, they are referred to as openings 357. Similarly, when the notches 358_2 and 358_5 are not distinguished, they are referred to as the notches 358. The wiring substrate 35 may have openings 351 different from the openings 351_2, 351_3, 351_4, and 351_5 instead of having one or both of the notches 352_1 and 352_6. Similarly, the wiring substrate 35 may have an opening 357 separate from the openings 357_1, 357_3, 357_4, 357_6, instead of having one or both of the notches 358_2 and 358_5.

Each of the four openings 351 extends in the V1 direction. Further, one side formed in the notch 352_1 and one side formed in the notch 352_6 extend in the V1 direction. Further, the plurality of terminals 353_1 are arranged in the V1 direction, the plurality of terminals 353_2 are arranged in the V1 direction, the plurality of terminals 353_3 are arranged in the V1 direction, the plurality of terminals 353_4 are arranged in the V1 direction, and the plurality of terminals 353_5 are arranged in the V1 direction, and the plurality of terminals 353_6 are arranged in the V1 direction. Of two directions orthogonal to the Z1 direction and the V1 direction, the direction closer to the X1 direction is referred to as a W1 direction. Further, of the two directions orthogonal to the Z1 direction and the V1 direction, the direction closer to the X2 direction is referred to as a W2 direction. In other words, the W1 direction is a direction containing components in the X1 direction and the Y2 direction among two directions orthogonal to the Z1 direction and the V1 direction, and the W2 direction is a direction containing components in the X2 direction and the Y1 direction among two directions orthogonal to the Z1 direction and the V1 direction. Further, the W1 direction and the W2 direction are collectively referred to as a W-axis direction.

A wiring member 388 included in a head unit 38_*i*, which will be described later, is inserted into the opening 351_*i*. i is an integer from 2 to 5. One side of the notch 352_*j* extending in the V1 direction is fitted with the wiring member 388 of the head unit 38_*j*. j is 1 and 6. A plurality of input terminals 3886 provided in an input terminal portion 3882 of the wiring member 388 of the head unit 38_*k* come into contact with the plurality of terminals 353_*k*. k is an integer from 1 to 6. The input terminal portion 3882 and the plurality of input terminals 3886 will be described later with reference to FIG. 12.

As illustrated in FIG. 5, the four openings 351 and the two notches 352 are arranged in zigzags. More specific arrangements of the six openings 351 are as follows. One side of the notch 352_1 extending in the V1 direction, the opening 351_2, the opening 351_3, the opening 351_4, the opening 351_5, and one side of the notch 352_6 extending in the V1 direction are arranged in this order in the W-axis direction.

A coupling pipe 373*o*_i is inserted through the opening 357_*i*. i is 1, 3, 4, and 6. A coupling pipe 373*o*_j is fitted in the notch 358_*j*. j is 2 and 5. The notch 358_2 is positioned in the V1 direction with respect to the notch 352_1. The opening 357_*k* is positioned in the V1 direction with respect to the opening 351_*k*−1. k is 4 and 6. The opening 357_*m* is positioned in the V2 direction with respect to the opening 351_*m*+1. m is 1 and 3. The notch 358_5 is positioned in the V2 direction with respect to the notch 352_6.

1.3.2. Flow Path Distribution Portion 37

Description will be made referring back to FIG. 3. The flow path distribution portion 37 is disposed between the wiring substrate 35 and the fixing plate 39, and is fixed to the fixing plate 39 with an adhesive. Therefore, the flow path distribution portion 37 reinforces the fixing plate 39. The flow path distribution portion 37 is made of, for example, resin or metal. From the viewpoint of the above-mentioned reinforcement, it is desirable that the thickness of the flow path distribution portion 37 is thicker than the thickness of the fixing plate 39.

Figure 6:
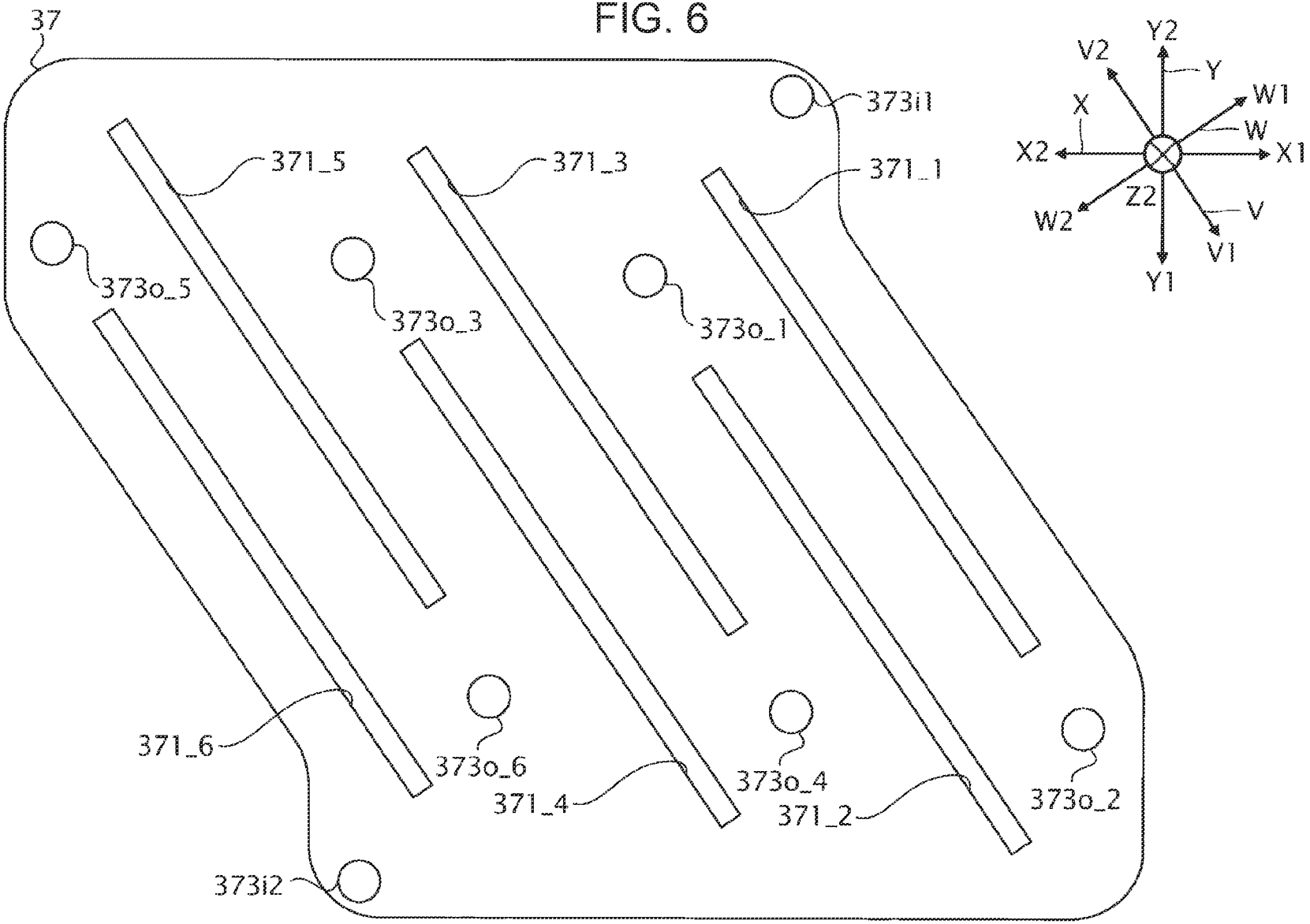
FIG. 6 is a plan view of a flow path distribution portion when viewed in the Z2 direction.

FIG. 6 is a plan view of the flow path distribution portion 37 when viewed in the Z2 direction. The first flow path member Du1 and the second flow path member Du2 included in the flow path distribution portion 37 are stacked in this order in the Z1 direction. Eight coupling pipes 373 are provided on the surface of the flow path distribution portion 37 toward the Z1 direction. The eight coupling pipes 373 are flow path pipes that project in the Z1 direction from the surface of the second flow path member Du2 toward the Z1 direction.

The flow path distribution portion 37 has a plurality of openings 371_1, 371_2, 371_3, 371_4, 371_5, and 371_6 penetrating in the Z-axis direction. When the plurality of openings 371_1 to 371_6 are not distinguished, it is referred to as openings 371. Wiring members 388 of the plurality of head units 38 are inserted into the six openings 371, respectively. The six openings 371 are also arranged in zigzags, similar to the openings 351 of the wiring substrate 35.

The openings 371 are openings that are longer in the V-axis direction than the openings 351 of the wiring substrate 35. Specifically, the opening 371_1 communicates with the notch 352_1 of the wiring substrate 35, and extends in the V2 direction rather than one side of the notch 352_1 extending in the V1 direction in the plan view as seen in the Z2 direction. The opening 371_2 communicates with the opening 351_2 of the wiring substrate 35 and extends further than the opening 351_2 in the V1 direction in the plan view. The opening 371_3 communicates with the opening 351_3 of the wiring substrate 35 and extends further than the opening 351_3 in the V2 direction in the plan view. The opening 371_4 communicates with the opening 351_4 of the wiring substrate 35 and extends further than the opening 351_4 in the V1 direction in the plan view. The opening 371_5 communicates with the opening 351_5 of the wiring substrate 35 and extends further than the opening 351_5 in the V2 direction in the plan view. The opening 371_6 communicates with the notch 352_6 of the wiring substrate 35 and extends in the V1 direction further than the side of the notch 352_6 in the V1 direction in the plan view.

The coupling pipes 373*i*1 are arranged at the corners of the flow path distribution portion 37 in the X1 direction and the Y2 direction. The coupling pipes 373*i*2 are arranged at the corners of the flow path distribution portion 37 in the X2 direction and the Y1 direction. The coupling pipe 373*o*_n is disposed in the V1 direction with respect to the opening 371_*n*−1. n is 2, 4, and 6. The coupling pipe 373*o*_p is disposed in the V2 direction with respect to the opening 371_*p*+1. p is 1, 3, and 5.

The coupling pipe 373*i*1 communicates with a discharge port CE1 formed on the surface of the flow path structure 34 toward the Z2 direction, and introduces ink from the flow path structure 34 into the flow path distribution portion 37. Similarly, the coupling pipe 373*i*2 communicates with a discharge port CE2 formed on the surface of the flow path structure 34 toward the Z2 direction, and introduces ink from the flow path structure 34 into the flow path distribution portion 37. Then, the flow path distribution portion 37 has a flow path for distributing the ink supplied from the flow path structure 34 to each of the head units 38. Further, the flow path distribution portion 37 has a flow path through which the ink discharged from each of the head units 38 flows. The coupling pipes 373*o*_1 to 373*o*_6 communicate with any one of inlets CI1_1, CI1_3, CI1_5, CI2_2, CI2_4, and CI2_6 formed on the surface of the flow path structure 34 toward the Z2 direction, and introduce ink from the flow path distribution portion 37 into the flow path structure 34. The discharge ports CE1 and CE2, and the inlets CI1_1, CI1_3, CI1_5, CI2_2, CI2_4, and CI2_6 will be described later in FIGS. 13 and 14.

Description will be made referring back to FIG. 3. The head units 38 have M nozzles N. M is an integer equal to or greater than 2. The six head units 38 are also arranged in zigzags, similar to the openings 351 of the wiring substrate 35. The head unit 38_1 will be described with reference to FIGS. 7, 8, 9, 10, and 11.

1.3.3. Head Unit 38

Figure 7:
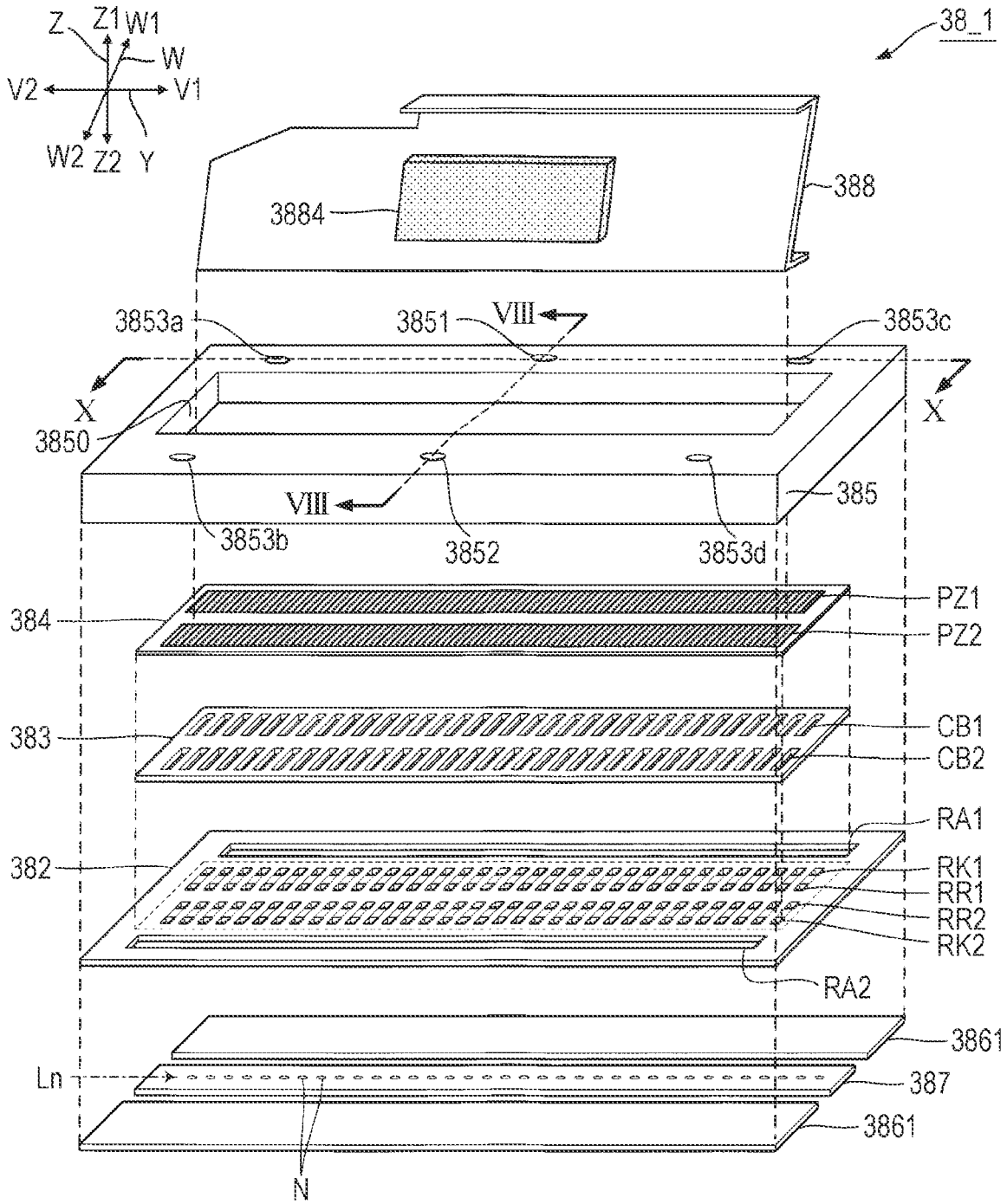
FIG. 7 is an exploded perspective view of a head unit.
Figure 8:
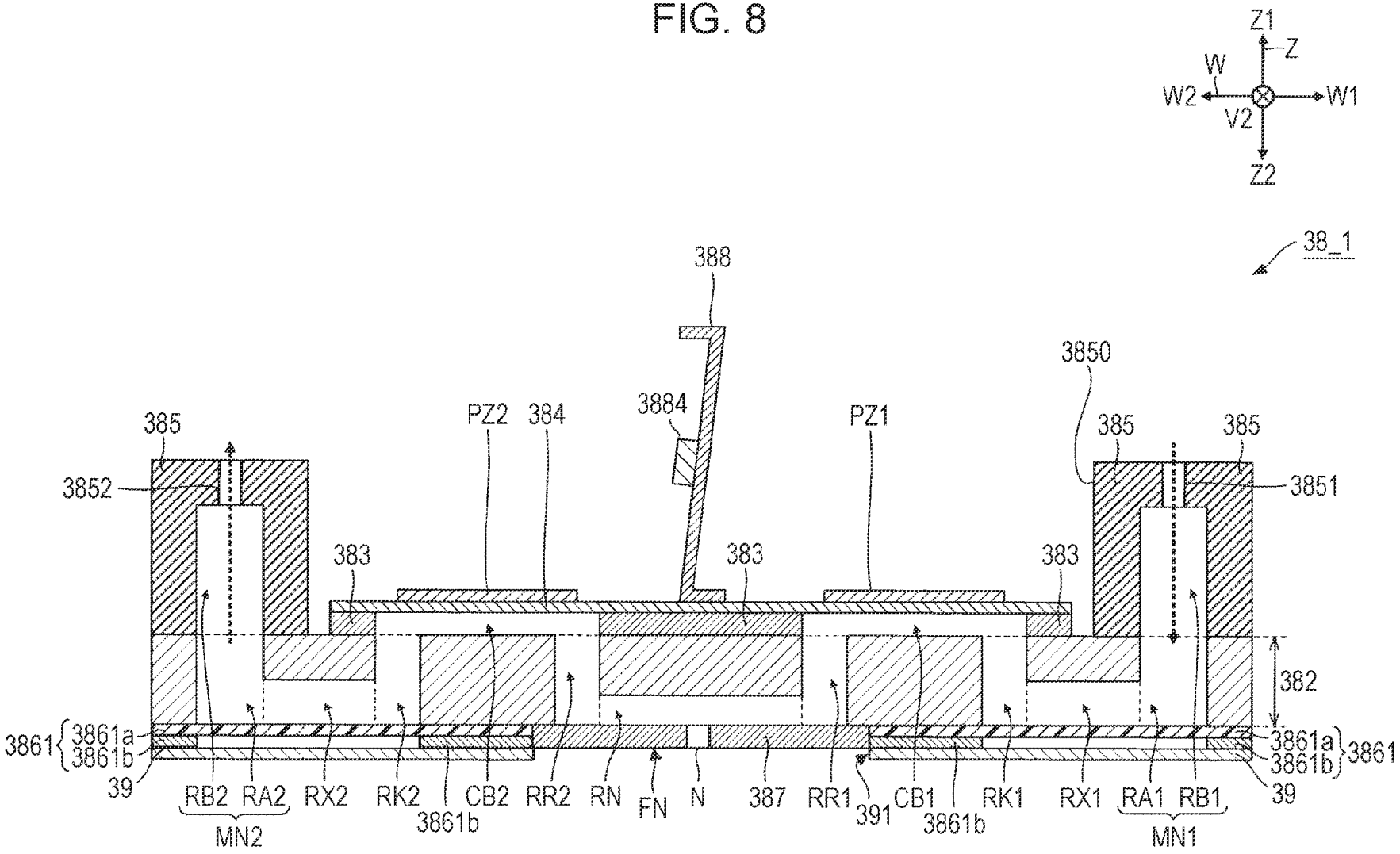
FIG. 8 is a cross-sectional view taken along line VIII-VIII in FIG. 7.

FIG. 7 is an exploded perspective view of the head unit 38_1. FIG. 8 is a cross-sectional view taken along the line VIII-VIII in FIG. 7. The VIII-VIII line is a virtual line segment that passes through an inlet 3851 and an outlet 3852 and passes through the nozzle N. In the figure shown in FIG. 8, in addition to the cross section of the head unit 38_1, the cross section of the fixing plate 39 is also shown.

As illustrated in FIGS. 7 and 8, the head unit 38_1 includes a nozzle plate 387, a compliance substrate 3861, a communication plate 382, a pressure chamber substrate 383, a vibration plate 384, a case 385, and the wiring member 388.

As illustrated in FIG. 7, the nozzle plate 387 is a plate-shaped member that is long in the V-axis direction and extends parallel to the VW plane, and M nozzles N are formed. The nozzle plate 387 is manufactured by processing a silicon single crystal substrate using, for example, a semiconductor manufacturing technique such as etching. However, any known material and manufacturing method can be employed for manufacturing the nozzle plate 387. Further, the nozzles N are through-holes provided in the nozzle plate 387. In the present embodiment, as an example, it is assumed that M nozzles N are provided in the nozzle plate 387 so as to form a nozzle row Ln extending in the V-axis direction. However, the nozzle plate 387 may have a plurality of nozzle rows Ln in which some of M nozzles N are arranged in the V-axis direction.

As illustrated in FIGS. 7 and 8, the communication plate 382 is provided in the Z1 direction with respect to the nozzle plate 387. The communication plate 382 is a plate-shaped member that is long in the V-axis direction and extends substantially parallel to the VW plane, and forms an ink flow path.

Specifically, one supply liquid chamber RA1 and one discharge liquid chamber RA2 are formed in the communication plate 382. Among them, the supply liquid chamber RA1 is provided so as to communicate with the supply liquid chamber RB1 to be described later and extend in the V-axis direction. Further, the discharge liquid chamber RA2 is provided so as to communicate with the discharge liquid chamber RB2 to be described later and extend in the V-axis direction. The supply liquid chamber RA1 may be divided into a plurality of parts in the V-axis direction, and the discharge liquid chamber RA2 may be also divided into a plurality of parts in the V-axis direction. Hereinafter, a common liquid chamber formed by the supply liquid chamber RA1 and the supply liquid chamber RB1 will be referred to as a "supply common liquid chamber MN1". Similarly, a common liquid chamber formed by the discharge liquid chamber RA2 and the discharge liquid chamber RB2 is referred to as "discharge common liquid chamber MN2".

Further, on the communication plate 382, M nozzle flow paths RN corresponding one-to-one with the M nozzles N, M communication flow paths RR1 corresponding to one-to-one with the M nozzles N, M communication flow paths RR2 corresponding one-to-one with the M nozzles N, M communication flow paths RK1 corresponding one-to-one with the M nozzles N, M communication flow paths RK2 corresponding one-to-one with the M nozzles N, M communication flow paths RX1 corresponding one-to-one with the M nozzles N, and M communication flow paths RX2 corresponding one-to-one with the M nozzles N are formed. On the communication plate 382, one communication flow path RX1 and one communication flow path RX2 that are commonly provided in the M nozzles N may be formed. In this case, the communication flow path RX1 constitutes a part of the "supply common liquid chamber MN1", and the communication flow path RX2 constitutes a part of the "discharge common liquid chamber MN2". Further, a plurality of communication flow paths RX1 commonly provided for some nozzles N among the M nozzles N may be formed, or a plurality of communication flow paths RX2 commonly provided for some nozzles N among the M nozzles N may be formed.

As illustrated in FIG. 8, in the present embodiment, the communication flow path RX1 is provided to communicate with the supply liquid chamber RA1, and extend in the W-axis direction and in the W2 direction when viewed from the supply liquid chamber RA1. Further, the communication flow path RK1 is provided to communicate with the communication flow path RX1, and extend in the Z-axis direction and in the W2 direction when viewed from the communication flow path RX1. Further, the communication flow path RR1 is provided to extend in the Z-axis direction and in the W2 direction when viewed from the communication flow path RK1.

Further, the communication flow path RX2 is provided to communicate with the discharge liquid chamber RA2, and extend in the W-axis direction and in the W1 direction when viewed from the discharge liquid chamber RA2. Further, the communication flow path RK2 is provided to communicate with the communication flow path RX2, and extend toward the Z-axis direction in the W1 direction when viewed from the communication flow path RX2. Further, the communication flow path RR2 is provided to extend in the Z-axis direction, in the W1 direction when viewed from the communication flow path RK2 and in the W2 direction when viewed from the communication flow path RR1.

Further, the nozzle flow path RN is provided to communicate with the communication flow path RR1 and the communication flow path RR2, and extend in the W-axis direction, in the W2 direction when viewed from the communication flow path RR1, and in the W1 direction when viewed from the communication flow path RR2. The nozzle flow path RN communicates with the nozzle N corresponding to the nozzle flow path RN.

The communication plate 382 is manufactured, for example, by processing a silicon single crystal substrate using semiconductor manufacturing technique. However, any known material or manufacturing method can be employed for manufacturing the communication plate 382.

As illustrated in FIGS. 7 and 8, the pressure chamber substrate 383 is provided in the Z1 direction of the communication plate 382. The pressure chamber substrate 383 is a plate-shaped member that is long in the V-axis direction and extends substantially parallel to the VW plane, and forms an ink flow path.

Specifically, on the pressure chamber substrate 383, M pressure chambers CB1 corresponding to one-to-one with the M nozzles N and M pressure chambers CB2 corresponding to one-to-one with the M nozzles N are formed. Hereinafter, the pressure chamber CB1 and the pressure chamber CB2 are collectively referred to as a pressure chamber CB. The pressure chamber CB1 communicates with the communication flow path RK1 and the communication flow path RR1, and is provided to couple an end of the communication flow path RK1 in the W1 direction to an end of the communication flow path RR1 in the W2 direction when viewed in the Z-axis direction and extend in the W-axis direction. Further, the pressure chamber CB2 communicates with the communication flow path RK2 and the communication flow path RR2, and is provided to couple an end of the communication flow path RK2 in the W2 direction to an end of the communication flow path RR2 in the W1 direction when viewed in the Z-axis direction, and extend in the W-axis direction. The number of pressure chambers CB provided corresponding to one nozzle N may be one; in other words, either one of the pressure chamber CB1 and the pressure chamber CB2 may be provided for one nozzle N.

The pressure chamber substrate 383 is manufactured, for example, by processing a silicon single crystal substrate using semiconductor manufacturing technique. However, any known material or manufacturing method can be employed for manufacturing the pressure chamber substrate 383.

In the following, the ink flow path communicating with the supply common liquid chamber MN1, the nozzle N, and the discharge common liquid chamber MN2 will be referred to as an "individual flow path RJ", and the ink flow path coupled to the supply common liquid chamber MN1 and the discharge common liquid chamber MN2 not communicating with the nozzle N will be referred to as a "bypass flow path BP".

Figure 9:
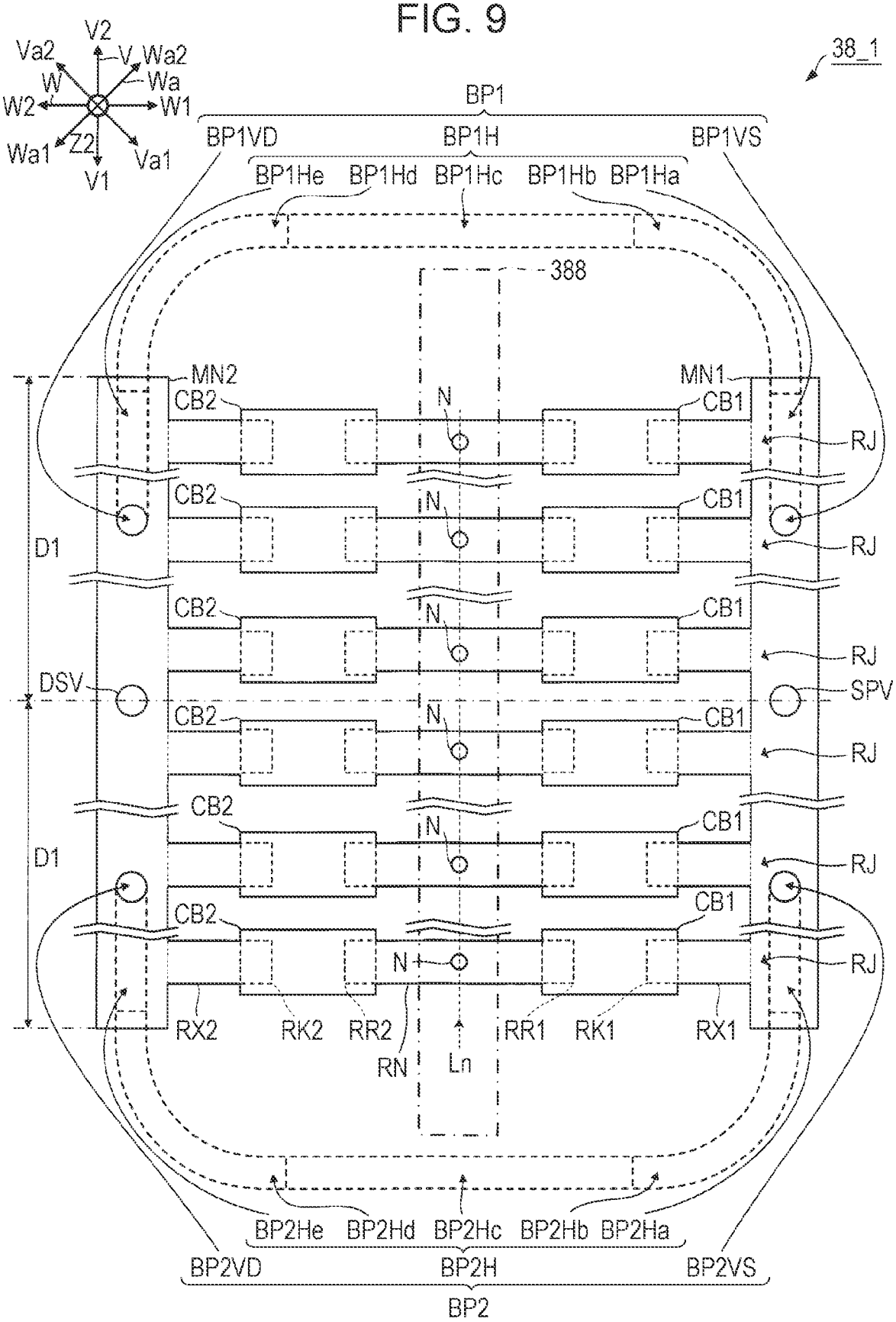
FIG. 9 is a plan view of the head unit seen in the Z2 direction.
Figure 10:
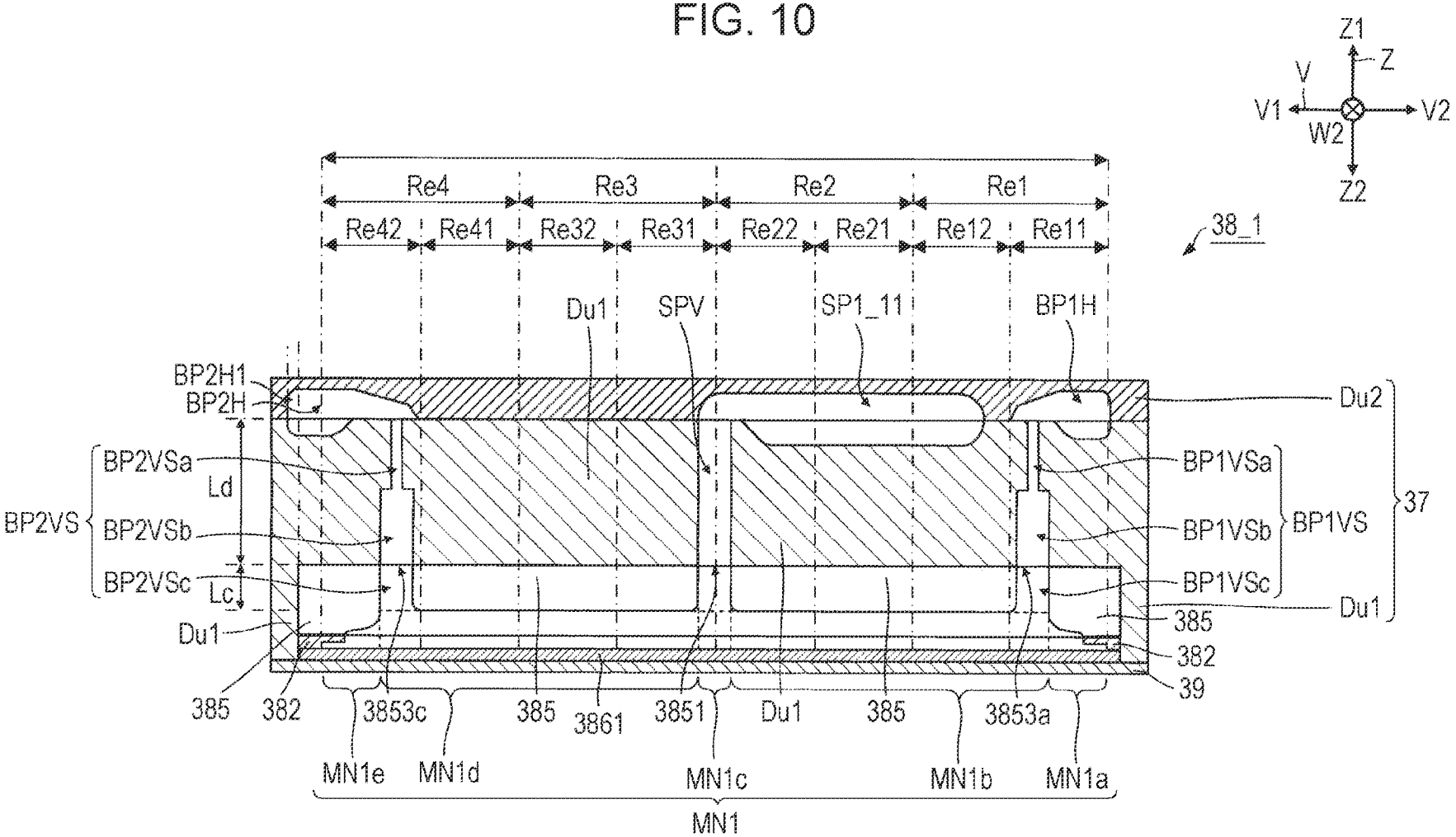
FIG. 10 is a cross-sectional view taken along line X-X in FIG. 7.

FIG. 9 is a plan view of the head unit 38_1 seen in the Z2 direction. In the figure shown in FIG. 9, the wiring member 388 is indicated by a dashed line to show a positional relationship between the bypass flow path BP and the wiring member 388. FIG. 10 is a cross-sectional view taken along the line X-X in FIG. 7. The X-X line is a virtual line segment passing through a bypass port 3853*a* provided in the W1 direction and the V2 direction, the inlet 3851, and a bypass port 3853*c* provided in the W1 direction and the V1 direction. In the figure shown in FIG. 10, in addition to the cross section of the head unit 38_1, the cross section of the flow path distribution portion 37 and the fixing plate 39 is also illustrated.

As illustrated in FIG. 9, the supply common liquid chamber MN1 and the discharge common liquid chamber MN2 are communicated by M individual flow paths RJ corresponding one-to-one to M nozzles N. As described above, each individual flow path RJ includes the communication flow path RX1 that communicates with the supply common liquid chamber MN1, the communication flow path RK1 that communicates with the communication flow path RX1, the pressure chamber CB1 that communicates with the communication flow path RK1, a communication flow path RR1 that communicates with the pressure chamber CB1, the nozzle flow path RN that communicates with the communication flow path RR1, the communication flow path RR2 that communicates with the nozzle flow path RN, the pressure chamber CB2 that communicates with the communication flow path RR2, the communication flow path RK2 that communicates with the pressure chamber CB2, and the communication flow path RX2 that communicates with the communication flow path RK2 and the discharge common liquid chamber MN2.

As illustrated in FIGS. 9 and 10, the supply common liquid chamber MN1 and the discharge common liquid chamber MN2 are coupled to each other by a first bypass flow path BP1 and a second bypass flow path BP2. The first bypass flow path BP1 and the second bypass flow path BP2 are collectively referred to as a bypass flow path BP. Further, the first bypass flow path BP1 corresponding to the head unit 38_*k* may be referred to as a first bypass flow path BP1_*k*. Similarly, the second bypass flow path BP2 corresponding to the head unit 38_*k* may be referred to as a second bypass flow path BP2_*k*. k is an integer from 1 to 6.

As illustrated in FIG. 9, the first bypass flow path BP1 has a supply vertical portion BP1VS, a bypass horizontal portion BP1H, and a discharge vertical portion BP1VD. The supply vertical portion BP1VS extends in the Z-axis direction, communicates with the supply common liquid chamber MN1 at the end in the Z2 direction, and communicates with the bypass horizontal portion BP1H at the end in the Z1 direction. The supply vertical portion BP1VS is an example of a "first vertical portion". The bypass horizontal portion BP1H is an example of a "first portion".

As illustrated in FIG. 10, the supply vertical portion BP1VS is defined by the first flow path member Du1 and the case 385. The supply vertical portion BP1VS has a vertical portion BP1VSa, a vertical portion BP1VSb, and a vertical portion BP1VSc. The vertical portion BP1VSa and the vertical portion BP1VSb are defined by the first flow path member Du1. The vertical portion BP1VSc is defined by the case 385. As illustrated in FIG. 10, the cross-sectional area of the vertical portion BP1VSa is smaller than the cross-sectional area of the vertical portion BP1VSb. The cross-sectional areas of the vertical portion BP1VSb and the cross-sectional area of the vertical portion BP1VSc are substantially the same. The cross-sectional area of the flow path is the area of a cut surface cut by a plane intersecting in the extending direction of the flow path, typically an orthogonal plane. As the cross-sectional area of the flow path decreases, the flow path resistance increases. Therefore, the average flow path resistance of unit length of the vertical portion BP1VSa and the vertical portion BP1VSb is larger than the average flow path resistance of unit length of the vertical portion BP1VSc. Further, the average flow path resistance of unit length of the supply vertical portion BP1VS and BP2VS is larger than the average flow path resistance of the unit length of the bypass horizontal portion BP1H.

The bypass horizontal portion BP1H is positioned substantially parallel to the VW plane. The bypass horizontal portion BP1H has a straight portion BP1Ha, a bent portion BP1Hb, a straight portion BP1Hc, a bent portion BP1Hd, and a straight portion BP1He. The bent portion BP1Hb and the bent portion BP1Hd are bent to bypass the wiring member 388. The straight portion BP1Ha extends in the V-axis direction, communicates with the supply vertical portion BP1VS at the end in the V1 direction, and communicates with the bent portion BP1Hb at the end in the V2 direction. The bent portion BP1Hb is bent 90 degrees so as to be convex in a Wa2 direction, communicates with the straight portion BP1Ha at the end in the V1 direction, and communicates with the straight portion BP1Hc at the end in the W2 direction. The Wa2 direction is a direction obtained by rotating the W1 direction counterclockwise by 45 degrees. The Wa2 direction and a Wa1 direction, which is the direction opposite to the Wa2 direction, are collectively referred to as a Wa-axis direction. The straight portion BP1Hc extends in the W-axis direction, communicates with the bent portion BP1Hb at the end in the W1 direction, and communicates with the bent portion BP1Hd at the end in the W2 direction. The bent portion BP1Hd is bent 90 degrees so as to be convex in a Va2 direction, communicates with the straight portion BP1Hc at the end in the W1 direction, and communicates with the straight portion BP1He at the end in the V1 direction. The Va2 direction is a direction obtained by rotating the V2 direction counterclockwise by 45 degrees. The Va2 direction and a Va1 direction, which is the direction opposite to the Va2 direction, are collectively referred to as a Va-axis direction. The straight portion BP1He extends in the V-axis direction, communicates with the bent portion BP1Hd at the end in the V2 direction, and communicates with the discharge vertical portion BP1VD at the end in the V1 direction.

The discharge vertical portion BP1VD extends in the Z-axis direction, communicates with the discharge common liquid chamber MN2 at the end in the Z2 direction, and communicates with the straight portion BP1He at the end in the Z1 direction. Although not illustrated in the figure, the discharge vertical portion BP1VD is defined by the first flow path member Du1 and the case 385, similarly to the supply vertical portion BP1VS. The discharge vertical portion BP1VD has a portion defined by the first flow path member Du1 and a portion defined by the case 385. In the portion of the discharge vertical portion BP1VD defined by the first flow path member Du1, there is a location the cross-sectional area changes as in the supply vertical portion BP1VS. The cross-sectional area of the discharge vertical portion BP1VD at the end in the Z1 direction is smaller than the cross-sectional area at the end in the Z2 direction.

As illustrated in FIG. 9, the second bypass flow path BP2 has a supply vertical portion BP2VS, a bypass horizontal portion BP2H, and a discharge vertical portion BP2VD. The supply vertical portion BP2VS extends in the Z-axis direction, communicates with the supply common liquid chamber MN1 at the end in the Z2 direction, and communicates with the bypass horizontal portion BP2H at the end in the Z1 direction.

The supply vertical portion BP2VS is an example of a "second vertical portion". The bypass horizontal portion BP2H is an example of the "first portion". Further, the bypass horizontal portion BP1H and the bypass horizontal portion BP2H are collectively referred to as a bypass horizontal portion BPH. Further, the bypass horizontal portion BP1H and the bypass horizontal portion BP2H corresponding to the head unit 38_*k* may be referred to as a bypass horizontal portion BP1H_k and a bypass horizontal portion BP2H_k, respectively. k is an integer from 1 to 6.

As illustrated in FIG. 10, the supply vertical portion BP2VS is defined by the first flow path member Du1 and the case 385. The supply vertical portion BP2VS has a vertical portion BP2VSa, a vertical portion BP2VSb, and a vertical portion BP2VSc. The vertical portion BP2VSa and the vertical portion BP2VSb are defined by the first flow path member Du1. The vertical portion BP2VSc is defined by the case 385. As illustrated in FIG. 10, the cross-sectional area of the vertical portion BP2VSa is smaller than the cross-sectional area of the vertical portion BP2VSb. The cross-sectional areas of the vertical portion BP2VSb and the cross-sectional area of the vertical portion BP2VSc are substantially the same.

The bypass horizontal portion BP2H is positioned substantially parallel to the VW plane. The bypass horizontal portion BP2H has a straight portion BP2Ha, a bent portion BP2Hb, a straight portion BP2Hc, a bent portion BP2Hd, and a straight portion BP2He. The straight portion BP2Ha extends in the V-axis direction, communicates with the supply vertical portion BP2VS at the end in the V2 direction, and communicates with the bent portion BP2Hb at the end in the V1 direction. The bent portion BP2Hb is bent 90 degrees so as to be convex in a Va1 direction, communicates with the straight portion BP2Ha at the end in the V2 direction, and communicates with the straight portion BP2Hc at the end in the W2 direction. The straight portion BP2Hc extends in the W-axis direction, communicates with the bent portion BP2Hb at the end in the W1 direction, and communicates with the bent portion BP2Hd at the end in the W2 direction. The bent portion BP2Hd is bent 90 degrees so as to be convex in a Wa1 direction, communicates with the straight portion BP2Hc at the end in the W1 direction, and communicates with the straight portion BP2He at the end in the V2 direction. The straight portion BP2He extends in the V-axis direction, communicates with the bent portion BP2Hd at the end in the V1 direction, and communicates with the discharge vertical portion BP2VD at the end in the V2 direction.

Further, as illustrated in FIG. 10, the bypass horizontal portion BP2H has a portion BP2H1 that is not overlapped with the case 385 in the plan view. On the other hand, the entirety of the bypass horizontal portion BP1H is totally overlapped with the case 385 in the plan view.

Further, as illustrated in FIG. 10, the total length Ld of the vertical portion BP1VSa and the vertical portion BP1VSb in the Z1 direction is longer than the length Lc of the vertical portion BP1VSc in the Z1 direction. Similarly, the total length Ld of the vertical portion BP2VSa and the vertical portion BP2VSb in the Z1 direction is longer than the length Lc of the vertical portion BP2VSc in the Z1 direction.

Although not shown, similarly to the supply vertical portion BP1VS and the supply vertical portion BP2VS, the length of the portion defined by the first flow path member Du1 of the discharge vertical portion BP1VD in the Z1 direction is longer than the length of the portion defined by the case 385 of the discharge vertical portion BP1VD in the Z1 direction, and the length of the portion defined by the first flow path member Du1 of the discharge vertical portion BP2VD in the Z1 direction is longer than the length of the portion defined by the case 385 of the discharge vertical portion BP2VD in the Z1 direction.

As illustrated in FIGS. 9 and 10, the supply common liquid chamber MN1 communicates with an introduction flow path SPV. The introduction flow path SPV communicates with the supply common liquid chamber MN1 between the first bypass flow path BP1 and the second bypass flow path BP2 in the V-axis direction. Similarly, the discharge common liquid chamber MN2 communicates with a flowing-out flow path DSV. The flowing-out flow path DSV communicates with the discharge common liquid chamber MN2 between the first bypass flow path BP1 and the second bypass flow path BP2 in the V-axis direction. The introduction flow path SPV is positioned at the midpoint between the end in the V1 direction and the end in the V2 direction, of the supply common liquid chamber MN1, in the plan view. Similarly, the flowing-out flow path DSV is positioned at the midpoint between the end in the V1 direction and the end in the V2 direction, of the discharge common liquid chamber MN2, in the plan view. That is, in the V-axis direction, a distance from the end of the supply common liquid chamber MN1 in the V1 direction to the introduction flow path SPV, and a distance from the introduction flow path SPV to the end of the supply common liquid chamber MN1 in the V2 direction are the same, and both are a distance D1. Similarly, in the V-axis direction, a distance from the end of the discharge common liquid chamber MN2 in the V1 direction to the flowing-out flow path DSV and a distance from the flowing-out flow path DSV to the end of the discharge common liquid chamber MN2 in the V2 direction are the same, and both are the distance D1.

Hereinafter, the introduction flow path SPV corresponding to the head unit 38_*k* may be referred to as an introduction flow path SPV_k. Similarly, the flowing-out flow path DSV corresponding to the head unit 38_*k* may be referred to as a flowing-out flow path DSV_k.

As illustrated in FIG. 10, from the end of the supply common liquid chamber MN1 in the V2 direction to the side surface of the supply vertical portion BP1VS in the V2 direction, as the position on the V-axis approaches the V2 direction, the length in the Z-axis direction in the supply common liquid chamber MN1 decreases monotonically. In addition, from the end of the supply common liquid chamber MN1 in the V1 direction to the side surface of the supply vertical portion BP2VS in the V1 direction, as the position on the V-axis approaches the V1 direction, the length in the Z-axis direction decreases monotonically. Although not shown, from the end of the discharge common liquid chamber MN2 in the V2 direction to the side surface of the discharge vertical portion BP1VD in the V2 direction, as the position on the V-axis approaches the V2 direction, the length in the Z-axis direction in the discharge common liquid chamber MN2 decreases monotonically. In addition, from the end of the discharge common liquid chamber MN2 in the V1 direction to the side surface of the discharge vertical portion BP2VD in the V1 direction, as the position on the V-axis approaches the V1 direction, the length in the Z-axis direction decreases monotonically.

As illustrated in FIG. 10, the supply common liquid chamber MN1 has a V2 end region MN1*a*, a V2 communication region MN1*b*, a distribution region MN1*c*, a V1 communication region MN1*d*, and a V1 end region MN1*e*. The V2 end region MN1*a* is an example of the "second region". The V2 communication region MN1*b* is an example of the "first region".

The V2 end region MN1*a* is a region of the supply common liquid chamber MN1 positioned in the V2 direction with respect to the supply vertical portion BP1VS. More specifically, being positioned in the V2 direction with respect to the supply vertical portion BP1VS means being positioned in the V2 direction with respect to the WZ plane in contact with the wall surface of the supply vertical portion BP1VS in the V2 direction. That is, the V2 end region MN1*a* is a region positioned toward the V2 direction among the two regions obtained by being separated by the WZ plane in which the supply common liquid chamber MN1 is in contact with the wall surface of the supply vertical portion BP1VS in the V2 direction.

The V2 communication region MN1*b* is a region of the supply common liquid chamber MN1 positioned from the introduction flow path SPV to the supply vertical portion BP1VS. More specifically, being positioned from the introduction flow path SPV to the supply vertical portion BP1VS means being positioned in the V2 direction with respect to the WZ plane in contact with the wall surface of the introduction flow path SPV in the V2 direction and being positioned in the V1 direction with respect to the WZ plane in contact with the wall surface of the supply vertical portion BP1VS in the V2 direction. That is, the V2 communication region MN1*b* is a region in which the region positioned toward the V2 direction, of two regions obtained by being separated by the WZ plane in which the supply common liquid chamber MN1 is in contact with the wall surface of the introduction flow path SPV in the V2 direction, and the region positioned toward the V1 direction, of two regions obtained by being separated by the WZ plane in which the supply common liquid chamber Mn1 is in contact with the wall surface of the supply vertical portion BP1VS in the V2 direction, are overlapped with each other.

The distribution region MN1*c* is a region positioned in the V1 direction with respect to the WZ plane in contact with the wall surface of the introduction flow path SPV in the V2 direction and positioned in the V2 direction with respect to the WZ plane in contact with the wall surface of the introduction flow path SPV in the V1 direction, of the supply common liquid chamber MN1.

The V1 communication region MN1*d* is a region of the supply common liquid chamber MN1 positioned from the introduction flow path SPV to the supply vertical portion BP2VS. More specifically, being positioned from the introduction flow path SPV to the supply vertical portion BP2VS means being positioned in the V1 direction with respect to the WZ plane in contact with the wall surface of the introduction flow path SPV in the V1 direction and being positioned in the V2 direction with respect to the WZ plane in contact with the wall surface of the supply vertical portion BP2VS in the V1 direction. That is, the V1 communication region MN1*d* is a region in which the region positioned toward the V1 direction, of two regions obtained by being separated by the WZ plane in which the supply common liquid chamber MN1 is in contact with the wall surface of the introduction flow path SPV in the V1 direction, and the region positioned toward the V2 direction, of two regions obtained by being separated by the WZ plane in which the supply common liquid chamber Mn1 is in contact with the wall surface of the supply vertical portion BP2VS in the V1 direction, are overlapped with each other.

The V1 end region MN1*e* is a region of the supply common liquid chamber MN1 positioned in the V1 direction with respect to the supply vertical portion BP2VS. More specifically, being positioned in the V1 direction with respect to the supply vertical portion BP2VS means being positioned in the V1 direction with respect to the WZ plane in contact with the wall surface of the supply vertical portion BP2VS in the V1 direction. That is, the V1 end region MN1*e* is a region positioned toward the V1 direction among the two regions obtained by being separated by the WZ plane in which the supply common liquid chamber MN1 is in contact with the wall surface of the supply vertical portion BP1VS in the V1 direction. The V2 end region MN1*a* will be described with reference to FIG. 11.

Figure 11:
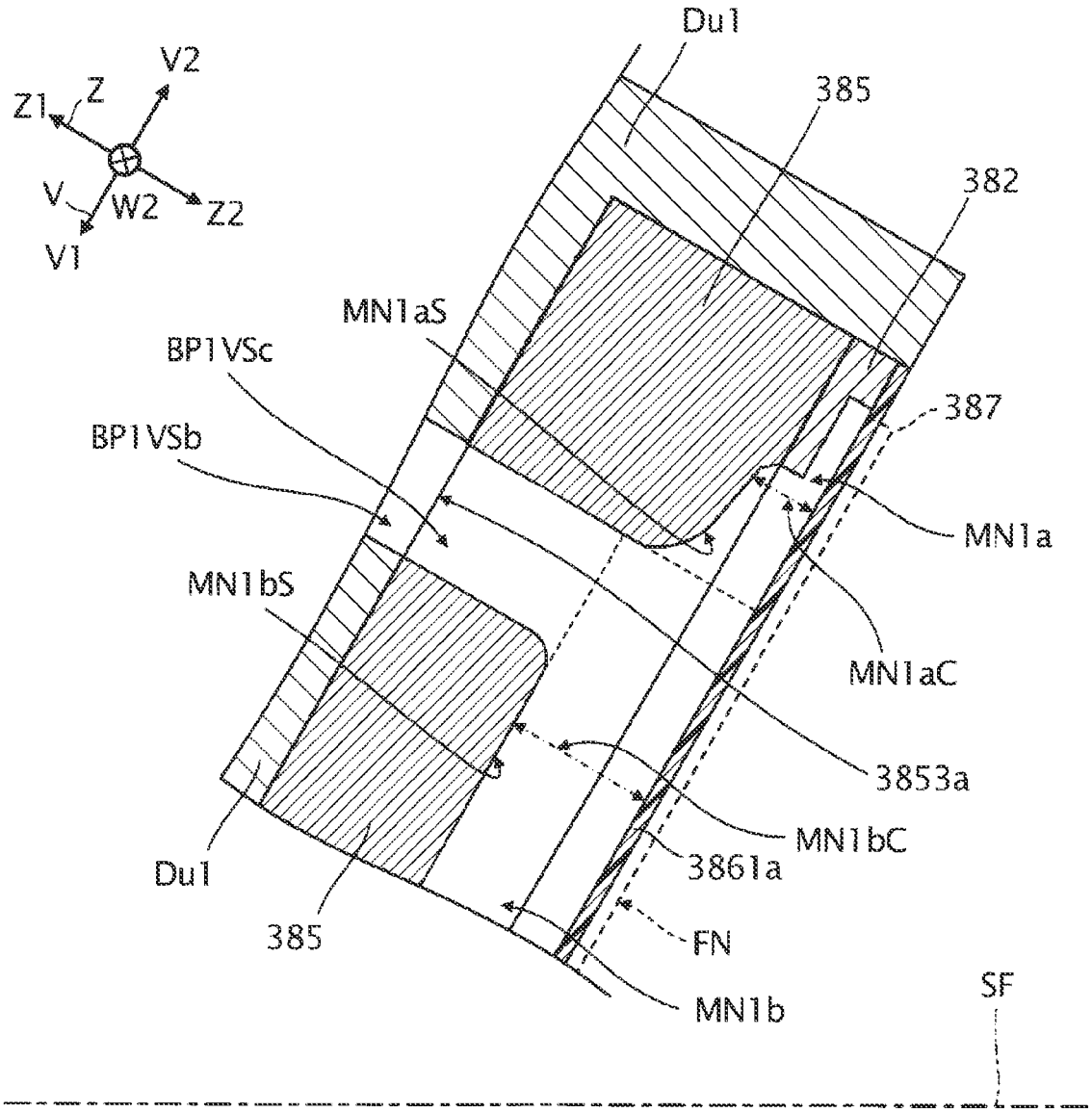
FIG. 11 is an enlarged view of a vicinity of a V2 end region.

FIG. 11 is an enlarged view of a vicinity of the V2 end region MN1*a*. The figure shown in FIG. 11 shows the vicinity of the V2 end region MN1*a* in a state where the nozzle surface FN is inclined by 60 degrees with respect to the horizontal plane SF. When the head module 3 is used at an angle, an inclination angle of the nozzle surface FN is greater than 0 degrees and 90 degrees or less. As illustrated in FIG. 11, a surface MN1*a*S of the V2 end region MN1*a* is disposed in the Z2 direction with respect to the surface MN1*b*S of the V2 communication region MN1*b*. Here, the surface MN1*a*S is a surface of the V2 end region MN1*a* in the Z1 direction. The reference to the surface in the Z1 direction includes a case in which, when the normal direction of the surface is decomposed into the Z-axis direction, the V-axis direction, and the W-axis direction, the decomposed V-axis direction is the V1 direction, in addition to the case where the normal direction of the surface is the Z1 direction. In FIG. 11, the nozzle plate 387 is shown by a broken line, and the fixing plate 39 and the support plate 3861*b* of the compliance substrate 3861 are not shown.

As illustrated in FIG. 11, the position of the end of the supply vertical portion BP1VS in the Z2 direction coincides with the position of the surface of the V2 communication region MN1*b* in the Z1 direction.

As illustrated in FIG. 11, the surface of the V2 end region MN1*a* in the Z1 direction is constituted by a surface of the case 385 and a surface of the communication plate 382. The surface of the case 385 in the Z1 direction in the V2 end region MN1*a* is a tapered surface. The surface of the communication plate 382 in the Z1 direction in the V2 end region MN1*a* is parallel to the VW plane. The V2 direction end of the surface of the case 385 in the Z1 direction in the V2 end region MN1*a* is positioned in the Z1 direction with respect to the V1 direction end of the surface of the communication plate 382 in the Z1 direction in the V2 end region MN1*a*. The V2 end region MN1*a* has a portion having a dimension in the Z-axis direction that is equal to or less than half of the maximum dimension of the V2 communication region MN1*b* in the Z-axis direction. In the example of FIG. 11, in the V-axis direction, the dimension MN1*a*C of the V2 end region MN1*a* in the Z-axis direction, which is positioned between the position on the wall surface of the supply vertical portion BP1VS in the V2 direction and the position of the end of the V2 end region MN1*a* in the V2 direction, is equal to or less than half of the maximum dimension of the V2 communication region MN1*b* in the Z-axis direction. The dimension in the Z-axis direction is the length in the Z-axis direction.

The shape of the V1 end region MN1*e* has a substantially line-symmetrical relationship with the shape of the V2 end region MN1*a* about the center of the introduction flow path SPV in a plan view as seen in the W2 direction. Specifically, the surface of the V1 end region MN1*e* in the Z1 direction is constituted by a surface of the case 385 and a surface of the communication plate 382. The surface of the case 385 in the Z1 direction in the V1 end region MN1*e* is a tapered surface. The surface of the communication plate 382 in the Z1 direction in the V1 end region MN1*e* is parallel to the VW plane. The V1 direction end of the surface of the case 385 in the Z1 direction in the V1 end region MN1*e* is positioned in the Z1 direction with respect to the V2 direction end of the surface of the communication plate 382 in the Z1 direction in the V1 end region MN1*e*.

Description will be made referring back to FIGS. 7 and 8. As illustrated in FIGS. 7 and 8, the vibration plate 384 is provided in the Z1 direction with respect to the pressure chamber substrate 383. The vibration plate 384 is a plate-shaped member that is long in the V-axis direction and extends substantially parallel to the VW plane, and is a member that can vibrate elastically. The vibration plate 384 may be formed of the same member as the pressure chamber substrate 383.

As illustrated in FIGS. 7 and 8, on the surface of the vibration plate 384 in the Z1 direction, M piezoelectric elements PZ1 corresponding to one-to-one with the M pressure chambers CB1 and M piezoelectric elements PZ2 corresponding to one-to-one with the M pressure chambers CB2 are provided. Hereinafter, the piezoelectric element PZ1 and the piezoelectric element PZ2 are collectively referred to as a piezoelectric element PZq. The piezoelectric element PZq is a passive element that is deformed in response to a change in the potential of the drive signal Com.

As illustrated in FIGS. 7 and 8, the wiring member 388 is mounted on the surface of the vibration plate 384 in the Z1 direction. The wiring member 388 will be described with reference to FIG. 12.

Figure 12:
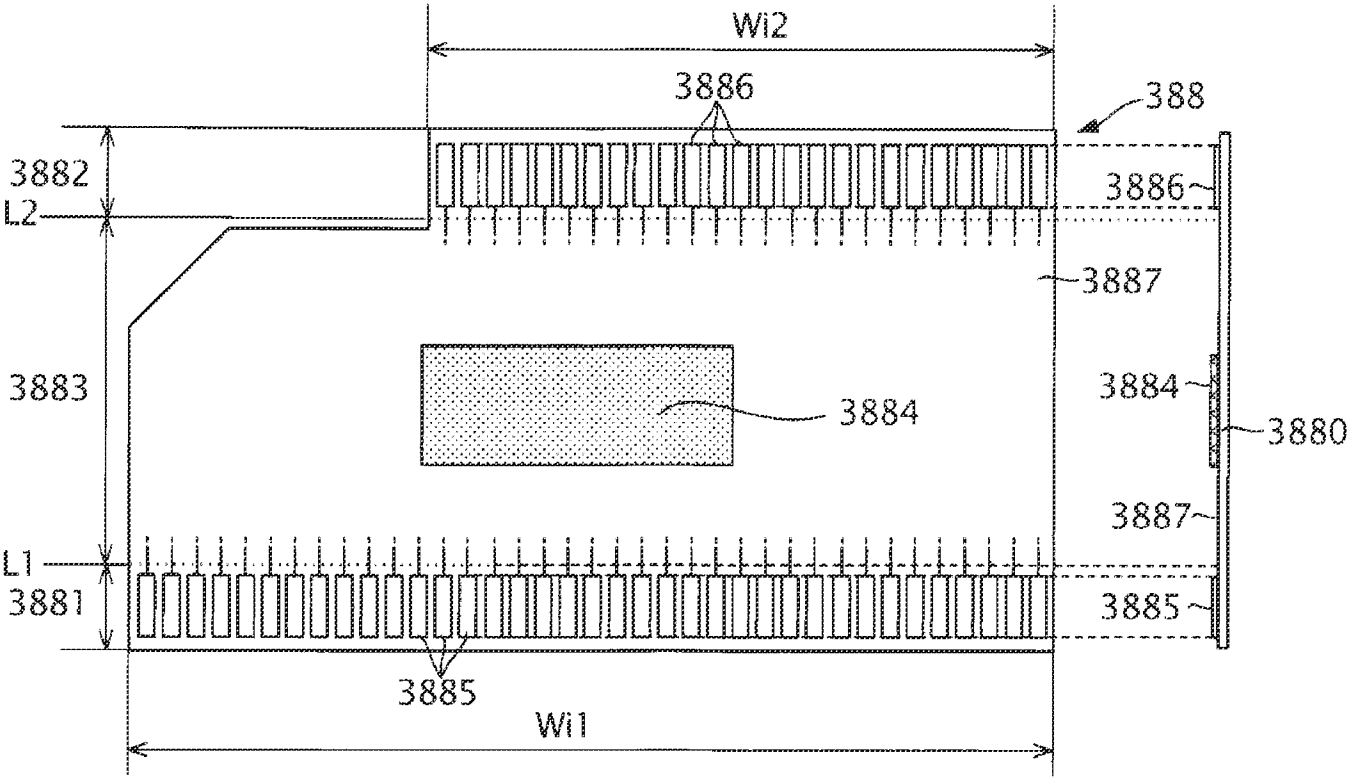
FIG. 12 is a plan view and a side view of a wiring member.

FIG. 12 is a plan view and a side view of the wiring member 388. The wiring member 388 is configured to include a flexible base material 3880 and a plurality of wires formed on a wiring forming surface 3887 of the base material 3880. The wiring member 388 is, for example, a chip on film (COF) substrate or a flexible printed circuit (FPC) substrate, and the COF substrate is employed in the present embodiment. The wiring member 388 illustrated in FIG. 12 is in a state in which no external force is applied to the wiring member 388. Wiring for transmitting control signals and a power supply voltage supplied from the wiring substrate 35 to the head units 38 is formed on the wiring forming surface 3887.

The wiring member 388 includes an output terminal portion 3881, an input terminal portion 3882, and a relay portion 3883. As illustrated in FIG. 8, the output terminal portion 3881 and the input terminal portion 3882 are portions positioned at both ends of the wiring member 388. That is, in the wiring member 388, the relay portion 3883 is positioned between the output terminal portion 3881 and the input terminal portion 3882. In FIG. 8, a boundary L1 of the output terminal portion 3881 and the relay portion 3883 and a boundary L2 of the input terminal portion 3882 and the relay portion 3883 are illustrated.

As illustrated in FIG. 12, a width Wi2 of the input terminal portion 3882 is smaller than a width Wi1 of the output terminal portion 3881. Further, the width Wi2 is larger than half of the width Wi1.

Further, as illustrated in FIGS. 7 and 12, the wiring member 388 has a shape in which the input terminal portion 3882 is closer to one side with respect to the entire width of the wiring member 388. Specifically, in the example of FIG. 12, the input terminal portion 3882 is closer to the right side. More specifically, when the wiring member 388 is viewed from the above, the right end of the input terminal portion 3882 and the right end of the output terminal portion 3881 are overlapped with each other; however, the left end of the input terminal portion 3882 is positioned on the right side as compared with the left end of the output terminal portion 3881.

As illustrated in FIG. 12, a plurality of output terminals 3885 electrically coupled to each piezoelectric element PZq are formed on the wiring forming surface 3887 of the output terminal portion 3881, and a plurality of input terminals 3886 electrically coupled to the wiring substrate 35 are formed on the wiring forming surface 3887 of the input terminal portion 3882. Further, a drive circuit 3884 is mounted on the relay portion 3883. The drive circuit 3884 uses the control signal SI and the power supply voltage supplied from the wiring substrate 35 to generate a drive signal Com for each piezoelectric element PZq. The drive signal Com generated by the drive circuit 3884 is supplied to the head units 38 via the output terminals 3885. The drive circuit 3884 is an electric circuit that switches whether or not to supply the drive signal Com to the piezoelectric element PZq under the control of the control signal SI. The drive circuit 3884 supplies the drive signal Com to an upper electrode of the piezoelectric element PZq.

As illustrated in FIGS. 7 and 8, in the wiring member 388, the output terminal portion 3881 is bent at the boundary L1 with the relay portion 3883, and the input terminal portion 3882 is bent at the boundary L2 with the relay portion 3883. As illustrated in FIGS. 7 and 8, the wiring member 388 extends substantially parallel along the VZ plane. More specifically, the wiring member 388 extends from the vibration plate 384 toward the wiring substrate 35 in a state of being inclined with respect to the normal line of the vibration plate 384.

As illustrated in FIGS. 7 and 8, the case 385 is provided in the Z1 direction with respect to the communication plate 382. The case 385 is a member that is long in the V-axis direction, and an ink flow path is formed. Specifically, one supply liquid chamber RB1 and one discharge liquid chamber RB2 are formed in the case 385. Among them, the supply liquid chamber RB1 is provided to communicate with the supply liquid chamber RA1, and extend in the V-axis direction, in the Z1 direction when viewed from the supply liquid chamber RA1. Further, the discharge liquid chamber RB2 is provided to communicate with the discharge liquid chamber RA2, and extend in the V-axis direction, in the Z1 direction when viewed from the discharge liquid chamber RA2 and in the W2 direction when viewed from the supply liquid chamber RB1.

Further, in the case 385, the inlet 3851 that communicates with the supply liquid chamber RB1, an outlet 3852 that communicates with the discharge liquid chamber RB2, the bypass port 3853*a*, the bypass port 3853*b*, the bypass port 3853*c*, and the bypass port 3853*d* are provided. Then, in the supply liquid chamber RB1, ink is supplied from the liquid container 93 to the supply common liquid chamber MN1 via the inlet 3851. The ink supplied to the supply common liquid chamber MN1 is stored in the discharge common liquid chamber MN2 via any one of the first bypass flow path BP1 via the individual flow path RJ, the bypass port 3853*a*, and the bypass port 3853*b*, and the second bypass flow path BP2 via the bypass port 3853*c* and the bypass port 3853*d*. The ink stored in the discharge common liquid chamber MN2 is collected via the outlet 3852.

Further, in the case 385, an opening 3850 is provided. Inside the opening 3850, the pressure chamber substrate 383, the vibration plate 384, and the wiring member 388 are provided. The case 385 is formed, for example, by injection molding of a resin material. However, any known material or manufacturing method can be employed for manufacturing the case 385.

Description will be made referring back to FIG. 3. Although the head unit 38_1 has been described with reference to FIGS. 7 to 11, the configuration of the head units 38_2 to 38_6 is also the same as the configuration of the head unit 38_1. However, the wiring members 388 of the head units 38_1, 38_3, and 38_5 are arranged such that the input terminal portion 3882 is closer to the V1 direction. On the other hand, the wiring members 388 of the head units 38_2, 38_4, and 38_6 are arranged such that the input terminal portion 3882 is closer to the V2 direction. The wiring members 388 of the head units 38_1 to 38_6 all have the same shape. The wiring members 388 of the head units 38_2, 38_4, and 38_6 are arranged in a direction rotated by 180 degrees with respect to the direction of the wiring members 388 of the head unit 38_1, about the Z-axis direction as an axis. The wiring member 388 of the head unit 38_1 and the wiring member 388 of the head unit 38_2 are arranged so as to be point-symmetrical to each other. The wiring member 388 of the head unit 38_3 and the wiring member 388 of the head unit 38_4 are also arranged so as to be point-symmetrical to each other. The wiring member 388 of the head unit 38_5 and the wiring member 388 of the head unit 38_6 are also arranged so as to be point-symmetrical to each other.

The fixing plate 39 is adhered to the surface of the compliance substrate 3861 in the Z2 direction and the surface of the first flow path member Du1 in the Z2 direction. That is, six exposure openings 391 provided in the fixing plate 39 expose the nozzle surface FN of the nozzle plate 387 within the exposure openings 391. The nozzle surface FN is a surface on which a plurality of nozzles N are formed and faces the Z2 direction of the nozzle plate 387, and is a surface perpendicular to the Z2 direction. The six exposure openings 391 are also arranged in zigzags, similar to the openings 351 and the notches 352 of the wiring substrate 35.

As illustrated in FIG. 8, the compliance substrate 3861 has a flexible film 3861*a* and a support plate 3861*b*. The flexible film 3861*a* is a flexible member and can employ, for example, a film made of a resin such as PPS, and the support plate 3861*b* is a rigid member, and can employ, for example, stainless steel. The flexible film 3861*a* is a member that covers the openings defining the supply liquid chamber RA1, the communication flow path RX1, the communication flow path RK1, the communication flow path RK2, the communication flow path RX2, and the discharge liquid chamber RA2 of the communication plate 382 in the Z2 direction by being fixed to the surface of the communication plate 382 in the Z2 direction. In other words, the flexible film 3861*a* is a member that defines the supply liquid chamber RA1, the communication flow path RX1, the communication flow path RK1, the communication flow path RK2, the communication flow path RX2, and the discharge liquid chamber RA2. The support plate 3861*b* is fixed to the surface of the flexible film 3861*a* in the Z2 direction, and has an opening formed at a position overlapping the supply liquid chamber RA1, the communication flow path RX1, the communication flow path RK1, the communication flow path RK2, the communication flow path RX2, and the discharge liquid chamber RA2, when viewed in the Z-axis direction. The fixing plate 39 is adhered to the support plate 3861*b* to seal the opening of the support plate 3861*b* in the Z2 direction. The space defined by the surface of the flexible film 3861*a* in the Z2 direction, the opening of the support plate 3861*b*, and the surface of the fixing plate 39 in the Z1 direction communicates with the atmosphere by an atmospheric communication passage (not shown), and the flexible film 3861*a* can absorb the pressure fluctuation generated in the head units 38 by being deformed in the Z1 direction and the Z2 direction by the space.

1.3.4. Flow Path

The flow path structure 34 and the flow path distribution portion 37 are provided with a first supply flow path Si1, a second supply flow path Si2, a first discharge flow path Do1, and a second discharge flow path Do2. Hereinafter, the first supply flow path Si1 and the second supply flow path Si2 are collectively referred to as a supply flow path Si. Similarly, the first discharge flow path Do1 and the second discharge flow path Do2 are collectively referred to as a discharge flow path Do. The supply flow path Si is a flow path for supplying ink to the supply common liquid chamber MN1 of each of the plurality of head units 38. The discharge flow path Do is a flow path for discharging ink from the discharge common liquid chambers MN2 of each of the plurality of head units 38.

Figure 13:
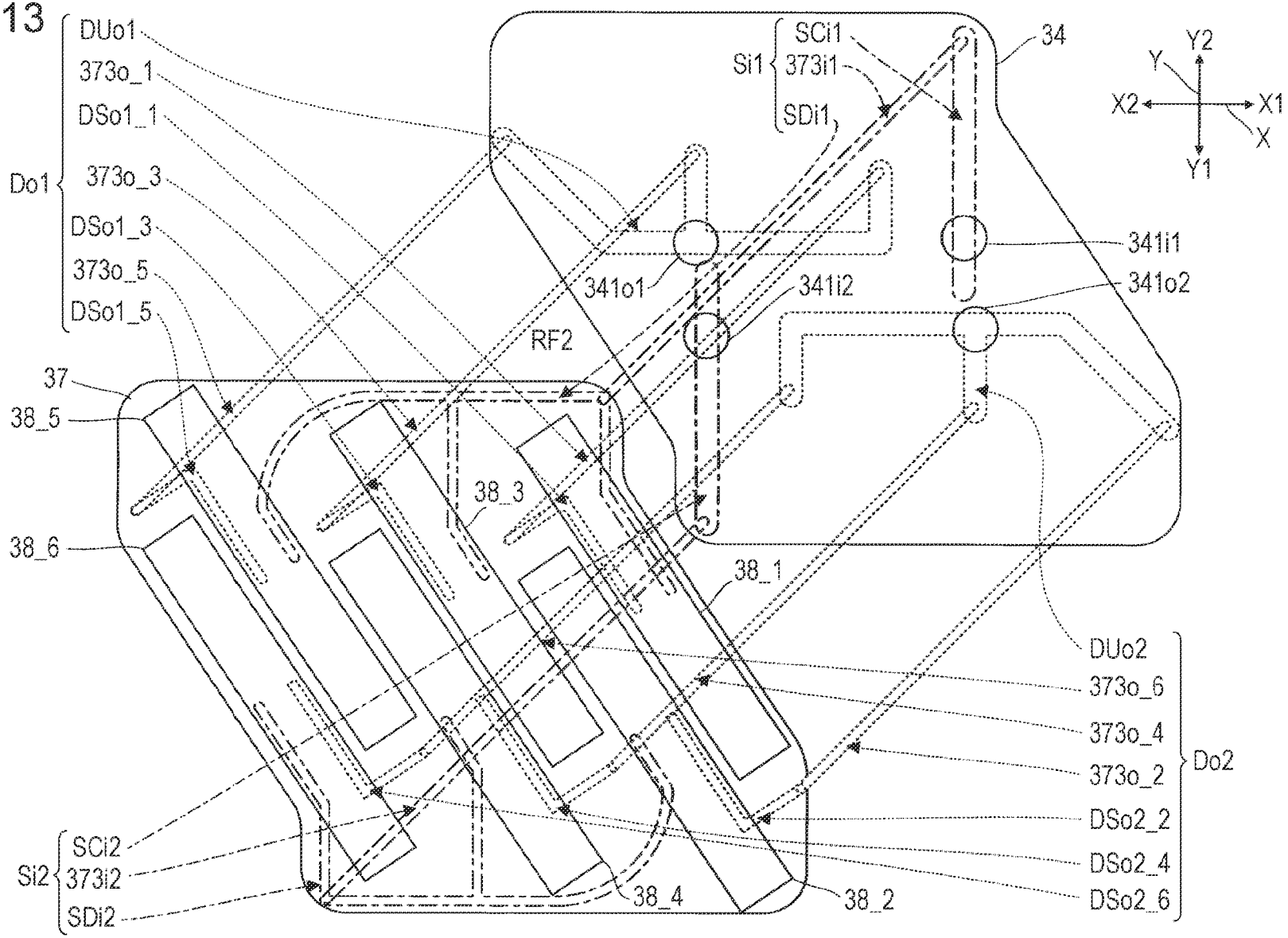
FIG. 13 is a diagram showing an outline of a flow path formed by the flow path structure and the flow path distribution portion.

FIG. 13 is a diagram showing an outline of a flow path formed by the flow path structure 34 and the flow path distribution portion 37. FIG. 13 shows the first supply flow path Si1, the second supply flow path Si2, the first discharge flow path Do1, and the second discharge flow path Do2. In the figure shown in FIG. 13, the direction perpendicular to the paper surface is the Z-axis direction. However, in order to prevent the drawing from being complicated, in the figured shown in FIG. 13, a flow path formed between the flow path structure 34 and the flow path distribution portion 37 and extending in the Z-axis direction, among the flow paths formed by the flow path structure 34 and the flow path distribution portion 37, is displayed so as to extend in a direction of 45 degrees to the upper right. Further, by displaying the length of the flow path so as to be longer than the original scale, in the figure shown in FIG. 13, the flow path structure 34 and the flow path distribution portion 37 are displayed so as not to be overlapped with each other. Further, in FIG. 13, the display of the bypass flow path BP is omitted. Further, in FIG. 13, the first supply flow path Si1 and the second supply flow path Si2 are indicated by dashed lines, and the first discharge flow path Do1 and the second discharge flow path Do2 are indicated by broken lines.

The first supply flow path Si1 is a flow path for supplying first ink to the head units 38_1, 38_3, and 38_5. The first supply flow path Si1 has a common supply flow path SCi1, the coupling pipe 373*i*1, and a supply distribution flow path SDi1. The second supply flow path Si2 is a flow path for supplying second ink to the head units 38_2, 38_4, and 38_6. The second supply flow path Si2 has a common supply flow path SCi2, the coupling pipe 373*i*2, and a supply distribution flow path SDi2.

The first discharge flow path Do1 is a flow path for discharging the first ink from the head units 38_1, 38_3, and 38_5. The first discharge flow path Do1 includes a discharge merging flow path DUo1, the coupling pipe 373*o*_1, an individual discharge flow path DSo1_1, the coupling pipe 373*o*_3, an individual discharge flow path DSo1_3, the coupling pipe 373*o*_5, and an individual discharge flow path DSo1_5.

The second discharge flow path Do2 is a flow path for discharging the second ink from the head units 38_2, 38_4, and 38_6. The second discharge flow path Do2 includes a discharge merging flow path DUo2, the coupling pipe 373*o*_2, an individual discharge flow path DSo2_2, the coupling pipe 373*o*_4, an individual discharge flow path DSo2_4, the coupling pipe 373*o*_6, and an individual discharge flow path DSo2_6.

The common supply flow path SCi1, the common supply flow path SCi2, the discharge merging flow path DUo1, and the discharge merging flow path DUo2 are formed in the flow path structure 34. The supply distribution flow path SDi1, the supply distribution flow path SDi2, the individual discharge flow path DSo1_1, the individual discharge flow path DSo1_3, the individual discharge flow path DSo1_5, the individual discharge flow path DSo2_2, the individual discharge flow path DSo2_4, and the individual discharge flow path DSo2_6 arm formed in the flow path distribution portion 37.

Of the flow paths formed by the flow path structure 34 and the flow path distribution portion 37, the flow path formed in the flow path structure 34 will be described with reference to FIG. 14, and the flow path formed by the flow path distribution portion 37 will be described with reference to FIGS. 15, 16, and 17.

Figure 14:
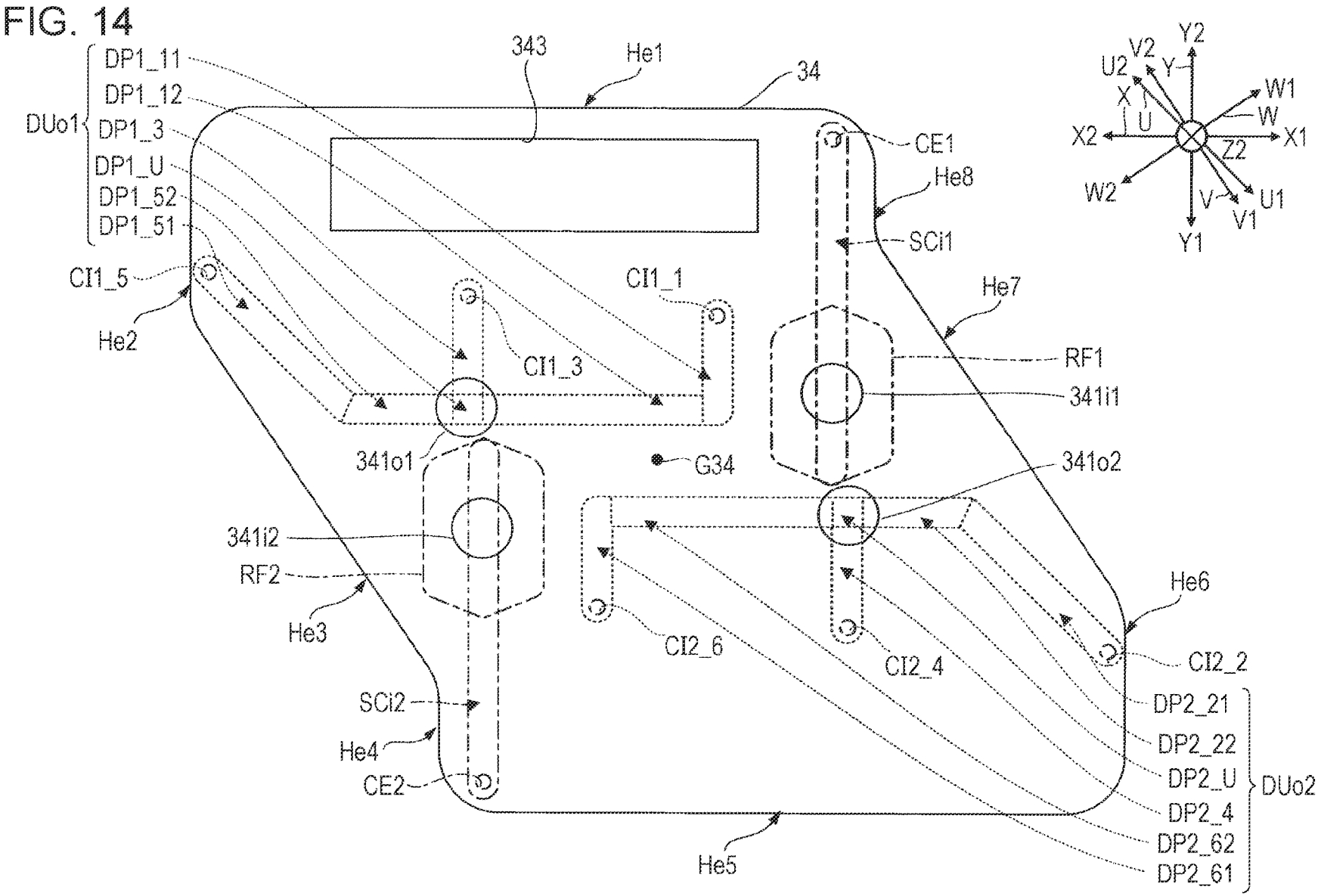
FIG. 14 is a diagram showing a flow path formed in the flow path structure.

FIG. 14 is a diagram showing a flow path formed in the flow path structure 34. The figure shown in FIG. 14 is a plan view of the flow path structure 34 when viewed in the Z2 direction. In the flow path structure 34, the common supply flow path SCi1, the common supply flow path SCi2, the discharge merging flow path DUo1, and the discharge merging flow path DUo2 are formed. Further, the flow path structure 34 has a filter RF1 and a filter RF2 in addition to the coupling pipes 341*i*1, 341*i*2, 341*o*1, and 341*o*2 described above. Hereinafter, the filter RF1 and the filter RF2 are collectively referred to as filters RF.

The coupling pipes 341*i*1, 341*i*2, 341*o*1, and 341*o*2 are provided so as to project to the surface of the flow path plate Su1 facing the Z1 direction. The coupling pipe 341*i*1 is a pipe body constituting a flow path for supplying the first ink to the flow path plate Su1. Further, the coupling pipe 341*i*2 is a pipe body constituting a flow path for supplying the second ink to the flow path plate Su1. On the other hand, the coupling pipe 341*o*1 is a pipe body constituting a flow path for discharging the first ink from the flow path plate Su1. Further, the coupling pipe 341*o*2 is a pipe body that constituting a flow path for discharging the second ink from the flow path plate Su1.

The filters RF are plate-shaped or sheet-shaped members that capture foreign matter and the like mixed in the ink while allowing the ink to pass through. The filters RF are made of metal fibers such as twill tatami or flat tatami. The filters RF are not limited to the structure using metal fibers, and may be made of resin fibers such as non-woven fabric, for example. The filters RF are typically disposed to be parallel to the XY plane.

The common supply flow path SCi1 and the common supply flow path SCi2 are arranged so as to be point-symmetrical with respect to the center of gravity G34 of the flow path structure 34. Similarly, the discharge merging flow path DUo1 and the discharge merging flow path DUo2 are arranged so as to be point-symmetrical with respect to the center of gravity G34 of the flow path structure 34.

The common supply flow path SCi1 communicates with the coupling pipe 341*i*1 via the filter RF1. Further, the common supply flow path SCi1 extends in the Y-axis direction and has the discharge port CE1 in the vicinity of the end in the Y2 direction. Further, a part of the common supply flow path SCi1 is arranged along the side He8. The discharge port CE1 communicates with the coupling pipe 373*i*1. Further, the discharge port CE1 is positioned in the vicinity of the apex when the side He1 and the side He8 intersect.

The common supply flow path SCi2 communicates with the coupling pipe 341*i*2 via the filter RF2. Further, the common supply flow path SCi2 extends in the Y-axis direction and has the discharge port CE2 in the vicinity of the end in the Y1 direction. Further, a part of the common supply flow path SCi2 is arranged along the side He4. The discharge port CE2 communicates with the coupling pipe 373*i*2. Further, the discharge port CE2 is positioned in the vicinity of the apex when the side He4 and the side He5 intersect.

The discharge merging flow path DUo1 has a discharge flow path portion DP1_11, a discharge flow path portion DP1_12, a discharge flow path portion DP1_3, a discharge flow path portion DP1_51, a discharge flow path portion DP1_52, and a discharge flow path portion DP1_U. The discharge flow path portion DP1_11 extends in the Y-axis direction, communicates with the discharge flow path portion DP1_12 at the end in the Y1 direction, and has an inlet CI1_1 in the vicinity of the end in the Y2 direction. The inlet CI1_1 communicates with the coupling pipe 373*o*_1. The discharge flow path portion DP1_12 extends in the X-axis direction, communicates with the discharge flow path portion DP1_11 at the end in the X1 direction, and communicates with the discharge flow path portion DP1_U at the end in the X2 direction. The discharge flow path portion DP1_3 extends in the Y-axis direction, communicates with the discharge flow path portion DP1_U at the end in the Y1 direction, and has an inlet CI1_3 in the vicinity of the end in the Y2 direction. The inlet CI1_3 communicates with the coupling pipe 373*o*_3. The discharge flow path portion DP1_51 extends in a U-axis direction, communicates with the discharge flow path portion DP1_52 at the end in a U1 direction, and has an inlet CI1_5 in the vicinity of the end in a U2 direction. Further, the inlet CI1_5 is provided in the vicinity of the side He2. The U-axis direction is a general term for the U1 direction and the U2 direction. The U1 direction is a direction obtained by rotating the X1 direction clockwise by approximately 45 degrees. The U2 direction is the opposite direction of the U1 direction. The discharge flow path portion DP1_52 extends in the X-axis direction, communicates with the discharge flow path portion DP1_U at the end in the X1 direction, and communicates with the discharge flow path portion DP1_51 at the end in the X2 direction. The discharge flow path portion DP1_U communicates with the coupling pipe 34101 at the end in the Z1 direction, communicates with the discharge flow path portion DP1_12 at the end in the X1 direction, communicates with the discharge flow path portion DP1_3 at the end in the Y2 direction, and communicates with the discharge flow path portion DP1_52 at the end in the X2 direction. The discharge flow path portion DP1_U is a location where the ink flowing from the discharge flow path portion DP1_12, the discharge flow path portion DP1_3, and the discharge flow path portion DP1_52 merge. The merged ink flows into the coupling pipe 341*o*2.

The discharge merging flow path DUo2 has a discharge flow path portion DP2_21, a discharge flow path portion DP2_22, a discharge flow path portion DP2_4, a discharge flow path portion DP2_61, a discharge flow path portion DP2_62, and a discharge flow path portion DP2_U. The discharge flow path portion DP2_21 extends in the U-axis direction, has the inlet CI2_2 in the vicinity of the end portion in the U1 direction, and communicates with the discharge flow path portion DP2_22 at the end in the U2 direction. The inlet CI2_2 communicates with the coupling pipe 373*o*_2. Further, the inlet CI2_2 is provided in the vicinity of the side He6. The discharge flow path portion DP2_22 extends in the X-axis direction, communicates with the discharge flow path portion DP2_U at the end in the X2 direction, and communicates with the discharge flow path portion DP2_21 at the end in the X1 direction. The discharge flow path portion DP2_4 extends in the Y-axis direction, has the inlet CI2_4 in the vicinity of the end in the Y1 direction, and communicates with the discharge flow path portion DP2_U at the end in the Y2 direction. The inlet CI2_4 communicates with the coupling pipe 373*o*_4. The discharge flow path portion DP2_61 extends in the Y-axis direction, has the inlet CI2_6 in the vicinity of the end in the Y1 direction, and communicates with the discharge flow path portion DP2_62 at the end in the Y2 direction. The inlet CI2_6 communicates with the coupling pipe 373*o*_6. The discharge flow path portion DP2_62 extends in the X-axis direction, communicates with the discharge flow path portion DP2_U at the end in the X1 direction, and communicates with the discharge flow path portion DP2_61 at the end in the X2 direction. The discharge flow path portion DP2_U communicates with the coupling pipe 341*o*2 at the end in the Z1 direction, communicates with the discharge flow path portion DP2_22 at the end in the X1 direction, communicates with the discharge flow path portion DP2_4 at the end in the Y1 direction, and communicates with the discharge flow path portion DP2_62 at the end in the X2 direction. The discharge flow path portion DP2_U is a location where the ink flowing from the discharge flow path portion DP2_22, the discharge flow path portion DP2_4, and the discharge flow path portion DP2_62 merge. The merged ink flows into the coupling pipe 341*o*2.

Figure 15:
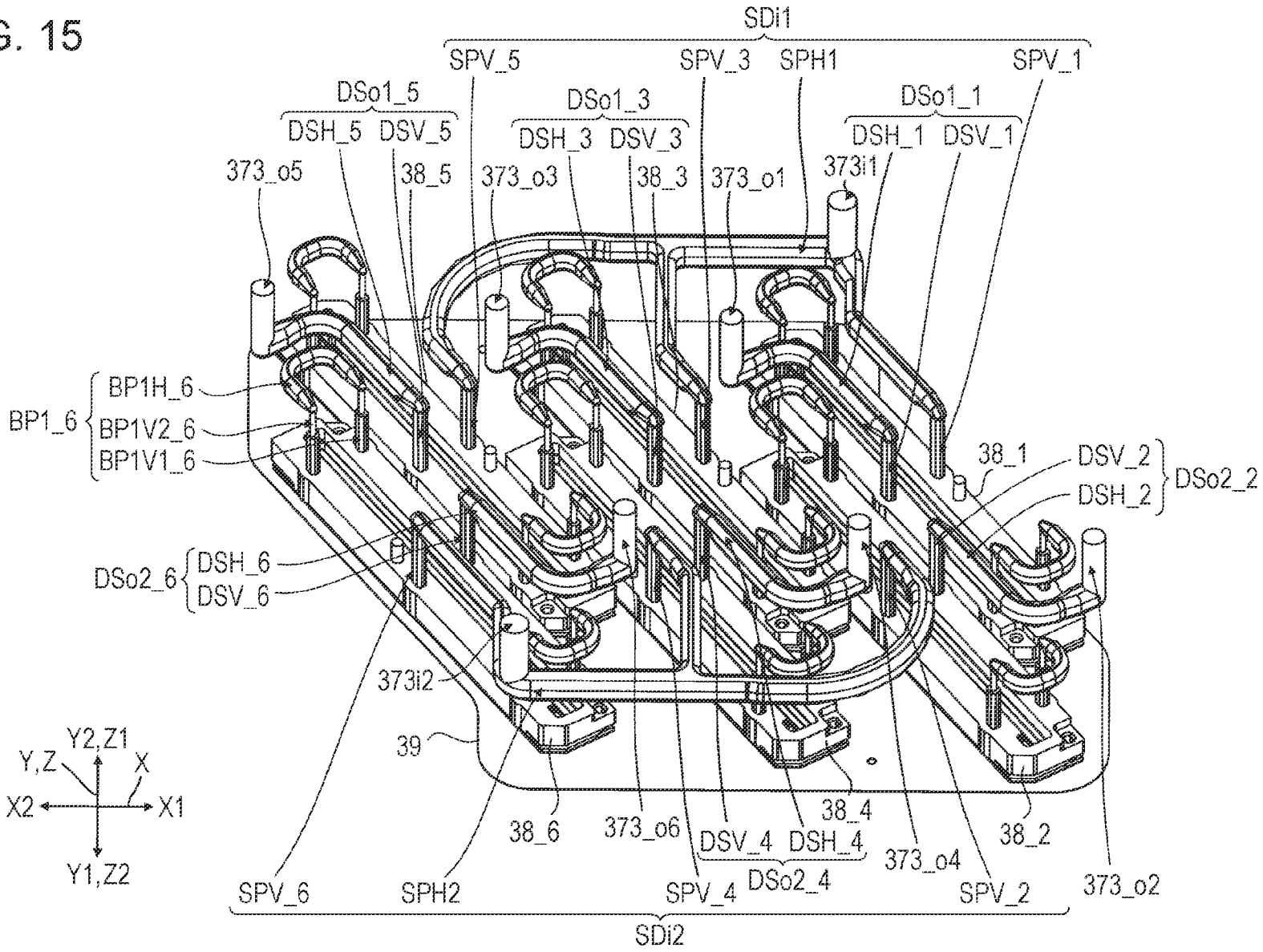
FIG. 15 is a perspective view of a flow path formed in the flow path distribution portion.
Figure 16:
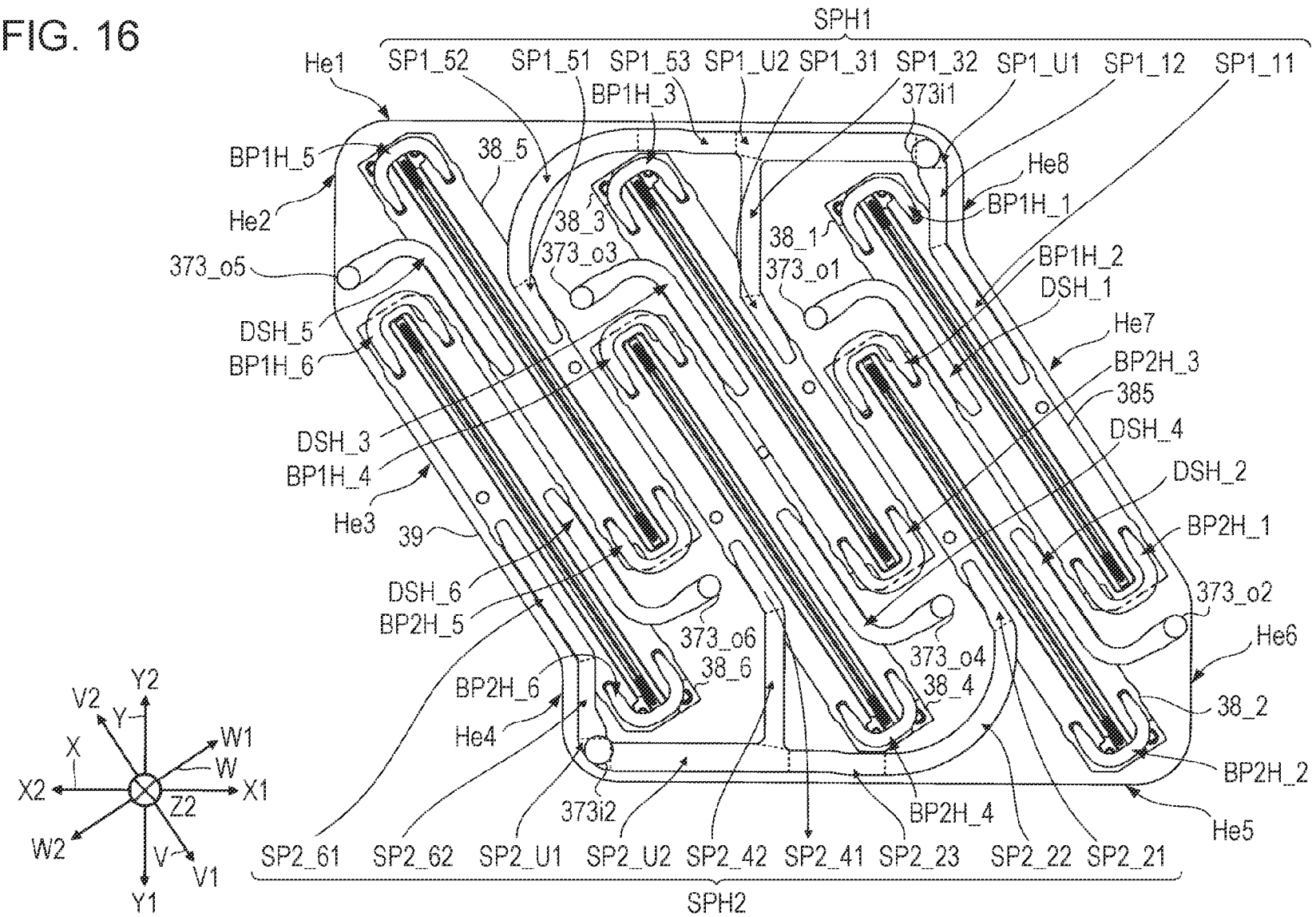
FIG. 16 is a plan view of a flow path formed in the flow path distribution portion.

FIGS. 15 and 16 are views of flow paths formed in the flow path distribution portion 37. The figure shown in FIG. 15 is a perspective view showing flow paths formed in the flow path distribution portion 37. The figure shown in FIG. 16 is a plan view showing flow paths formed in the flow path distribution portion 37. In FIGS. 15 and 16, the head units 38 and the fixing plate 39 are further displayed. Further, in FIG. 15, in order to prevent the drawings from being complicated, signs are given to only some of the bypass flow paths BP among the plurality of bypass flow paths BP. In the plan view, the outer shapes of the flow path distribution portion 37 and the fixing plate 39 are substantially the same as the outer shape of the flow path structure 34. Therefore, in order to simplify the description, each of the eight sides of the outer shape of the flow path distribution portion 37 and the fixing plate 39 will be described using the same sign as that of the side substantially at the same position among sides He1 to He8 of the outer shape of the flow path structure 34.

As illustrated in FIG. 15, the coupling pipe 373*i*1 extends in the Z-axis direction, communicates with the discharge port CE1 at the end in the Z1 direction, and communicates with the supply distribution flow path SDi1 at the end in the Z2 direction. As illustrated in FIG. 15, the supply distribution flow path SDi1 has a distribution flow path SPH1, an introduction flow path SPV_1, an introduction flow path SPV_3, and an introduction flow path SPV_5.

The distribution flow path SPH1 is formed by the first flow path member Du1 and the second flow path member Du2. Further, the distribution flow path SPH1 distributes and supplies the first ink to a plurality of supply common liquid chambers MN1 corresponding to the head units 38_1, 38_3, and 38_5, respectively. As illustrated in FIG. 16, the distribution flow path SPH1 has a distribution flow path portion SP1_11, a distribution flow path portion SP1_12, a distribution flow path portion SP1_31, a distribution flow path portion SP1_32, a distribution flow path portion SP1_51, a distribution flow path portion SP1_52, a distribution flow path portion SP1_53, a distribution flow path portion SP1_U1, and a distribution flow path portion SP1_U2.

The distribution flow path portion SP1_11 extends in the V-axis direction, communicates with the introduction flow path SPV_1 at the end in the V1 direction, and communicates with the distribution flow path portion SP1_12 at the end in the V2 direction. The distribution flow path portion SP1_11 is positioned in the vicinity of the side He7 and is provided along the side He7. The introduction flow path SPV_1 extends in the Z-axis direction, communicates with the distribution flow path portion SP1_11 at the end in the Z1 direction, and communicates with the supply common liquid chamber MN1 of the head unit 38_1 at the end in the Z2 direction. The distribution flow path portion SP1_12 extends in the Y-axis direction, communicates with the distribution flow path portion SP1_11 at the end in the Y1 direction, and communicates with the distribution flow path portion SP1_U1 at the end in the Y2 direction. The distribution flow path portion SP1_12 is positioned in the vicinity of the side He8 and is provided along the side He8.

The distribution flow path portion SP1_31 extends in the V-axis direction, communicates with the introduction flow path SPV_3 at the end in the V1 direction, and communicates with the distribution flow path portion SP1_32 at the end in the V2 direction. The introduction flow path SPV_3 extends in the Z-axis direction, communicates with the distribution flow path portion SP1_31 at the end in the Z1 direction, and communicates with the supply common liquid chamber MN1 of the head unit 38_3 at the end in the Z2 direction. The distribution flow path portion SP1_32 extends in the Y-axis direction, communicates with the distribution flow path portion SP1_31 at the end in the Y1 direction, and communicates with the distribution flow path portion SP1_U2 at the end in the Y2 direction.

The distribution flow path portion SP1_51 extends in the V-axis direction, communicates with the introduction flow path SPV_5 at the end in the V1 direction, and communicates with the distribution flow path portion SP1_52 at the end in the V2 direction. The introduction flow path SPV_5 extends in the Z-axis direction, communicates with the distribution flow path portion SP1_51 at the end in the Z1 direction, and communicates with the supply common liquid chamber MN1 of the head unit 38_5 at the end in the Z2 direction. The distribution flow path portion SP1_52 is bent approximately 124 degrees so as to be convex in the V2 direction, communicates with the distribution flow path portion SP1_51 at the end in the V1 direction, and communicates with the distribution flow path portion SP1_53 at the end in the X1 direction. The distribution flow path portion SP1_53 extends in the X-axis direction, communicates with the distribution flow path portion SP1_52 at the end in the X2 direction, and communicates with the distribution flow path portion SP1_U2 at the end in the X1 direction. The distribution flow path portion SP1_53 is disposed in the vicinity of the side He1.

The distribution flow path portion SP1_U1 communicates with the coupling pipe 373*i*1 at the end in the Z1 direction, communicates with the distribution flow path portion SP1_12 at the end in the Y1 direction, and communicates with the distribution flow path portion SP1_U2 at the end in the X2 direction. The distribution flow path portion SP1_U1 is a location where the first ink flowing from the coupling pipe 373*i*1 is distributed to the distribution flow path portion SP1_12 and the distribution flow path portion SP1_U2. The distribution flow path portion SP1_U1 is positioned in the vicinity of the apex when the side He1 and the side He8 intersect.

The distribution flow path portion SP1_U2 extends in the X-axis direction, communicates with the distribution flow path portion SP1_U1 at the end in the X1 direction, and communicates with the distribution flow path portion SP1_32 and the distribution flow path portion SP1_53 at the end in the X2 direction. The end of the distribution flow path portion SP1_U2 in the X2 direction is a location where the first ink flowing from the distribution flow path portion SP1_U1 is distributed to the distribution flow path portion SP1_32 and the distribution flow path portion SP1_53. The distribution flow path portion SP1_U2 is positioned in the vicinity of the side He1 and is provided along the side He1.

As illustrated in FIG. 15, the coupling pipe 373*i*2 extends in the Z-axis direction, communicates with the discharge port CE2 at the end in the Z1 direction, and communicates with the supply distribution flow path SDi2 at the end in the Z2 direction. As illustrated in FIG. 15, the supply distribution flow path SDi2 has a distribution flow path SPH2, an introduction flow path SPV_2, an introduction flow path SPV_4, and an introduction flow path SPV_6.

The distribution flow path SPH2 distributes and supplies the second ink to a plurality of supply common liquid chambers MN1 corresponding to the head units 38_2, 38_4, and 38_6, respectively. As illustrated in FIG. 16, the distribution flow path SPH2 has a distribution flow path portion SP2_21, a distribution flow path portion SP2_22, a distribution flow path portion SP2_23, a distribution flow path portion SP2_41, a distribution flow path portion SP2_42, a distribution flow path portion SP2_61, a distribution flow path portion SP2_62, a distribution flow path portion SP2_U1, and a distribution flow path portion SP2_U2.

The distribution flow path portion SP2_21 extends in the V-axis direction, communicates with the introduction flow path SPV_2 at the end in the V2 direction, and communicates with the distribution flow path portion SP2_22 at the end in the V1 direction. The introduction flow path SPV_2 extends in the Z-axis direction, communicates with the distribution flow path portion SP2_21 at the end in the Z1 direction, and communicates with the supply common liquid chamber MN1 of the head unit 38_2 in the Z2 direction. The distribution flow path portion SP2_22 is bent approximately 124 degrees so as to be convex in the V1 direction, communicates with the distribution flow path portion SP2_21 at the end in the V2 direction, and communicates with the distribution flow path portion SP2_23 at the end in the X2 direction. The distribution flow path portion SP2_23 extends in the X-axis direction, communicates with the distribution flow path portion SP2_22 at the end in the X1 direction, and communicates with the distribution flow path portion SP2_U2 at the end in the X2 direction. The distribution flow path portion SP2_23 is positioned in the vicinity of the side He5 and is provided along the side He5.

The distribution flow path portion SP2_41 extends in the V-axis direction, communicates with the introduction flow path SPV_4 at the end in the V2 direction, and communicates with the distribution flow path portion SP2_42 at the end in the V1 direction. The introduction flow path SPV_4 extends in the Z-axis direction, communicates with the distribution flow path portion SP2_41 at the end in the Z1 direction, and communicates with the supply common liquid chamber MN1 of the head unit 38_4 in the Z2 direction. The distribution flow path portion SP2_42 extends in the Y-axis direction, communicates with the distribution flow path portion SP2_41 at the end in the Y2 direction, and communicates with the distribution flow path portion SP2_U2 at the end in the Y1 direction.

The distribution flow path portion SP2_61 extends in the V-axis direction, communicates with the introduction flow path SPV_6 at the end in the V2 direction, and communicates with the distribution flow path portion SP2_62 at the end in the V1 direction. The distribution flow path portion SP2_61 is provided in the vicinity of the side He3 and along the side He3. The introduction flow path SPV_6 extends in the Z-axis direction, communicates with the distribution flow path portion SP2_61 at the end in the Z1 direction, and communicates with the supply common liquid chamber MN1 of the head unit 38_6 in the Z2 direction. The distribution flow path portion SP2_62 extends in the Y-axis direction, communicates with the distribution flow path portion SP2_61 at the end in the Y2 direction, and communicates with the distribution flow path portion SP2_U1 at the end in the Y1 direction. The distribution flow path portion SP2_62 is provided in the vicinity of the side He4 and along the side He4.

The distribution flow path portion SP2_U1 communicates with the coupling pipe 373*i*2 at the end in the Z1 direction, communicates with the distribution flow path portion SP2_62 at the end in the Y2 direction, and communicates with the distribution flow path portion SP2_U2 at the end in the X1 direction. The distribution flow path portion SP2_U1 is a location where the second ink flowing from the coupling pipe 373*i*2 is distributed to the distribution flow path portion SP2_62 and the distribution flow path portion SP2_U2. The distribution flow path portion SP1_U2 is positioned in the vicinity of the apex when the side He4 and the side He5 intersect.

The distribution flow path portion SP2_U2 extends in the X-axis direction, communicates with the distribution flow path portion SP2_U1 at the end in the X2 direction, and communicates with the distribution flow path portion SP2_42 and the distribution flow path portion SP2_23 at the end in the X1 direction. The end of the distribution flow path portion SP2_U2 in the X1 direction is a location where the second ink flowing from the distribution flow path portion SP2_U1 is distributed to the distribution flow path portion SP2_42 and the distribution flow path portion SP2_23. The distribution flow path portion SP2_U2 is positioned in the vicinity of the side He5 and is provided along the side He5.

As illustrated in FIG. 15, an individual discharge flow path DSo1_1 has a discharge horizontal flow path DSH_1 and a flowing-out flow path DSV_1. As illustrated in FIG. 16, the discharge horizontal flow path DSH_1 is bent approximately 90 degrees so as to be convex in the Y2 direction, communicates with the flowing-out flow path DSV_1 at the end in the V1 direction, and communicates with the coupling pipe 373*o*_1 at the end in the W2 direction. The flowing-out flow path DSV_1 extends in the Z-axis direction, communicates with the discharge common liquid chamber MN2 of the head unit 38_1 at the end in the Z2 direction, and communicates with the discharge horizontal flow path DSH_1 at the end in the Z1 direction.

As illustrated in FIG. 15, an individual discharge flow path DSo2_2 has a discharge horizontal flow path DSH_2 and a flowing-out flow path DSV_2. As illustrated in FIG. 16, the discharge horizontal flow path DSH_2 is bent approximately 90 degrees so as to be convex in the Y1 direction, communicates with the flowing-out flow path DSV_2 at the end in the V2 direction, and communicates with the coupling pipe 373*o*_2 at the end in the W1 direction. The flowing-out flow path DSV_2 extends in the Z-axis direction, communicates with the discharge common liquid chamber MN2 of the head unit 38_2 at the end in the Z2 direction, and communicates with the discharge horizontal flow path DSH_2 at the end in the Z1 direction.

As illustrated in FIG. 15, an individual discharge flow path DSo1_3 has a discharge horizontal flow path DSH_3 and a flowing-out flow path DSV_3. As illustrated in FIG. 16, the discharge horizontal flow path DSH_3 is bent approximately 90 degrees so as to be convex in the Y2 direction, communicates with the flowing-out flow path DSV_3 at the end in the V1 direction, and communicates with the coupling pipe 373*o*_3 at the end in the W2 direction. The flowing-out flow path DSV_3 extends in the Z-axis direction, communicates with the discharge common liquid chamber MN2 of the head unit 38_3 at the end in the Z2 direction, and communicates with the discharge horizontal flow path DSH_3 at the end in the Z1 direction.

As illustrated in FIG. 15, an individual discharge flow path DSo2_4 has a discharge horizontal flow path DSH_4 and a flowing-out flow path DSV_4. As illustrated in FIG. 16, the discharge horizontal flow path DSH_4 is bent approximately 90 degrees so as to be convex in the Y1 direction, communicates with the flowing-out flow path DSV_4 at the end in the V2 direction, and communicates with the coupling pipe 373*o*_4 at the end in the W1 direction. The flowing-out flow path DSV_4 extends in the Z-axis direction, communicates with the discharge common liquid chamber MN2 of the head unit 38_4 at the end in the Z2 direction, and communicates with the discharge horizontal flow path DSH_4 at the end in the Z1 direction.

As illustrated in FIG. 15, an individual discharge flow path DSo1_5 has a discharge horizontal flow path DSH_5 and a flowing-out flow path DSV_5. As illustrated in FIG. 16, the discharge horizontal flow path DSH_5 is bent approximately 90 degrees so as to be convex in the Y2 direction, communicates with the flowing-out flow path DSV_5 at the end in the V1 direction, and communicates with the coupling pipe 373*o*_5 at the end in the W2 direction. The flowing-out flow path DSV_5 extends in the Z-axis direction, communicates with the discharge common liquid chamber MN2 of the head unit 38_5 at the end in the Z2 direction, and communicates with the discharge horizontal flow path DSH_5 at the end in the Z1 direction.

As illustrated in FIG. 15, an individual discharge flow path DSo2_6 has a discharge horizontal flow path DSH_6 and a flowing-out flow path DSV_6. As illustrated in FIG. 16, the discharge horizontal flow path DSH_6 is bent approximately 90 degrees so as to be convex in the Y1 direction, communicates with the flowing-out flow path DSV_6 at the end in the V2 direction, and communicates with the coupling pipe 373*o*_6 at the end in the W1 direction. The flowing-out flow path DSV_6 extends in the Z-axis direction, communicates with the discharge common liquid chamber MN2 of the head unit 38_6 at the end in the Z2 direction, and communicates with the discharge horizontal flow path DSH_6 at the end in the Z1 direction.

As illustrated in FIG. 16, each of the bypass horizontal portions BP1H_2, BP1H_4, BP1H_6, BP2H_1, BP2H_3, and BP2H_5 has a portion that is not overlapped with the case 385 of the head unit 38 corresponding to each of the bypass horizontal portions BPH in the plan view. In FIG. 16, in the plan view, the boundary of the case 385 overlapped with the bypass horizontal portion BPH is indicated by a broken line. Further, each of the bypass horizontal portions BP1H_1, BP1H_3, BP1H_5, BP2H_2, BP2H_4, and BP2H_6 is overlapped with the case 385 of the head unit 38 corresponding to each of the bypass horizontal portions BPH in all parts in the plan view.

That is, in the head unit 38_*k*, of the bypass horizontal portions BP1H_k and BP2H_k, the bypass horizontal portion BPH positioned at a far distance from the outer edge of the flow path distribution portion 37 in the Y-axis direction has a portion that is not overlapped with the case 385 of the head unit 38_*k* in the plan view, and the bypass horizontal portion BPH positioned at a short distance from the outer edge of the flow path distribution portion 37 in the Y-axis direction is overlapped with the case 385 of the head unit 38_*k* in all parts in the plan view. k is an integer from 1 to 6.

Figure 17:
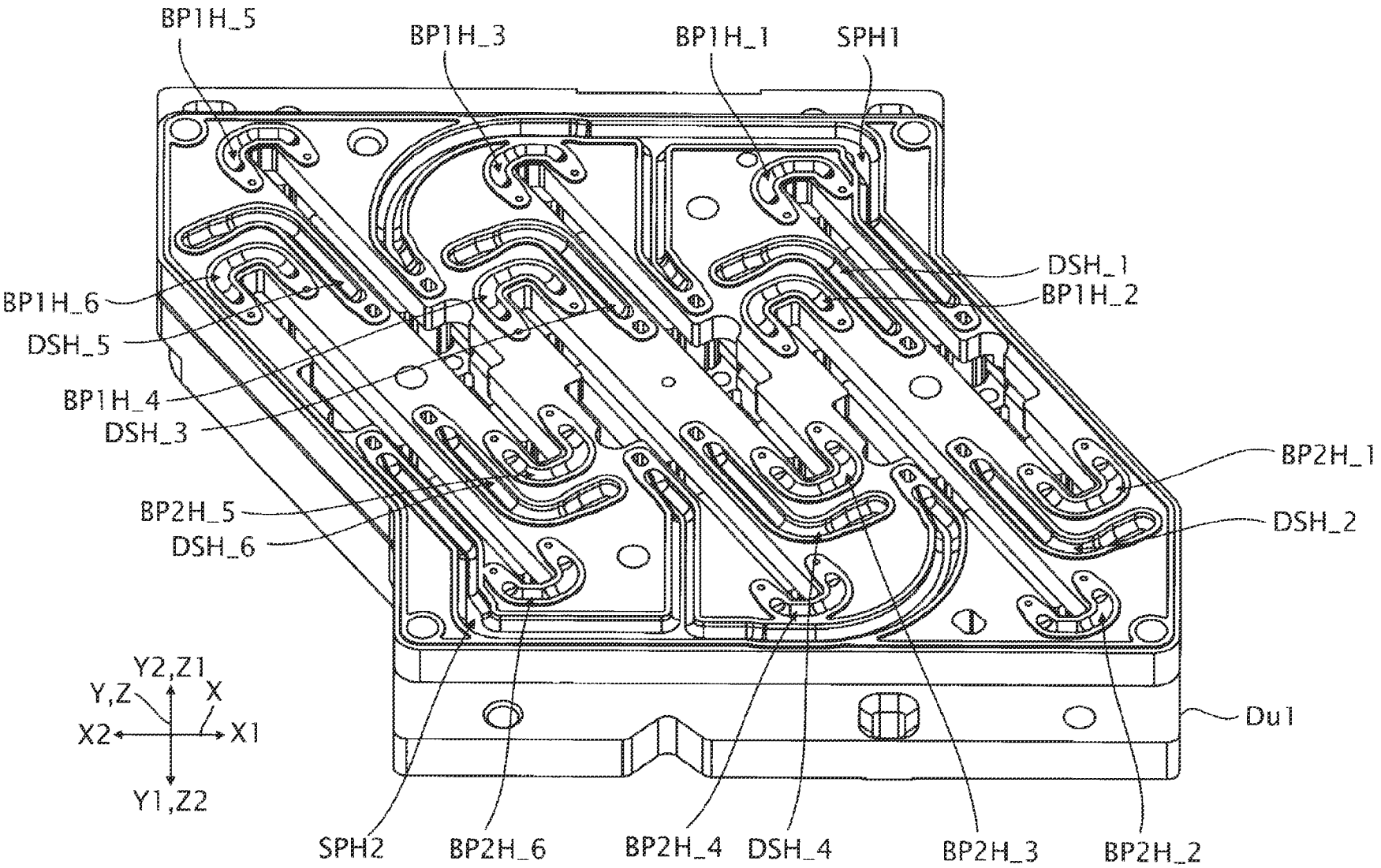
FIG. 17 is a perspective view of a first flow path member.

FIG. 17 is a perspective view of the first flow path member Du1. As illustrated in FIG. 17, on the surface of the first flow path member Du1 in the Z1 direction, grooves are formed that define the distribution flow path SPH1, the distribution flow path SPH2, the discharge horizontal flow paths DSH_1 to DSH_6, the bypass horizontal portions BP1H_1 to BP1H_6, and the bypass horizontal portions BP2H_1 to BP2H_6. Although not shown, on the surface of the second flow path member Du2 in the Z2 direction, grooves are formed that define the distribution flow path SPH1, the distribution flow path SPH2, the discharge horizontal flow paths DSH_1 to DSH_6, the bypass horizontal portions BP1H_1 to BP1H_6, and the bypass horizontal portions BP2H_1 to BP2H_6. In other words, the distribution flow path SPH1, the distribution flow path SPH2, the discharge horizontal flow paths DSH_1 to DSH_6, and the bypass horizontal portions BP1H_1 to BP1H_6, and the bypass horizontal portions BP2H_1 to BP2H_6 are formed between the first flow path member Du1 and the second flow path member Du2. The grooves that define the distribution flow path SPH1, the distribution flow path SPH2, the discharge horizontal flow paths DSH_1 to DSH_6, and the bypass horizontal portions BP1H_1 to BP1H_6, and the bypass horizontal portions BP2H_1 to BP2H_6 may be formed in only one of the first flow path member Du1 and the second flow path member Du2.

1.4. Summary of First Embodiment

As described above, the liquid ejecting head 30 includes the nozzle row Ln, the plurality of individual flow paths RJ, the supply common liquid chamber MN1, the discharge common liquid chamber MN2, the first bypass flow path BP1, the second bypass flow path BP2, and the introduction flow path SPY. The nozzle row Ln is formed in which a plurality of nozzles N for ejecting ink in the Z2 direction are arranged in the V2 direction orthogonal to the Z2 direction. The plurality of individual flow paths RJ communicate with the plurality of nozzles N, respectively. The supply common liquid chamber MN1 extends in the Z2 direction and communicates with the plurality of individual flow paths RJ to supply ink to the plurality of individual flow paths RJ. The discharge common liquid chamber MN2 extends in the V2 direction and communicates with the plurality of individual flow paths RJ and ink discharged from the plurality of individual flow paths RJ flows therethrough. The first bypass flow path BP1 couples the supply common liquid chamber MN1 to the discharge common liquid chamber MN2. The second bypass flow path BP2 couples the supply common liquid chamber MN1 to the discharge common liquid chamber MN2. The introduction flow path SPV communicates with the supply common liquid chamber MN1 between the first bypass flow path BP1 and the second bypass flow path BP2 in the V2 direction. The first bypass flow path BP1 has the supply vertical portion BP1VS extending from the supply common liquid chamber MN1 in the Z1 direction opposite to the Z2 direction. The second bypass flow path BP2 has the supply vertical portion BP2VS extending from the supply common liquid chamber MN1 in the Z1 direction. As illustrated in FIG. 9, the supply vertical portion BP1VS is positioned in the V1 direction opposite to the V2 direction with respect to the individual flow path RJ disposed foremost in the V2 direction. The supply vertical portion BP2VS is positioned in the V2 direction with respect to the individual flow paths RJ disposed foremost in the V1 direction.

In other words, the supply vertical portion BP1VS and the supply vertical portion BP2VS are positioned inward from the end of the supply common liquid chamber MN1 in the longitudinal direction.

The Z2 direction is an example of the "first direction". The V2 direction is an example of the "second direction". The Z1 direction is an example of the "third direction". The supply vertical portion BP1VS is an example of the "first vertical portion". The supply vertical portion BP2VS has the "second vertical portion". The V1 direction is an example of the "fourth direction". However, the second direction is not limited to the V2 direction, and may be the V1 direction. When the second direction is the V2 direction, the fourth direction corresponds to the V1 direction, the first vertical portion corresponds to the supply vertical portion BP2VS, and the second vertical portion corresponds to the supply vertical portion BP1VS.

Generally, it is desirable that the bypass flow path BP is provided at a position away from the introduction flow path SPV to collect air bubbles in the ink. This is because by providing the bypass flow path BP at a position away from the introduction flow path SPV, the ink flows in a location away from the introduction flow path SPV and the air bubbles retained in the supply common liquid chamber MN1 can be collected. However, in a first example in which the supply vertical portion BP1VS is disposed in the V2 direction with respect to the individual flow path RJ disposed foremost in the V2 direction, when the nozzle surface FN is inclined with respect to the horizontal plane SF, air bubbles may be retained in the vicinity of the opening of the supply vertical portion BP1VS.

Figure 18:
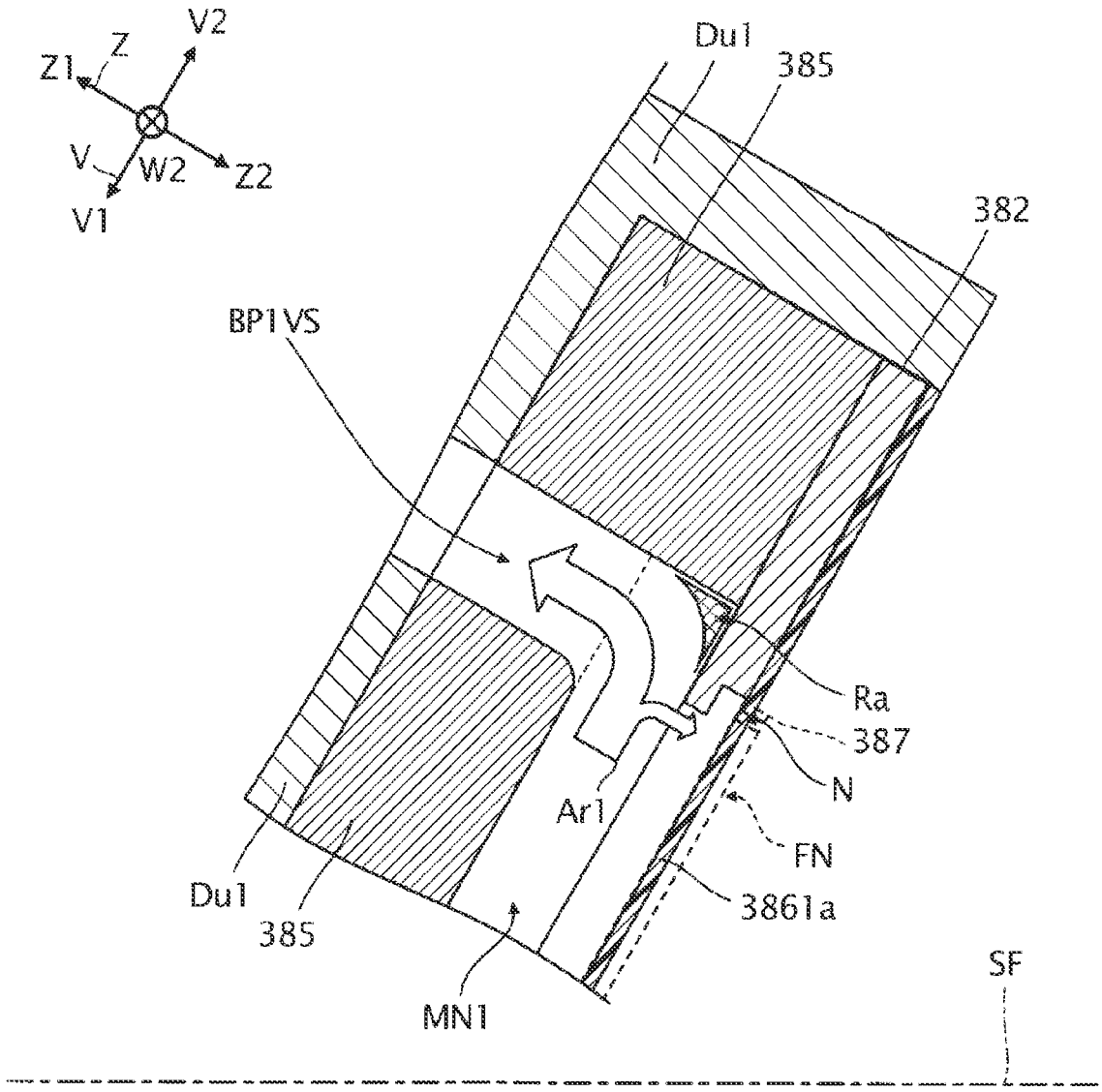
FIG. 18 is a diagram showing a case where a nozzle surface is inclined in a first example.

FIG. 18 is a diagram showing a case where the nozzle surface FN is inclined in the first example. The figure shown in FIG. 18 illustrates the end of the supply common liquid chamber MN1 in the V2 direction in a state where the nozzle surface FN is inclined by 60 degrees with respect to the horizontal plane SF in the first example described above. In states shown in FIG. 18 and FIGS. 19, 20, and 21 to be described later, the V2 direction is a direction rotated by 60 degrees in the direction opposite to the gravitational direction with respect to the horizontal plane SF, and has a component in the direction opposite to the gravitational direction. The W-axis direction is parallel to the horizontal plane SF. In FIG. 18 and FIGS. 19, 20, and 21 to be described later, the nozzle plate 387 is shown by a broken line, and the fixing plate 39 and the support plate 3861*b* of the compliance substrate 3861 are not shown. Further, in FIG. 18 and FIGS. 19, 20, and 21 to be described later, only the nozzle N disposed foremost in the V2 direction are illustrated.

As illustrated in FIG. 18, the nozzle N positioned foremost in the V2 direction is positioned in the V1 direction with respect to the wall surface of the supply vertical portion BP1VS in the V2 direction. Then, the ink flows as indicated by an arrow Ar1 shown in FIG. 18. Specifically, in the ink flowing into the supply common liquid chamber MN1 in the V2 direction, the ink flowing into the individual flow path RJ communicating with the nozzle N positioned foremost in the V2 direction changes its flow direction to the Z2 direction in front of the wall surface of the supply vertical portion BP1VS in the V2 direction (toward the V1 direction), and the ink flowing into the supply vertical portion BP1VS changes its flow direction to the Z1 direction. In a region Ra illustrated in FIG. 18, since the flow of ink from the supply common liquid chamber MN1 to the supply vertical portion BP1VS is weak, the flow rate of the ink decreases, and since the flow of ink flowing into the individual flow path RJ does not occur, stagnation occurs in the flow of ink. Further, in the state in which the nozzle surface FN is inclined with respect to the horizontal plane SF, air bubbles generated in the supply common liquid chamber MN1 move in the direction opposite to the gravitational direction due to buoyancy, and thus is likely to be retained in the region Ra. When the pressure in the pressure chamber CB becomes negative due to the ink-ejecting operation, ink is drawn from the supply common liquid chamber MN1, but when the ink is drawn, it is likely that air bubbles retained in the supply common liquid chamber MN1 are also drawn at the same time. When air bubbles are drawn into the individual flow path RJ, the air bubbles cause an ejection abnormality.

Figure 19:
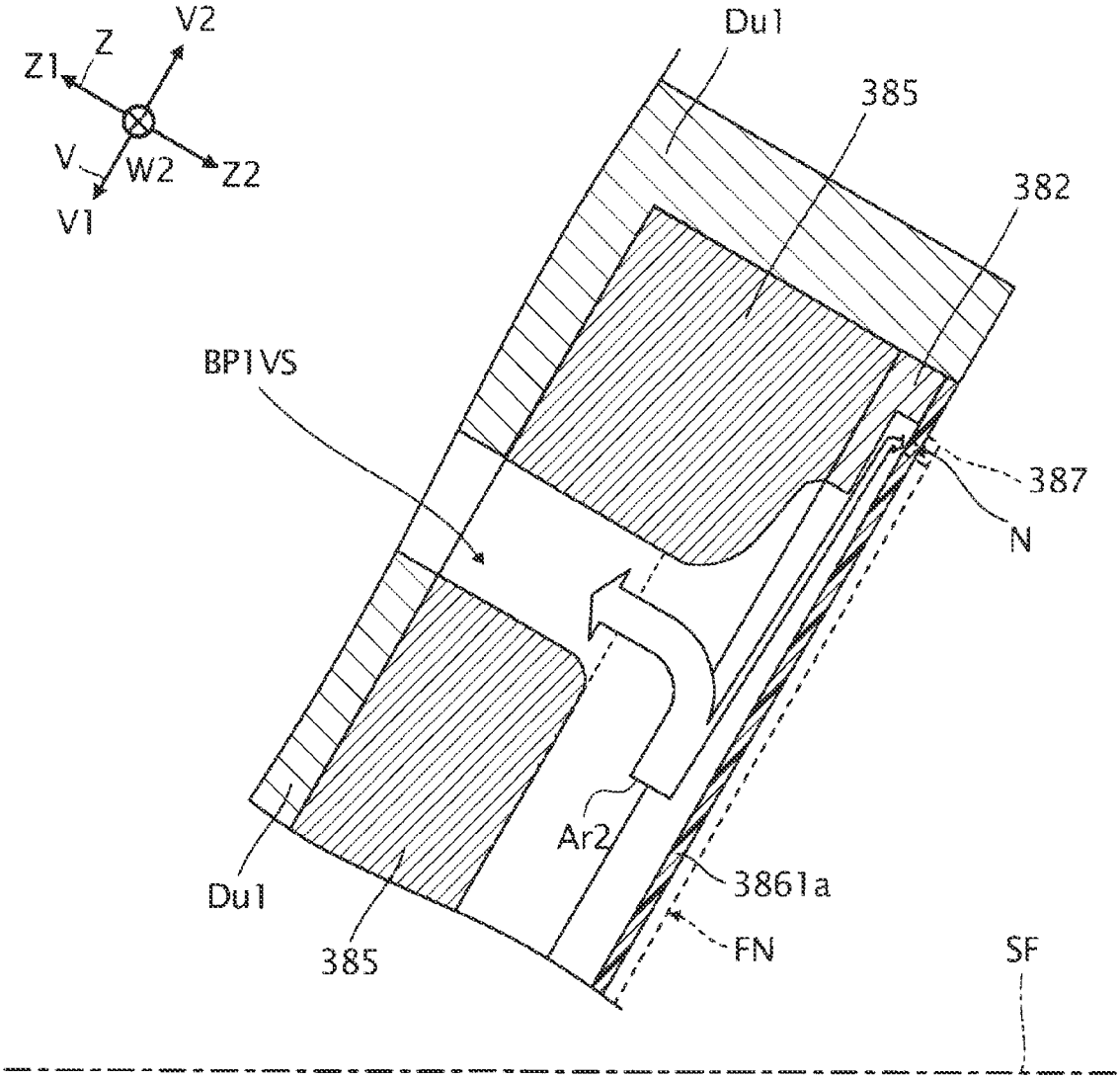
FIG. 19 is a diagram showing a supply common liquid chamber when the nozzle surface is inclined in the present embodiment.

FIG. 19 is a diagram showing the supply common liquid chamber MN1 when the nozzle surface FN is inclined in the present embodiment. The figure shown in FIG. 19 illustrates the end of the supply common liquid chamber MN1 in the V2 direction in a state where the nozzle surface FN is inclined by 60 degrees with respect to the horizontal plane SF in the present embodiment.

Ink flows as indicated by an arrow Ar2 shown in FIG. 19. Specifically, in the ink flowing in the supply common liquid chamber MN1 in the V2 direction, the ink flowing to the individual flow path RJ communicating with the nozzle N disposed foremost in the V2 direction flows in the V2 direction beyond the wall surface of the supply vertical portion BP1VS in the V2 direction, and the ink flowing to the supply vertical portion BP1VS flows in the Z1 direction. That is, since ink flows in the V2 direction toward the end of the supply common liquid chamber MN1 in the V2 direction, the occurrence of ink stagnation at the end of the supply common liquid chamber MN1 in the V2 direction can be reduced.

Further, in the present embodiment, since the surface of the V2 end region MN1*a* in the Z1 direction is a tapered surface, the occurrence of ink stagnation can be reduced as compared with a second example in which the surface of the V2 end region MN1*a* in the Z1 direction is not a tapered surface but parallel to the V-axis direction.

Figure 20:
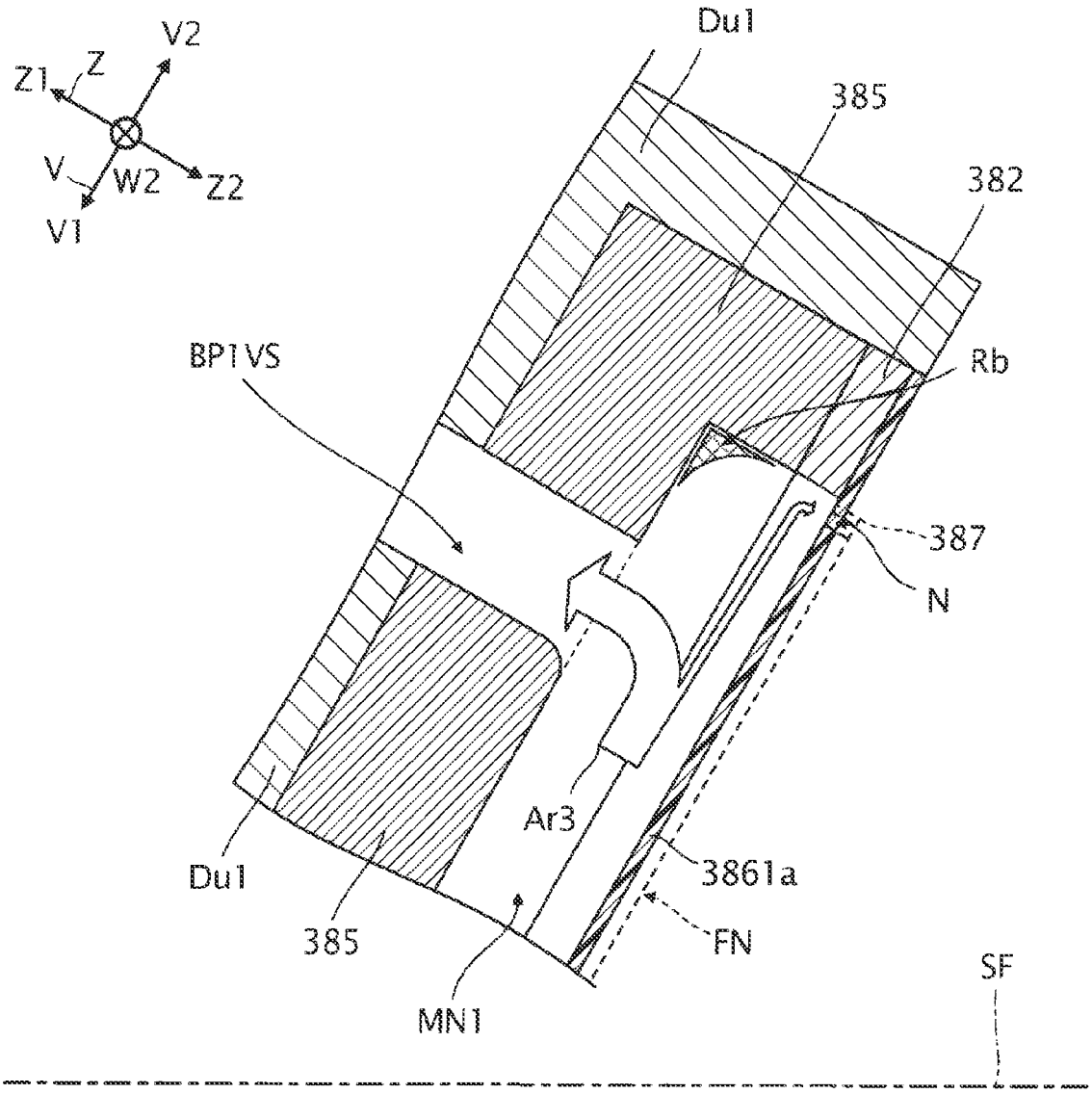
FIG. 20 is a diagram showing a supply common liquid chamber when a nozzle surface is inclined in a second example.

FIG. 20 is a diagram showing the supply common liquid chamber MN1 when the nozzle surface FN is inclined in the second example. The figure shown in FIG. 20 illustrates the end of the supply common liquid chamber MN1 in the V2 direction in a state where the nozzle surface FN is inclined by 60 degrees with respect to the horizontal plane SF in the second example described above.

Ink flows as indicated by an arrow Ar3 shown in FIG. 20. Specifically, in the ink flowing in the supply common liquid chamber MN1 in the V2 direction, the ink flowing into the individual flow path RJ changes its flow direction to the Z2 direction, and the ink flowing into the supply vertical portion BP1VS changes its flow direction in the Z1 direction in front of the region Rb (toward the V1 direction). In the second example, since, in the ink flowing into the supply common liquid chamber MN1 in the V2 direction, there is no flow of ink flowing into the individual flow path RJ and no flow of ink flowing into the supply vertical portion BP1VS in the region Rb illustrated in FIG. 20, stagnation is likely to occur.

On the other hand, in the present embodiment, since the surface of the V2 end region MN1*a* in the Z1 direction is a tapered surface, there is no location where the flow rate of the ink decreases, and thus the occurrence of stagnation can be reduced. In order to suppress a decrease in the flow rate of the ink, a corner portion between the surface of the V2 end region MN1*a* in the Z1 direction and the surface of the supply vertical portion BP1VS in the V2 direction is formed in an R shape.

Further, in the present embodiment, in the plan view, the introduction flow path SPV is positioned at the midpoint between the ends of the supply common liquid chamber MN1 in the V1 direction and in the V2 direction, and the flowing-out flow path DSV is positioned at the midpoint between the ends of the discharge common liquid chamber MN2 in the V1 direction and in the V2 direction. In other words, the length to the nozzle N farthest from the introduction flow path SPV in the V-axis direction is approximately half the length of the supply common liquid chamber MN1 in the V-axis direction, and the length to the nozzle N farthest from the flowing-out flow path DSV in the V-axis direction is approximately half the length of the discharge common liquid chamber MN2 in the V-axis direction. Generally, when the supply common liquid chamber MN1 and the discharge common liquid chamber MN2 are made long, the resistance increases, and the pressure fluctuation of the ink at the time of ejection in the vicinity of the nozzle N away from the introduction flow path SPV and the flowing-out flow path DSV increases. When the pressure fluctuation of the ink is large, in other words, when the pressure of the ink in the nozzle N in the vicinity of the nozzle N away from the introduction flow path SPV and the flowing-out flow path DSV is low, air bubbles may be mixed from the nozzle N. As described above, in the present embodiment, since the length to the nozzle N farthest from the introduction flow path SPV in the Y-axis direction is shorter than the length to the nozzle N farthest from the introduction flow path SPV in the Y-axis direction in the mode in which the introduction flow path SPV is at one end of the supply common liquid chamber MN1, the resistance from the introduction flow path SPV to the vicinity of the nozzle N farthest from the introduction flow path SPV can be small, and the pressure fluctuation of the ink can be reduced.

Further, as illustrated in FIG. 10, when the supply common liquid chamber MN1 is evenly divided into four regions, that is, a region Re1, a region Re2, a region Re3, and a region Re4, parallel to the plane perpendicular to the V2 direction, the supply vertical portion BP1VS is positioned in the region Re1 positioned foremost in the V2 direction. When the supply common liquid chamber MN1 is evenly divided into the above-mentioned four regions in parallel with the plane perpendicular to the V2 direction, the supply vertical portion BP2VS is positioned in the region Re4 positioned foremost in the V1 direction.

As described above, it is desirable that the bypass flow path BP is provided at a position away from the introduction flow path SPV to collect air bubbles in the ink. Since the supply vertical portion BP1VS is positioned in the region Re1, the air bubbles retained in the region Re1 and the region Re2 in the supply common liquid chamber MN1 can be collected. Further, since the supply vertical portion BP1VS is positioned in the V1 direction with respect to the individual flow path RJ disposed foremost in the V2 direction, the occurrence of stagnation of the ink at the end of the supply common liquid chamber MN1 in the V2 direction can be reduced by the flow of the ink toward the individual flow path RJ disposed foremost in the V2 direction.

Further, since the supply vertical portion BP2VS is positioned in the region Re2, the air bubbles retained in the region Re3 and the region Re4 in the supply common liquid chamber MN1 can be collected. Further, since the supply vertical portion BP2VS is positioned in the V2 direction with respect to the individual flow path RJ disposed foremost in the V1 direction, the occurrence of stagnation of the ink at the end of the supply common liquid chamber MN1 in the V1 direction can be reduced by the flow of the ink toward the individual flow path RJ disposed foremost in the V1 direction.

Further, as illustrated in FIG. 10, when the supply common liquid chamber MN1 is evenly divided into eight regions, that is, a region Re11, a region Re12, a region Re21, and a region Re22, a region Re31, a region Re32, a region Re41, and a region Re42 parallel to the plane perpendicular to the V2 direction, the supply vertical portion BP1VS is positioned in the region Re11 positioned foremost in the V2 direction. When the supply common liquid chamber MN1 is evenly divided into the above-mentioned eight regions in parallel with the plane perpendicular to the V2 direction, the supply vertical portion BP2VS is positioned in the region Re42 positioned foremost in the V1 direction. Since the supply vertical portion BP1VS is positioned in the region Re11, the first bypass flow path BP1 can collect the air bubbles retained in the region Re12 as compared with the mode in which the supply vertical portion BP1VS is positioned in the region Re12.

Further, since the supply vertical portion BP2VS is positioned in the region Re42, the first bypass flow path BP1 can collect the air bubbles retained in the region Re41 as compared with the mode in which the supply vertical portion BP2VS is positioned in the region Re41.

The introduction flow path SPV may be slightly deviated from the midpoint between the ends of the supply common liquid chamber MN1 in the V1 direction and in the V2 direction, and the flowing-out flow path DSV may be slightly deviated from the midpoint between the ends of the discharge common liquid chamber MN2 in the V1 direction and in the V2 direction. For example, the introduction flow path SPV may be disposed in the region including the region R22 and the region R31 in FIG. 10. The same applies to the flowing-out flow path DSV.

Figure 21:
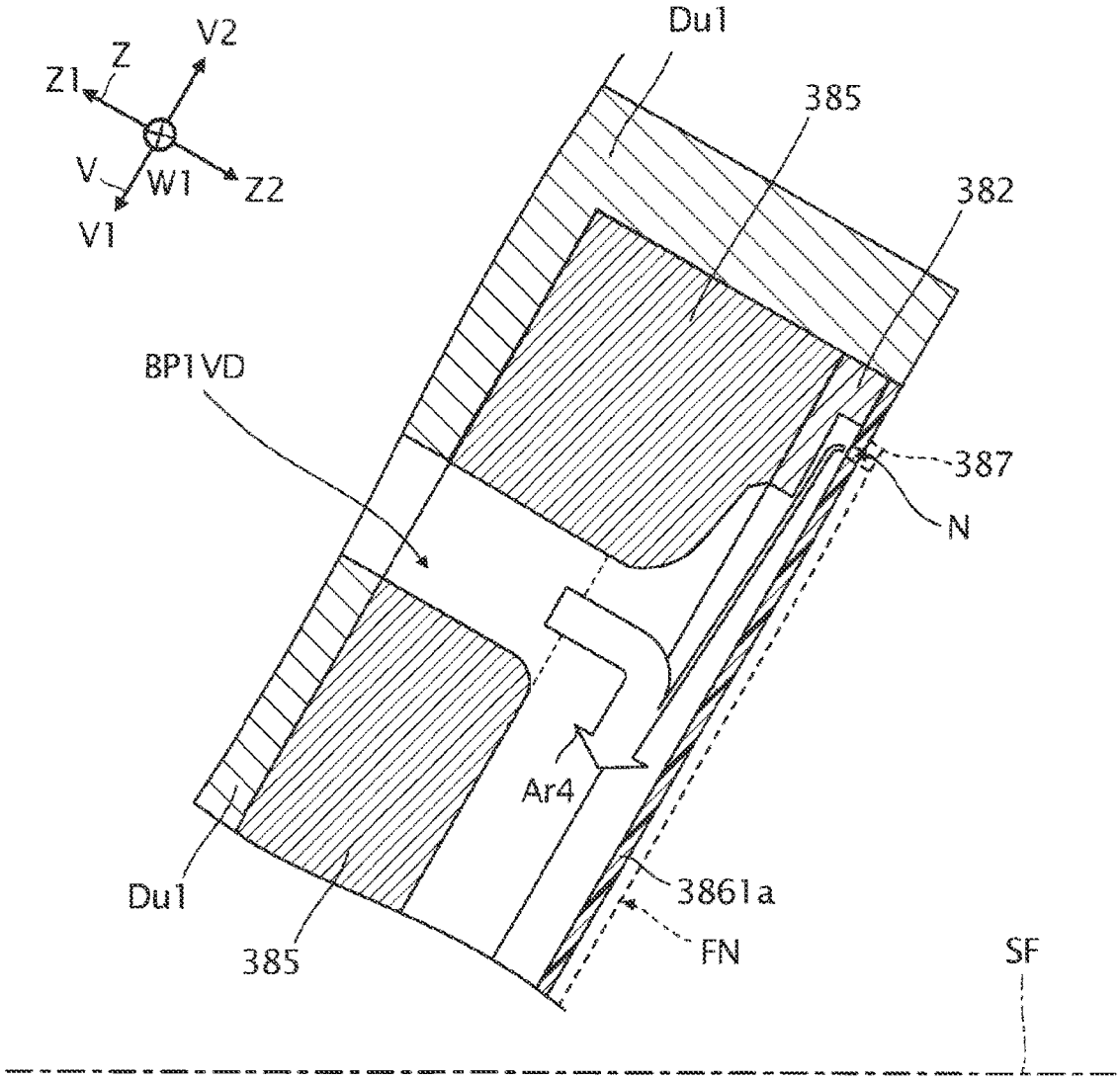
FIG. 21 is a diagram showing a discharge common liquid chamber when the nozzle surface is inclined in the present embodiment.

Further, the liquid ejecting heads 30 include the flowing-out flow path DSV that communicates with the discharge common liquid chamber MN2 between the first bypass flow path BP1 and the second bypass flow path BP2 in the V2 direction. The first bypass flow path BP1 has the discharge vertical portion BP1VD extending from the discharge common liquid chamber MN2 in the Z1 direction. The discharge vertical portion BP1VD is an example of a "third vertical portion". The second bypass flow path BP2 has the discharge vertical portion BP2VD extending from the discharge common liquid chamber MN2 in the Z1 direction. The discharge vertical portion BP2VD is an example of a "fourth vertical portion". The discharge vertical portion BP1VD is positioned in the V1 direction with respect to the individual flow paths RJ disposed foremost in the V2 direction. The discharge vertical portion BP2VD is positioned in the V2 direction with respect to the individual flow paths RJ disposed foremost in the V1 direction. With reference to FIG. 21, the effect when the discharge vertical portion BP1VD is positioned in the V1 direction with respect to the individual flow path RJ disposed foremost in the V2 direction will be described.

FIG. 21 is a diagram showing a discharge common liquid chamber MN2 when the nozzle surface FN is inclined in the present embodiment. The figure shown in FIG. 21 illustrates the end of the discharge common liquid chamber MN2 in the V2 direction in a state where the nozzle surface FN is inclined by 60 degrees with respect to the horizontal plane SF in the present embodiment. In the example of FIG. 21, the V2 direction is a direction rotated 60 degrees counterclockwise with respect to the horizontal plane SF, and has a component in the direction opposite to the gravitational direction.

In the discharge common liquid chamber MN2, air bubbles in the vicinity of the individual flow path RJ communicating with the nozzle N disposed foremost in the V2 direction flow in the V2 direction due to buoyancy. On the other hand, the ink flows as indicated by an arrow Ar4 shown in FIG. 21. More specifically, the ink flowing in the discharge vertical portion BP1VD in the Z2 direction and the ink flowing from the individual flow path RJ disposed foremost in the V2 direction substantially in the V1 direction merge. As described above, in the present embodiment, since the discharge vertical portion BP1VD is positioned in the V1 direction with respect to the individual flow path RJ disposed foremost in the V2 direction, the flow of ink in the V1 direction from the individual flow path RJ disposed foremost in the V2 direction is generated. As described above, the air bubbles in the discharge common liquid chamber MN2 tend to flow in the V2 direction due to buoyancy, but since the flow of the air bubbles in the V2 direction and the flow of the ink in the V1 direction are opposite to each other, the occurrence of retention of air bubbles at the end of the discharge common liquid chamber MN2 in the V2 direction can be reduced.

Further, the supply common liquid chamber MN1 has a V2 communication region MN1*b* positioned from the introduction flow path SPV to the supply vertical portion BP1VS and a V2 end region MN1*a* positioned in the V2 direction with respect to the supply vertical portion BP1VS. The V2 communication region MN1*b* is an example of the "first region". The V2 end region MN1*a* is an example of the "second region". The surface MN1*a*S of the V2 end region MN1*a* in the Z1 direction is disposed in the Z2 direction with respect to the surface MN1*b*S of the V2 communication region MN1*b* in the Z1 direction.

By disposing the surface MN1*a*S in the Z2 direction with respect to the surface MN1*b*S, the flow rate of the ink in the V2 end region MN1*a* is made greater than the flow rate of the ink in the V2 end region MN1*a* in the mode in which the position of the surface MN1*a*S of the V2 end region MN1*a* in the Z-axis direction is the same as that of the surface MN1*b*S. By increasing the flow rate of the ink in the V2 end region MN1*a*, the occurrence of ink stagnation in the V2 end region MN1*a* can be reduced.

The V2 end region MN1*a* has a portion having a dimension that is equal to or less than half of the maximum dimension of the V2 communication region MN1*b* in the Z-axis direction. Generally, as the cross-sectional area of the flow path decreases, the flow rate of the liquid in the flow path increases. Therefore, the liquid ejecting head 30 can suppress a decrease in the flow rate of the individual flow path RJ communicating with the V2 end region MN1*a*. Further, as the wall surface of the V2 end region MN1*a* in the Z1 direction and the wall surface of the V2 end region MN1*a* are closer to each other in distance in the Z2 direction, the formation of a space in which air bubbles can be retained in the vicinity of the wall surface of the V2 end region MN1*a* in the Z1 direction can be suppressed.

Further, the liquid ejecting apparatus 100 includes a plurality of liquid ejecting heads 30. The plurality of liquid ejecting heads 30 constitute a long line head in the X-axis direction orthogonal to the Z1 direction. The V2 direction is a direction that intersects the X1 direction and the X2 direction. The X1 direction and the X2 direction are examples of a "fifth direction". One liquid ejecting head 30 may constitute a long line head in the X-axis direction.

When the line head is used with being placed on a surface inclined from the horizontal plane SF; in other words, when the nozzle surface FN is in a state of rotating about a straight line in the X-axis direction, the retention of air bubbles can be reduced as illustrated in FIG. 19 and FIG. 21.

Further, the liquid ejecting apparatus 100 includes the liquid ejecting head 30. Further, the liquid ejecting apparatus 100 includes the circulation mechanism 94 that circulates the ink supplied into the liquid ejecting head 30. By providing the circulation mechanism 94, air bubbles and sedimentation ink mixed in the ink are returned to the sub tank together with the circulating ink, and thus the occurrence of clogging of the nozzle N is reduced. Therefore, maintenance such as liquid replacement and cleaning of the liquid ejecting head 30 becomes easy.

Further, the liquid ejecting head 30 is constructed by stacking a plurality of substrates in the Z2 direction. The plurality of substrates include, for example, the first flow path member Du1 and the second flow path member Du2, which are included in the flow path distribution portion 37, and the case 385 and the communication plate 382, which are included in the head unit 38. The liquid ejecting head 30 includes the plurality of individual flow paths RJ, the supply common liquid chamber MN1, the discharge common liquid chamber MN2, and the bypass flow path BP. The plurality of individual flow paths RJ communicate with the plurality of nozzles N for ejecting ink in the Z2 direction, respectively. The supply common liquid chamber MN1 extends in a direction intersecting the Z1 direction and communicates with the plurality of individual flow paths RJ to supply ink to the plurality of individual flow paths RJ. The direction intersecting the Z1 direction is typically the V1 direction, but it does not have to be the V1 direction as long as it intersects the Z1 direction. The discharge common liquid chamber MN2 extends in the direction intersecting the Z1 direction and communicates with the plurality of individual flow paths RJ and ink discharged from the plurality of individual flow paths RJ flows therethrough. The extending direction of the supply common liquid chamber MN1 and the extending direction of the discharge common liquid chamber MN2 may be the same or different. The plurality of individual flow paths RJ couple the supply common liquid chamber MN1 to the discharge common liquid chamber MN2. The supply common liquid chamber MN1 and the discharge common liquid chamber MN2 are formed in the same layer, among a plurality of substrates. The same layer means that the positions in the Z-axis direction are the same. The same position in the Z-axis direction means that a part or the entirety is overlapped when viewed in the direction perpendicular to the Z-axis direction. For example, as illustrated in FIG. 8, the supply common liquid chamber MN1 and the discharge common liquid chamber MN2 overlap each other when viewed in the W-axis direction, which is the direction perpendicular to the Z-axis direction. The bypass flow path BP has the bypass horizontal portion BPH formed in a layer different from the supply common liquid chamber MN1 and the discharge common liquid chamber MN2, among the plurality of substrates. The bypass horizontal portion BPH is an example of the "first portion". Different layers mean different positions in the Z-axis direction. Different positions in the Z-axis direction mean that there is no overlapping portion when viewed in the direction perpendicular to the Z-axis direction. For example, as illustrated in FIG. 10, the bypass horizontal portion BP1H and the bypass horizontal portion BP2H are not overlapped with the supply common liquid chamber MN1 when viewed in the W2 direction.

Since the bypass horizontal portion BPH is also formed in a layer different from the supply common liquid chamber MN1 and the discharge common liquid chamber MN2, the bypass horizontal portion BPH can be overlapped with a part of the supply common liquid chamber Mn1 and the discharge common liquid chamber MN2, in the plan view. Therefore, in the first embodiment, the liquid ejecting head 30 can be miniaturized in the W-axis direction and the V-axis direction as compared with the mode in which the bypass horizontal portion BPH is in the same layer as the supply common liquid chamber MN1 and the discharge common liquid chamber MN2.

Further, the first bypass flow path BP1 has a supply vertical portion BP1VS and the discharge vertical portion BP1VD. The second bypass flow path BP2 has the supply vertical portion BP2VS and the discharge vertical portion BP2VD. The supply vertical portion BP1VS and the supply vertical portion BP2VS are examples of the "second portion". The discharge vertical portion BP1VD and the discharge vertical portion BP2VD are examples of the "third portion". The supply vertical portion BP1VS and the supply vertical portion BP2VS couple the supply common liquid chamber MN1 to one end of the bypass horizontal portion BPH, and extend from the supply common liquid chamber MN1 in the Z1 direction opposite to the Z2 direction. The discharge vertical portion BP1VD and the discharge vertical portion BP2VD couple the discharge common liquid chamber MN2 to the other end of the bypass horizontal portion BPH, and extend from the discharge common liquid chamber MN2 in the Z1 direction.

Since the first bypass flow path BP1 has the supply vertical portion BP1VS and the discharge vertical portion BP1VD, the bypass horizontal portion BP1H can be overlapped with a part of the supply common liquid chamber MN1 and the discharge common liquid chamber MN2, in the plan view. Similarly, since the second bypass flow path BP2 has the supply vertical portion BP2VS and the discharge vertical portion BP2VD, the bypass horizontal portion BP2H can be overlapped with a part of the supply common liquid chamber Mn1 and a part of the discharge common liquid chamber MN2, in the plan view.

By providing the supply flow path Si through which liquid is supplied to the supply common liquid chamber MN1 and the discharge flow path Do through which the liquid discharged from the discharge common liquid chamber MN2 flows, the bypass horizontal portion BPH, a part of the supply flow path Si, and a part of the discharge flow path Do are formed in the same layer, among a plurality of substrates. More specifically, the bypass horizontal portion BPH, the distribution flow paths SPH1 and the distribution flow path SPH2 which are a part of the supply flow path Si, and the discharge horizontal flow paths DSH_1 to DSH_6 which are a part of the discharge flow path Do are formed in the same layer.

Since the bypass horizontal portion BPH, distribution flow path SPH1 and distribution flow path SPH2, and discharge horizontal flow paths DSH_1 to DSH_6 are formed in the same layer, the bypass horizontal portion BPH, the distribution flow path SPH1 and distribution flow path SPH2, and the discharge horizontal flow paths DSH_1 to DSH_6 can be formed by the same members, the first flow path member Du1 and the second flow path member Du2. Therefore, in the present embodiment, the number of parts of the liquid ejecting head 30 can be reduced as compared with the mode in which one of the bypass horizontal portion BPH, the distribution flow path SPH1 and the distribution flow path SPH2, and the discharge horizontal flow paths DSH_1 to DSH_6, and the remaining flow paths other than the one of the flow paths are in the different layers.

Further, the plurality of nozzles N are arranged in the V2 direction orthogonal to the Z2 direction to form the nozzle row Ln. The supply common liquid chamber MN1 and the discharge common liquid chamber MN2 extend in the V2 direction. The liquid ejecting head 30 includes the wiring member 388 disposed between the supply common liquid chamber MN1 and the discharge common liquid chamber MN2 in the plan view in the Z2 direction. As illustrated in FIG. 10, the wiring member 388 has a portion positioned in the V2 direction with respect to the nozzle N disposed foremost in the V2 direction among the plurality of nozzles N in the plan view. Further, as illustrated in FIG. 10, the wiring member 388 has a portion positioned in the V1 direction with respect to the nozzle N disposed foremost in the V1 direction among the plurality of nozzles N in the plan view. The bypass horizontal portion BP1H has the bent portion BP1Hb and the bent portion BP1Hd that bend to bypass the wiring member 388. Similarly, the bypass horizontal portion BP2H has the bent portion BP2Hb and the bent portion BP2Hd that bend to bypass the wiring member 388.

As described above, the wiring member 388 has a portion positioned in the V2 direction with respect to the nozzle N disposed foremost in the V2 direction among the plurality of nozzles N, and has a portion positioned in the V1 direction with respect to the nozzle N disposed foremost in the V1 direction among the plurality of nozzles N. That is, the length of the wiring member 388 in the V-axis direction is longer than the length from the nozzle N disposed foremost in the most V2 direction to the nozzle N disposed foremost in the V1 direction, among the plurality of nozzles N. The reason why the length of the wiring member 388 in the V-axis direction is long is that the wiring member 388 has a plurality of wires corresponding to the plurality of nozzles N, respectively, in the center, and a wiring shared by all of the plurality of nozzles N. Therefore, the first bypass flow path BP1 cannot couple the bypass port 3853*a* and the bypass port 3853*b* with the shortest straight line in the plan view. Similarly, the second bypass flow path BP2 cannot couple the bypass port 3853*a* to the bypass port 3853*d* with the shortest straight line in the plan view. However, in the present embodiment, since the bypass horizontal portion BP1H has the bent portion BP1Hb and the bent portion BP1Hd and the bypass horizontal portion BP2H has the bent portion BP2Hb and the bent portion BP2Hd, it is not necessary to shift the bypass horizontal portion BP1H and the bypass horizontal portion BP2H in the Z-axis direction with respect to the wiring member 388, and thus the liquid ejecting head 30 can be miniaturized in the Z-axis direction.

Further, the plurality of substrates have the case 385 that defines a part of the supply common liquid chamber MN1 and a part of the discharge common liquid chamber MN2. A plurality of nozzles N communicating with the supply common liquid chamber MN1 are arranged in the V2 direction orthogonal to the Z2 direction to form the nozzle row Ln. The supply common liquid chamber MN1 and the discharge common liquid chamber MN2 extend in the V2 direction. As illustrated in FIGS. 10 and 16, the bypass horizontal portion BP2H has the portion BP2H1 that is not overlapped with the case 385 in the plan view in the Z2 direction. On the other hand, the entire bypass horizontal portion BP1H is overlapped with the case 385 in the plan view as seen in the Z2 direction. As described above, the bypass horizontal portion BPH may be completely overlapped with the case 385 or may not be overlapped with the case 385 in the plan view. The flow path distribution portion 37 can be miniaturized by overlapping the entire bypass horizontal portion BP1H with the case 385 in the plan view as seen in the Z-axis direction.

Further, the plurality of substrates have a plurality of cases 385 and the first flow path member Du1. Each of the plurality of cases 385 defines a part of the supply common liquid chamber MN1, a part of the discharge common liquid chamber MN2, and a part of the supply vertical portion BP1VS and the supply vertical portion BP2VS. The first flow path member Du1 defines the plurality of bypass horizontal portions BPH corresponding to the plurality of cases 385, respectively, and a part of the plurality of supply vertical portions BP1VS and supply vertical portions BP2VS corresponding to the plurality of cases 385, respectively. The average flow path resistance per unit length of the part of the supply vertical portion BP1VS defined by the first flow path member Du1 is greater than the average flow path resistance per unit length of the part of the supply vertical portion BP1VS defined by each of the plurality of cases 385. Specifically, in the supply vertical portion BP1VS, the vertical portion BP1VSa defined by the first flow path member Du1 has the largest flow path resistance. Therefore, the designer of the liquid ejecting head 30 can accurately and easily change the flow path resistance of the first bypass flow path BP1 by simply replacing the first flow path member Du1 defining the vertical portion BP1VSa having the largest flow path resistance. The designer can accurately and easily change the ink pressure by accurately and easily changing the flow path resistance of the first bypass flow path BP1.

The reason why the flow path resistance of the first bypass flow path BP1 can be easily changed is that when the first flow path member Du1 is formed by injection molding, the cross-sectional area of the supply vertical portion BP1VS can be easily changed by changing the thickness of the pin, which is the type of the supply vertical portion BP1VS. Further, even when the supply vertical portion BP1VS is formed by drilling, the designer can easily change the cross-sectional area of the supply vertical portion BP1VS by changing the thickness of the drill bit used for drilling.

The reason why the flow path resistance of the first bypass flow path BP1 can be changed with high accuracy will be described. The flow path resistance can be changed by changing the cross-sectional area of the bypass horizontal portion BP1H. However, when the flow path resistance of the bypass horizontal portion BP1H is changed, due to the influence of three factors, that is, the width in the V-axis direction, the width in the W-axis direction, and the width in the Z-axis direction, of the bypass horizontal portion BP1H, it is difficult to accurately manufacture the flow path resistance of the bypass horizontal portion BP1H to have the flow path resistance desired by the designer. On the other hand, the flow path resistance of the supply vertical portion BP1VS is only affected by the size of the pin used during injection molding or the size of the drill bit used for drilling. As described above, the flow path resistance of the supply vertical portion BP1VS can be changed with high accuracy as compared with the flow path resistance of the bypass horizontal portion BP1H.

Even for the second bypass flow path BP2, the designer of the liquid ejecting head 30 can accurately and easily change the flow path resistance of the second bypass flow path BP2, similar to the first bypass flow path BP1.

Further, in the first bypass flow path BP1, the average flow path resistance of the unit lengths of the supply vertical portion BP1VS and the discharge vertical portion BP1VD is greater than the average flow path resistance of the unit length of the bypass horizontal portion BP1H. In general, the flow path resistance of the entire flow path largely depends on the portion where the flow path resistance is relatively large. Therefore, by increasing the flow path resistance of the supply vertical portion BP1VS and the discharge vertical portion BP1VD of which flow path resistances can be accurately and easily changed, the flow path resistance of the first bypass flow path BP1 can be accurately and easily changed. Even in the second bypass flow path BP2, the average flow path resistance of the unit lengths of the supply vertical portion BP2VS and the discharge vertical portion BP2VD is greater than the average flow path resistance of the unit length of the bypass horizontal portion BP2H, similar to the first bypass flow path BP1.

Further, the length of the first flow path member Du1 in the supply vertical portion BP1VS and the supply vertical portion BP2VS in the Z1 direction is longer than the length of the case 385 in the supply vertical portion BP1VS and the supply vertical portion BP2VS in the Z1 direction. The length of the first flow path member Du1 in the supply vertical portion BP1VS and the supply vertical portion BP2VS in the Z1 direction is synonymous with the total length Ld of the vertical portion BP1VSa and the vertical portion BP1VSb in the Z1 direction. Further, the length of the case 385 in the supply vertical portion BP1VS and the supply vertical portion BP2VS in the Z1 direction is synonymous with the length Lc of the vertical portion BP2VSc in the Z1 direction.

Since the length Ld is longer than the length Lc, the length of the head unit 38 in the Z-axis direction can be shortened as compared with the mode in which the length Ld is shorter than the length Lc. Further, in the present embodiment, the maximum value of the flow path resistance of the bypass flow path BP formed in the first flow path member Du1 can be increased as compared with the mode in which the length Ld is shorter than the length Lc. That is, in the present embodiment, the changeable range of the flow path resistance of the bypass flow path BP can be increased as compared with the mode in which the length Ld is shorter than the length Lc.

The plurality of substrates have the plurality of cases 385, the first flow path member Du1, and the second flow path member Du2. Each of the plurality of cases 385 defines a part of the supply common liquid chamber MN1, a part of the discharge common liquid chamber MN2, and a part of the bypass flow path BP. The first flow path member Du1 is stacked with respect to the plurality of cases 385 in the Z1 direction which is a direction opposite to the Z2 direction. The second flow path member Du2 is stacked with respect to the first flow path member Du1 in the Z1 direction. The liquid ejecting head 30 includes the distribution flow path SPH1 and the distribution flow path SPH2. The distribution flow path SPH1 and the distribution flow path SPH2 distribute and supply ink to a plurality of supply common liquid chambers MN1 defined by each of the plurality of cases 385. As illustrated in FIG. 17, the plurality of bypass horizontal portions BP1H and bypass horizontal portions BP2H corresponding to each of the plurality of cases 385, and the distribution flow path SPH1 and the distribution flow path SPH1 are formed between the first flow path member Du1 and the second flow path member Du2. The bypass horizontal portion BP1H and the bypass horizontal portion BP2H corresponding to the case 385 are the bypass horizontal portion BP1H and the bypass horizontal portion BP2H included in the bypass flow path BP communicating with the bypass port 3853 of the case 385.

According to the present embodiment, the bypass horizontal portion BP1H, the bypass horizontal portion BP2H, the distribution flow path SPH1, and the distribution flow path SPH2 can be formed by the same member, and thus the number of parts of the liquid ejecting head 30 can be reduced as compared with the mode in which one of the bypass horizontal portion BP1H, the bypass horizontal portion BP2H, the distribution flow path SPH1, and the distribution flow path SPH2 is formed other than between the first flow path member Du1 and the second flow path member Du2.

2. Second Embodiment

As illustrated in FIG. 1, the liquid ejecting apparatus 100 according to the first embodiment is a so-called line-type liquid ejecting apparatus in which the head module 3 is fixed and printing is performed simply by transporting the medium PP, but the configuration of the liquid ejecting apparatus is not limited to that described above. A liquid ejecting apparatus 100A according to the second embodiment is a so-called serial-type liquid ejecting apparatus in which one or more liquid ejecting heads 30 are mounted on a carriage 911 and printing is performed by reciprocating the one or more liquid ejecting heads 30 in the X-axis direction and transporting the medium PP. Hereinafter, the second embodiment will be described.

Figure 22:
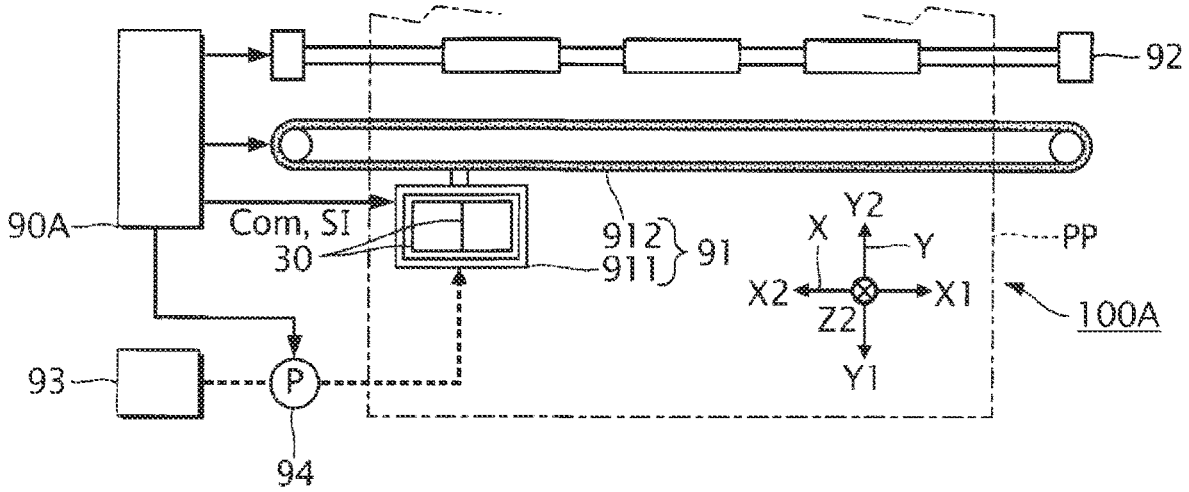
FIG. 22 is an explanatory view showing an example of a liquid ejecting apparatus according to the second embodiment.

FIG. 22 is an explanatory view showing an example of the liquid ejecting apparatus 100A according to the second embodiment. The liquid ejecting apparatus 100A is different from the liquid ejecting apparatus 100 in that it includes a control device 90A instead of the control device 90, a head module 3A instead of the head module 3, and a moving mechanism 91.

The moving mechanism 91 reciprocates the liquid ejecting heads 30 in the X1 direction and the X2 direction under the control of the control device 90A. In the example shown in FIG. 22, the moving mechanism 91 has a box-shaped carriage 911 that holds two liquid ejecting heads 30, and a transport belt 912 to which the carriage 911 is fixed. The transport belt 912 reciprocates the carriage 911 in the X1 direction and the X2 direction by a driving force from a driving source (not shown).

As described above, the liquid ejecting apparatus 100A in the second embodiment includes the liquid ejecting heads 30 and the moving mechanism 91. The moving mechanism 91 holds the liquid ejecting heads 30 and reciprocates the liquid ejecting heads 30 in the X1 direction and the X2 direction orthogonal to the Z2 direction.

When the liquid ejecting heads 30 are used at an angle with respect to the horizontal plane SF, in other words, when the nozzle surface FN is in a state of being rotated about a straight line in the X-axis direction with respect to the horizontal plane SF, the V-axis direction is a direction intersecting the X-axis direction, and thus the occurrence of ink stagnation can be reduced as in the first embodiment.

3. Third Embodiment

A liquid ejecting apparatus 100B according to the third embodiment has a configuration in which four head modules 3 are arranged around a drum 921 for rotationally transporting the medium PP. Hereinafter, a third embodiment will be described.

Figure 23:
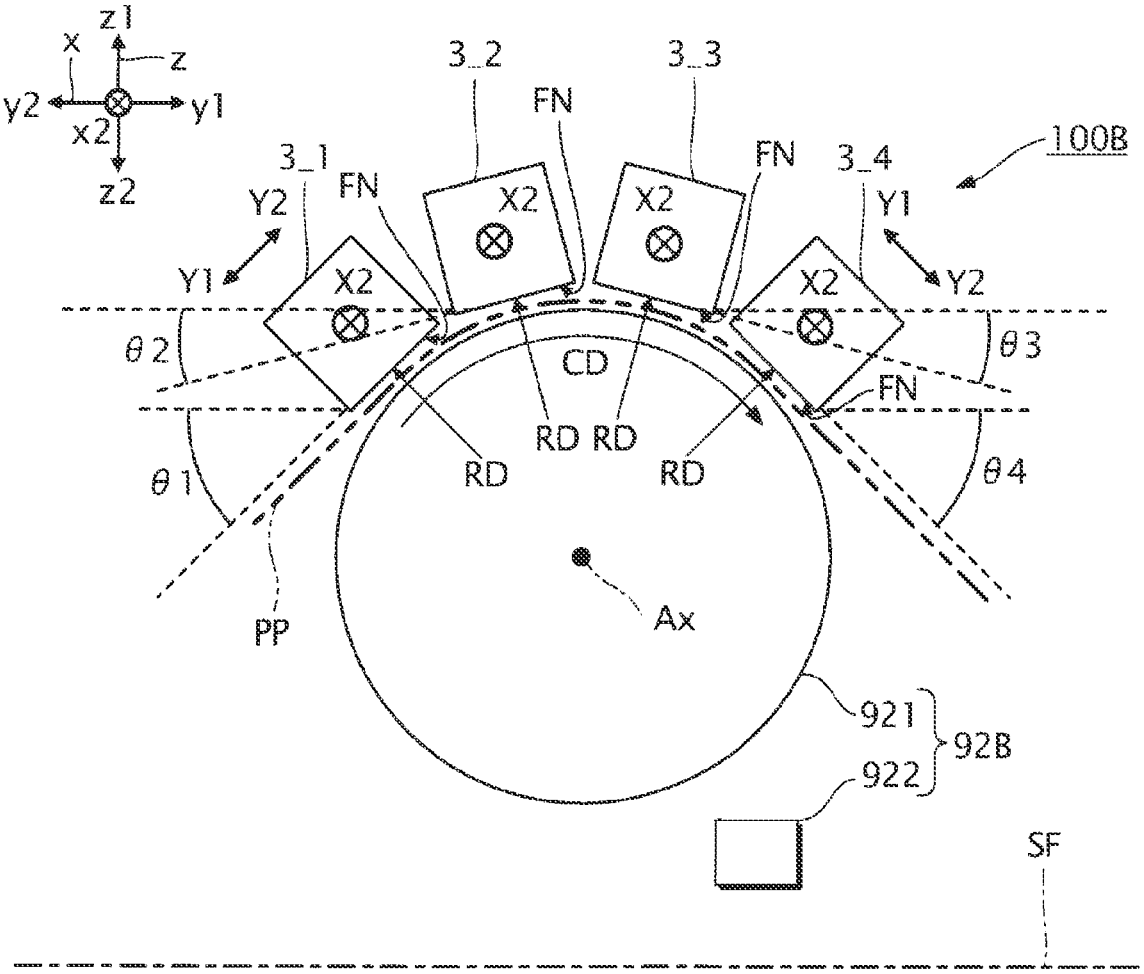
FIG. 23 is a schematic view of a liquid ejecting apparatus according to a third embodiment.

FIG. 23 is a schematic view of the liquid ejecting apparatus 100B according to the third embodiment. The liquid ejecting apparatus 100B is the same as the liquid ejecting apparatus 100 except that it has a transport mechanism 92B instead of the transport mechanism 92 and has a plurality of head modules 3. In FIG. 23, the control device 90, the circulation mechanism 94, and the like are not shown.

In FIG. 23, in addition to the XYZ coordinate system used in FIG. 1 and the like, an xyz coordinate system different from the XYZ coordinate system will be used for description. The xyz coordinate system is a global coordinate system. The xyz coordinate system is defined by an x1 direction, a y1 direction, and a z2 direction. The x1 direction is any direction parallel to the horizontal plane SF. The y1 direction is parallel to the horizontal plane SF and orthogonal to the x1 direction. The z2 direction is the gravitational direction. Further, in the following description, the opposite direction of the x1 direction is referred to as an x2 direction. Further, the x1 direction and the x2 direction are collectively referred to as an x-axis direction. The opposite direction of the y1 direction is referred to as a y2 direction. The y1 direction and the y2 direction are collectively referred to as a y-axis direction. The opposite direction of the z2 direction is referred to as a z1 direction. The z1 direction and the z2 direction are collectively referred to as a z-axis direction. The figure shown in FIG. 23 is a view of the liquid ejecting apparatus 100B when viewed in the x2 direction. The XYZ coordinate system in the third embodiment exists for each head module 3.

As illustrated in FIG. 23, the transport mechanism 92B includes the drum 921 that transports the medium PP in a state of being adsorbed on the outer peripheral surface, and a drive mechanism 922 such as a motor. The drum 921 is a cylindrical or columnar member having an outer peripheral surface along the central axis Ax parallel to the x-axis direction. The drum 921 is rotationally driven about the central axis Ax by the drive mechanism 922. The outer peripheral surface of the drum 921 is charged by a charger (not shown). The medium PP is electrostatically adsorbed on the outer peripheral surface of the drum 921 by the electrostatic force due to this charging.

The configuration of the transport mechanism 92B is not limited to the example illustrated in FIG. 23, and for example, a belt may be used instead of the drum 921, or air suction or the like may be used instead of electrostatic adsorption. Further, the transport mechanism 92B may have a component such as an electrostatic eliminator in addition to the above-mentioned components.

Head modules 3_1, 3_2, 3_3, and 3_4 face each other on the outer peripheral surface of the drum 921. Each of the head modules 3_1, 3_2, 3_3, and 3_4 is configured in the same manner as the head module 3 of the first embodiment.

However, in the head modules 3_1, 3_2, 3_3, and 3_4, the attitudes around the axes parallel to the x-axis direction are different from each other. Further, the type of ink used for the head modules 3_1, 3_2, 3_3, and 3_4 may be different for each head module 3. For example, when the colors of the inks used for the head modules 3_1, 3_2, 3_3, and 3_4 are different for each head module 3, four colors of inks of yellow, magenta, cyan and black are used.

Specifically, the head modules 3_1, 3_2, 3_3, and 3_4 are arranged in this order along the outer peripheral surface of the drum 921 in the circumferential direction CD of the central axis Ax. Further, each of the head modules 3_1, 3_2, 3_3, and 3_4 is arranged at a position rotated about a rotation axis extending in the X1 direction which is the longitudinal direction of the head module 3, and thus the nozzle surface FN is orthogonal to a radial direction RD of the central axis Ax of the drum 921 and inclined with respect to the horizontal plane SF.

However, in the example of FIG. 23, the nozzle surface FNs of each of the head modules 3_1, 3_2, 3_3, and 3_4 are inclined with respect to the horizontal plane SF, but may be parallel to the horizontal plane SF. When the nozzle surface FN is parallel to the horizontal plane SF, the Y-axis direction of the head module 3 having the nozzle surface FN is parallel to the y-axis direction, and the Z-axis direction of the head module 3 is parallel to the z-axis direction.

The X-axis direction of the head modules 3_1, 3_2, 3_3, and 3_4 is parallel to the x-axis direction. Therefore, the head modules 3_1, 3_2, 3_3, and 3_4 are line heads that are long in the x-axis direction.

A positional relationship of the head modules 3 will be described. The head module 3_4 is disposed in the y1 direction orthogonal to the x-axis direction with respect to the head module 3_1 in the plan view as seen in the z-axis direction. Similarly, the head module 3_3 is disposed in the y1 direction with respect to the head module 3_2 in the plan view as seen in the z-axis direction.

The head module 3_1 and the head module 3_2 are examples of the "first line head". When the head module 3_1 corresponds to the "first line head", the head module 3_4 corresponds to the "second line head". When the head module 3_2 corresponds to the "first line head", the head module 3_3 corresponds to the "second line head". In the third embodiment, the x1 direction and the x2 direction are examples of the "fifth direction". The y1 direction is an example of the "sixth direction". However, when the nozzle surface FN is parallel to the horizontal plane SF, the Y1 direction and the y1 direction of the head module 3 having the nozzle surface FN are the same.

The head module 3_1 is disposed at an angle such that the end of the nozzle surface FN of the head module 3_1 in the y1 direction is positioned in the z1 direction with respect to the end of the nozzle surface FN of the head module 3_1 in the y2 direction opposite to the y1 direction. Similarly, the head module 3_2 is disposed at an angle such that the end of the nozzle surface FN of the head module 3_2 in the y1 direction is positioned in the z1 direction with respect to the end of the nozzle surface FN of the head module 3_2 in the y2 direction opposite to the y1 direction.

When the head module 3_1 corresponds to the "first line head", the nozzle surface FN of the head module 3_1 corresponds to the "first nozzle surface". When the head module 3_2 corresponds to the "first line head", the nozzle surface FN of the head module 3_2 corresponds to the "first nozzle surface". The y2 direction is an example of a "seventh direction".

The head module 3_3 is disposed so as to be inclined such that the end of the nozzle surface FN of the head module 3_3 in the y1 direction is positioned in the z2 direction with respect to the end of the nozzle surface FN of the head module 3_3 in the y2 direction. Similarly, the head module 3_4 is disposed to be inclined such that the end of the nozzle surface FN of the head module 3_4 in the y1 direction is positioned in the z2 direction with respect to the end of the nozzle surface FN of the head module 3_4 in the y2 direction.

Further, an inclination angle θ1 of the nozzle surface FN of the head module 3_1 with respect to the horizontal plane SF is equal to an inclination angle θ4 of the nozzle surface FN of the head module 3_4 with respect to the horizontal plane SF. Similarly, an inclination angle θ2 of the nozzle surface FN of the head module 3_2 with respect to the horizontal plane SF is equal to an inclination angle θ3 of the nozzle surface FN of the head module 3_3 with respect to the horizontal plane SF. However, each of the inclination angles θ2 and 03 is smaller than the above-mentioned inclination angles θ1 and θ4.

In the above third embodiment, the liquid ejecting head 30 in the head modules 3_1, 3_2, 3_3, and 3_4 includes the nozzle surface FN having a plurality of nozzles N, and the nozzle surface FN is orthogonal to the radial direction RD of the axis along the x-axis direction and is inclined with respect to the horizontal plane SF. The x-axis direction is a direction intersecting the V-axis direction. According to the third embodiment, as in the first embodiment, occurrence of ink stagnation at the ends of the supply common liquid chamber MN1 and the discharge common liquid chamber MN2 in the direction opposite to the gravitational direction can be suppressed, which can lead to a reduction in the retention of air bubbles.

Even in the liquid ejecting apparatus including the head module disposed such that the V1 direction contains a component in the z1 direction and the head module disposed such that the V2 direction contains a component in the z1 direction, such as the head module 3_2 and the head module 3_3, and the head module 3_1 and the head module 3_4, the bypass flow path BP is provided in the vicinity of the ends in both the V1 direction and the V2 direction, and thus the air discharge properties can be improved. It can be seen that the liquid ejecting apparatus including the head module disposed such that the V1 direction contains a component in the z1 direction and the head module disposed such that the V2 direction contains a component in the z1 direction includes a plurality of head modules having opposite rotation directions with respect to the central axis Ax.

In the above description, the head module 3_1 and the head module 3_2 are described as an example of the "first line head"; however, the head module 3_3 and the head module 3_4 may be examples of the "first line head". When the head module 3_3 corresponds to the "first line head", the head module 3_2 corresponds to the "second line head". On the other hand, when the head module 3_4 corresponds to the "first line head", the head module 3_1 corresponds to the "second line head". The "sixth direction" corresponds to the y2 direction, and the "seventh direction" corresponds to the y1 direction.

Further, as described above, the inclination angle θ1 is equal to the inclination angle θ4. Therefore, it is highly likely that the location where air bubbles are generated in the head module 3_1 and the location where air bubbles are generated in the head module 3_4 are close to line symmetry with the xz plane passing through the central axis Ax as the axis of symmetry, as compared with the mode in which the inclination angle θ1 is different from the inclination angle θ4. Therefore, the operating conditions for discharging air bubbles, in other words, the operating time for maintenance, can be set to be the same for the head module 3_1 and the head module 3_1. More specifically, the time for performing maintenance for discharging the air bubbles in the head module 3_1 and the time for performing maintenance for discharging the air bubbles in the head module 3_4 can be set to the same time. Therefore, according to the third embodiment, it is possible to simplify the maintenance setting for discharging the air bubbles.

4. Modification Example

The above-illustrated embodiments can be modified in various ways. Specific modes of modification examples that can be applied to the above-described embodiment are illustrated below. Any two or more modes selected from the following examples can be appropriately merged within the extent that they do not contradict each other.

4.1. First Modification Example

The bypass horizontal portion BPH in each of the embodiments described above is bent to bypass the wiring member 388; however, when the length of the wiring member 388 in the V-axis direction is shorter than the length from the supply vertical portion BP1VS to the supply vertical portion BP2VS, the bypass horizontal portion BPH does not have to be bent.

Figure 24:
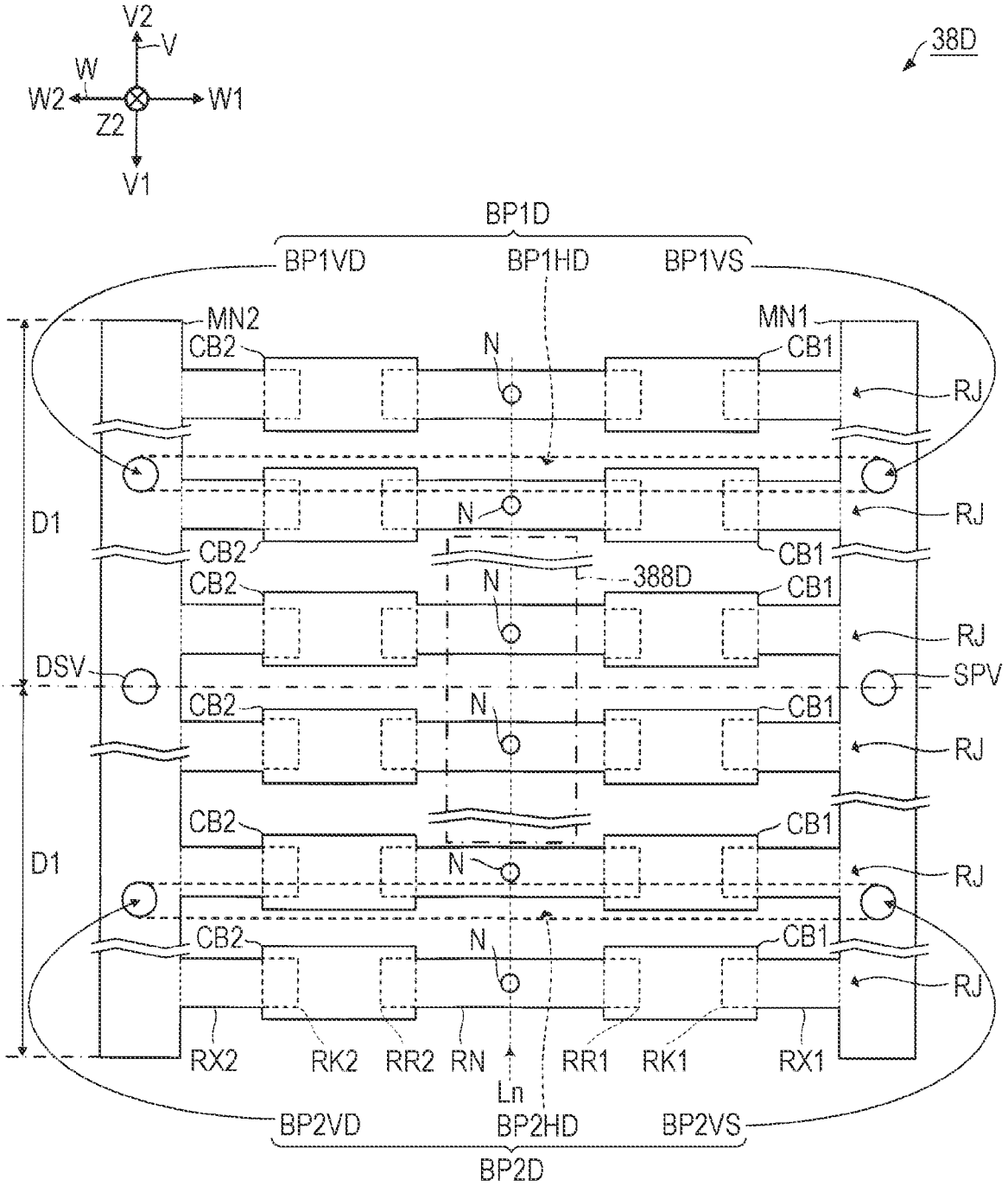
FIG. 24 is a plan view of the head unit seen in the Z2 direction in a first modification example.

FIG. 24 is a plan view of a head unit 38D seen in the Z2 direction in a first modification example. In the figure shown in FIG. 24, a wiring member 388D is indicated by the dashed line to show a positional relationship among a first bypass flow path BP1D in the first modification example, a second bypass flow path BP2D in the first modification example, and the wiring member 388D in the first modification example.

As illustrated in FIG. 24, the first bypass flow path BP1D has the supply vertical portion BP1VS, the bypass horizontal portion BP1HD, and the discharge vertical portion BP1VD. As illustrated in FIG. 24, in the V-axis direction, the end of the wiring member 388D in the V2 direction is positioned in the V1 direction with respect to the end of the supply vertical portion BP1VS in the V1 direction and the end of the discharge vertical portion BP1VD in the V1 direction. Therefore, the bypass horizontal portion BP1HD does not have to have a bent portion. The bypass horizontal portion BP1HD extends in the W-axis direction, communicates with the supply vertical portion BP1VS at the end in the W1 direction, and communicates with the discharge vertical portion BP1VD at the end in the W2 direction.

As illustrated in FIG. 24, the second bypass flow path BP2D has the supply vertical portion BP2VS, the bypass horizontal portion BP2HD, and the discharge vertical portion BP2VD. As illustrated in FIG. 24, in the V-axis direction, the end of the wiring member 388D in the V1 direction is positioned in the V2 direction with respect to the end of the supply vertical portion BP2VS in the V2 direction and the end of the discharge vertical portion BP2VD in the V2 direction. Therefore, the bypass horizontal portion BP2HD does not have to have a bent portion. The bypass horizontal portion BP2HD extends in the W-axis direction, communicates with the supply vertical portion BP2VS at the end in the W1 direction, and communicates with the discharge vertical portion BP2VD at the end in the W2 direction.

4.2. Second Modification Example

The supply flow path Si in each of the above embodiments includes the distribution flow path SPH1 and the distribution flow path SPH2 which are the same layer as the bypass horizontal portion BPH, and the discharge flow path Do includes the discharge horizontal flow paths DSH_1 to DSH_6 which are the same layer as the bypass horizontal portion BPH; however, the present disclosure is not limited thereto. For example, one of the supply flow path Si and the discharge flow path Do does not have to have a flow path that is in the same layer as the bypass horizontal portion BPH. In other words, the bypass horizontal portion BPH, a part of the supply flow path Si, and a part of the discharge flow path Do may be formed in the same layer. Specifically, there are the following two modes. In the first mode, the supply flow path Si includes the distribution flow path SPH1 and the distribution flow path SPH2, and the discharge flow path Do does not have a flow path along the VW plane between the first flow path member Du1 and the second flow path member Du2. In the second mode, the supply flow path Si does not have a flow path along the VW plane between the first flow path member Du1 and the second flow path member Du2, and the discharge flow path Do has discharge horizontal flow paths DSH_1 to DSH_6.

According to the second modification example, since the bypass horizontal portion BPH and one of the part of the supply flow path Si and the part of the discharge flow path Do can be formed of the same member as compared with the mode in which the supply flow path Si and the discharge flow path Do do not have a flow path along the VW plane formed between the first flow path member Du1 and the second flow path member Du2, it is possible to reduce the number of parts of the liquid ejecting head 30.

4.3. Third Modification Example

In the first embodiment, the second embodiment, the third embodiment, and the first modification example described above, the distribution flow paths SPH1 and SPH2 are formed in the flow path distribution portion 37, and the discharge merging flow paths DUo1 and DUo2 are formed in the flow path structure 34, but the present disclosure is not limited thereto. The liquid ejecting head 30 according to the third modification example has a distribution flow path for distributing and supplying ink to a plurality of supply common liquid chambers MN1 in the flow path structure 34, and has a merging flow path for merging ink discharged from a plurality of discharge common liquid chambers MN2 in the flow path distribution portion 37.

That is, in the liquid ejecting head 30 in the third modification example, the plurality of substrates have the plurality of cases 385, the first flow path member Du1, and the second flow path member Du2. Each of the plurality of cases 385 defines a part of the supply common liquid chamber MN1, a part of the discharge common liquid chamber MN2, and a part of the bypass flow path BP. The first flow path member Du1 is stacked with respect to the plurality of cases 385 in the direction opposite to the Z1 direction. The second flow path member Du2 is stacked with respect to the first flow path member Du1 in the direction opposite to the Z1 direction. The liquid ejecting head 30 includes a merging flow path for merging the liquid discharged from the plurality of discharge common liquid chambers MN2 defined by each of the plurality of cases 385. A plurality of first portions corresponding to each of the plurality of cases 385 and the merging flow path are formed between the first flow path member Du1 and the second flow path member Du2.

According to the third modification example, since the bypass horizontal portion BPH and the above-mentioned merging flow path can be formed by the same member, the number of parts of the liquid ejecting head 30 can be reduced as compared with the mode in which the above-mentioned merging flow path is formed other than between the first flow path member Du1 and the second flow path member Du2.

The effect of the first embodiment due to the difference between the first embodiment and the third modification example will be described. In general, when the flow paths merge, the flow rate increases, and the pressure loss is likely to increase. Further, considering the influence of the pressure on the nozzles N, there is a situation in which the pressure loss is desired to be reduced in the discharge flow path Do rather than in the supply flow path Si. Therefore, in the first embodiment, the portion where ink merges is relative long in the supply flow path Si as compared with the third modification example in which ink is distributed to the flow path structure 34, and thus the flow rate increases, which can lead to the improvement of discharge of air bubbles. Further, in the first embodiment, the portion where ink merges is relatively short in the discharge flow path Do as compared with the third modification example in which the merging flow path is provided for merging ink into the flow path distribution portion 37, and thus the resistance of the flow path is reduced, which can lead to the reduction in the pressure fluctuation of the nozzles N.

4.4. Fourth Modification Example

In each of the modes, the case 385 defines a part of the supply common liquid chamber MN1 and a part of the discharge common liquid chamber MN2, but may define the entire supply common liquid chamber MN1, and the entire discharge common liquid chamber MN2.

4.5. Fifth Modification Example

In each of the above modes, the supply vertical portion BP1VS is positioned in the V1 direction with respect to the individual flow paths RJ arranged foremost in the V2 direction. The supply vertical portion BP2VS is positioned in the V2 direction with respect to the individual flow paths RJ disposed foremost in the V1 direction, and is not limited thereto. For example, the supply vertical portion BP1VS may be positioned in the V2 direction with respect to the individual flow path RJ arranged foremost in the V2 direction, and the supply vertical portion BP2VS may be positioned in the V1 direction with respect to the individual flow path RJ disposed foremost in the V1 direction. For example, the first example shown in FIG. 18 is the mode in which the supply vertical portion BP1VS is positioned in the V2 direction with respect to the individual flow path RJ disposed foremost in the V2 direction.

In the fifth modification example, the bypass horizontal portion BPH is also formed in a layer different from the supply common liquid chamber MN1 and the discharge common liquid chamber MN2, and thus the bypass horizontal portion BPH can be overlapped with a part of the supply common liquid chamber MN1 and the discharge common liquid chamber MN2, in the plan view. Therefore, even in the fifth modification example, the liquid ejecting head 30 can be miniaturized in the W-axis direction and the V-axis direction as in the first embodiment.

4.6. Sixth Modification Example

In each of the above modes, the liquid ejecting head 30 may serve as an energy generating element for generating energy in the pressure chambers CB to eject ink, and may have a heat generating element instead of the piezoelectric elements used in each of the above modes.

4.7. Other Modification Examples

The liquid ejecting apparatus 100 described above can be employed in various devices such as a facsimile machine and a copier, in addition to a device dedicated to printing. However, the application of the liquid ejecting apparatus 100 of the present disclosure is not limited to printing. For example, the liquid ejecting apparatus for ejecting a solution of a coloring material is used as a manufacturing device for forming a color filter of a liquid crystal display device. Further, the liquid ejecting apparatus for ejecting a solution of a conductive material is used as a manufacturing device for forming wiring and electrodes on a wiring substrate.

5. Appendix

For example, the following configurations can be understood from the embodiments exemplified above.

According to Aspect 1, which is a preferred aspect, there is provided a liquid ejecting head that has a plurality of substrates stacked in a first direction, the liquid ejecting head including a plurality of individual flow paths that communicate with a plurality of nozzles for ejecting liquid in the first direction, respectively, a supply common liquid chamber that extends in a direction intersecting the first direction and communicates with the plurality of individual flow paths to supply liquid to the plurality of individual flow paths, a discharge common liquid chamber that extends in a direction intersecting the first direction and communicates with the plurality of individual flow paths and through which liquid discharged from the plurality of individual flow paths flows, and a bypass flow path that couples the supply common liquid chamber to the discharge common liquid chamber, in which the supply common liquid chamber and the discharge common liquid chamber are formed in the same layer among the plurality of substrates, and the bypass flow path has a first portion formed in a layer different from the supply common liquid chamber and the discharge common liquid chamber, among the plurality of substrates.

According to Aspect 1, it is possible to miniaturize the liquid ejecting head in a direction parallel to a nozzle surface as compared with an aspect in which the first portion is in the same layer as the supply common liquid chamber and the discharge common liquid chamber.

In Aspect 2, which is a specific example of Aspect 1, the bypass flow path has a second portion that couples the supply common liquid chamber to one end of the first portion and extends from the supply common liquid chamber in an opposite direction of the first direction, and a third portion that couples the discharge common liquid chamber to the other end of the first portion and extends from the discharge common liquid chamber in the opposite direction.

According to Aspect 2, in a plan view, the first portion can be overlapped with a part of the supply common liquid chamber and a part of the discharge common liquid chamber.

In Aspect 3, which is a specific example of Aspect 1 or 2, the liquid ejecting head further includes a supply flow path through which liquid is supplied to the supply common liquid chamber and a discharge flow path through which liquid discharged from the discharge common liquid chamber flows, and the first portion and at least one of a part of the supply flow path and a part of the discharge flow path are formed in the same layer, among the plurality of substrates.

According to Aspect 3, since the first portion and at least one of the part of the supply flow path and the part of the discharge flow path can be formed of the same member as compared with the aspect in which the supply flow path and the discharge flow path do not have a flow path formed between the first flow path member and the second flow path member, it is possible to reduce the number of parts of the liquid ejecting head.

In Aspect 4, which is a specific example of Aspect 1 or 2, the liquid ejecting head further includes a supply flow path through which liquid is supplied to the supply common liquid chamber and a discharge flow path through which liquid discharged from the discharge common liquid chamber flows, and the first portion, a part of the supply flow path, and a part of the discharge flow path are formed in the same layer, among the plurality of substrates.

According to Aspect 4, since the first portion, the part of the supply flow path, and the part of the discharge flow path can be formed of the same member as compared with the aspect in which the supply flow path and the discharge flow path do not have a flow path formed between the first flow path member and the second flow path member, it is possible to reduce the number of parts of the liquid ejecting head.

In Aspect 5, which is a specific example of any one of Aspects 1 to 4, the plurality of nozzles form a nozzle row by arranging the nozzles in a second direction orthogonal to the first direction, the supply common liquid chamber and the discharge common liquid chamber extend in the second direction, the liquid ejecting head further includes a wiring member disposed between the supply common liquid chamber and the discharge common liquid chamber in a plan view as seen in the first direction, the wiring member has a portion positioned in the second direction with respect to a nozzle disposed foremost in the second direction, among the plurality of nozzles, in the plan view, and the first portion has a bent portion that is bent to bypass the wiring member.

According to Aspect 5, since the first portion has the bent portion and thus it is not necessary to shift the first portion in the first direction with respect to the wiring member, it is possible to miniaturize the liquid ejecting head in the first direction.

In Aspect 6, which is a specific example of any one of Aspects 1 to 5, the plurality of substrates include a case that defines a part or an entirety of the supply common liquid chamber and a part or an entirety of the discharge common liquid chamber, the plurality of nozzles communicating with the supply common liquid chamber form a nozzle row by arranging the nozzles in a second direction orthogonal to the first direction, the supply common liquid chamber and the discharge common liquid chamber extend in the second direction, and the first portion has a portion that is not overlapped with the case in a plan view as seen in the first direction.

In Aspect 7, which is a specific example of any one of Aspects 1 to 5, the plurality of substrates include a case that defines a part or an entirety of the supply common liquid chamber and a part or an entirety of the discharge common liquid chamber, the plurality of nozzles communicating with the supply common liquid chamber form a nozzle row by arranging the nozzles in a second direction orthogonal to the first direction, the supply common liquid chamber and the discharge common liquid chamber extend in the second direction, and the first portion is overlapped with the case in a plan view as seen in the first direction.

According to Aspect 7, it is possible to miniaturize the member defining the first portion as compared with the aspect in which the first portion has a portion that is not overlapped with the case in the plan view as seen in the first direction.

In Aspect 8, which is a specific example of Aspect 2 and any one of Aspects 3 to 6, which is a specific example of Aspect 2, the plurality of substrates include a plurality of cases that define a part or an entirety of the supply common liquid chamber, a part or an entirety of the discharge common liquid chamber, and a part of the second portion and a first flow path member that defines a plurality of the first portions corresponding to each of the plurality of cases, and a part of a plurality of the second portions corresponding to each of the plurality of cases, and an average flow path resistance per unit length of the part of the second portions defined by the first flow path member is greater than an average flow path resistance per unit length of the part of the second portion defined by each of the plurality of cases.

According to Aspect 8, a designer of the liquid ejecting apparatus can accurately and easily change the bypass flow path resistance of the bypass flow path just by replacing the first flow path member that defines the vertical portion having the greatest flow path resistance.

In Aspect 9, which is a specific example of Aspect 8, a length of the first flow path member in the second portion in the first direction is longer than a length of the case in the second portion in the first direction.

According to Aspect 9, it is possible to increase the changeable range of the flow path resistance of the bypass flow path as compared with the aspect in which the length of the first flow path member in the second portion in the first direction is shorter than the length of the case in the second portion in the first direction.

In Aspect 10, which is a specific example of any one of Aspects 1 to 5, the plurality of substrates include a plurality of cases that define a part or an entirety of the supply common liquid chamber, a part or an entirety of the discharge common liquid chamber, and a part of the bypass flow path, a first flow path member stacked with respect to the plurality of cases in an opposite direction of the first direction, and a second flow path member stacked with respect to the first flow path member in the opposite direction, the liquid ejecting head further includes a distribution flow path for distributing and supplying liquid to a plurality of the supply common liquid chambers defined by each of the plurality of cases, and a plurality of the first portions corresponding to each of the plurality of cases, and the distribution flow path are formed between the first flow path member and the second flow path member.

According to Aspect 10, since the first portion and the distribution flow path can be formed of the same member, it is possible to reduce the number of parts of the liquid ejecting head as compared with the aspect in which any one of the first portion and the distribution flow path are formed other than between the first flow path member and the second flow path member.

In Aspect 11, which is a specific example of any one of Aspects 1 to 5, the plurality of substrates include a plurality of cases that define a part or an entirety of the supply common liquid chamber, a part or an entirety of the discharge common liquid chamber, and a part of the bypass flow path, a first flow path member stacked with respect to the plurality of cases in an opposite direction of the first direction, and a second flow path member stacked with respect to the first flow path member in the opposite direction, the liquid ejecting head further includes a merging flow path for merging liquid discharged from a plurality of the discharge common liquid chambers defined by each of the plurality of cases, and a plurality of the first portions corresponding to each of the plurality of cases and the merging flow path are formed between the first flow path member and the second flow path member.

According to Aspect 11, since the first portion and the merging flow path can be formed of the same member, it is possible to reduce the number of parts of the liquid ejecting head as compared with the aspect in which any one of the first portion and the merging flow path are formed other than between the first flow path member and the second flow path member.

In Aspect 12, which is a preferred aspect, a liquid ejecting apparatus includes the liquid ejecting head according to any one of Aspects 1 to 10.

According to Aspect 12, it is possible to provide the liquid ejecting apparatus including the liquid ejecting head that is miniaturized in the direction parallel to the nozzle surface.

In Aspect 13, which is a specific example of Aspect 12, the liquid ejecting apparatus includes a circulation mechanism for circulating liquid supplied into the liquid ejecting head.

According to Aspect 13, the air bubbles and dust mixed in the liquid are returned to the circulation mechanism together with the circulating liquid, and thus the occurrence of nozzle clogging is reduced. Therefore, maintenance of liquid replacement and cleaning of the liquid ejecting head becomes easy.

What is claimed is:

1. A liquid ejecting head that has substrates stacked in a first direction, the liquid ejecting head comprising:

individual flow paths respectively communicating with nozzles configured to eject liquid in the first direction;

a supply common liquid chamber that extends in a direction intersecting the first direction and communicates with the individual flow paths to supply liquid to the individual flow paths;

a discharge common liquid chamber that extends in a direction intersecting the first direction and communicates with the individual flow paths and through which liquid discharged from the individual flow paths flows; and a bypass flow path coupling the supply common liquid chamber to the discharge common liquid chamber, wherein the supply common liquid chamber and the discharge common liquid chamber are formed in the same layer among the substrates, and the bypass flow path has a first portion formed in a layer different from the supply common liquid chamber and the discharge common liquid chamber, among the substrates.

2. The liquid ejecting head according to claim 1, wherein the bypass flow path has a second portion that couples the supply common liquid chamber to one end of the first portion and extends from the supply common liquid chamber in an opposite direction of the first direction, and a third portion that couples the discharge common liquid chamber to the other end of the first portion and extends from the discharge common liquid chamber in the opposite direction.

3. The liquid ejecting head according to claim 1, further comprising a supply flow path through which liquid is supplied to the supply common liquid chamber and a discharge flow path through which liquid discharged from the discharge common liquid chamber flows, wherein the first portion and at least one of a part of the supply flow path and a part of the discharge flow path are formed in the same layer, among the substrates.

4. The liquid ejecting head according to claim 1, further comprising a supply flow path through which liquid is supplied to the supply common liquid chamber and a discharge flow path through which liquid discharged from the discharge common liquid chamber flows, wherein the first portion, a part of the supply flow path, and a part of the discharge flow path are formed in the same layer, among the substrates.

5. The liquid ejecting head according to claim 1, wherein the nozzles form a nozzle row by arranging the nozzles in a second direction orthogonal to the first direction, the supply common liquid chamber and the discharge common liquid chamber extend in the second direction, the liquid ejecting head further comprises a wiring member disposed between the supply common liquid chamber and the discharge common liquid chamber in a plan view as seen in the first direction, the wiring member has a portion positioned in the second direction with respect to a nozzle disposed foremost in the second direction, among the nozzles, in the plan view, and the first portion has a bent portion that is bent to bypass the wiring member.

6. The liquid ejecting head according to claim 1, wherein the substrates include a case that defines a part or an entirety of the supply common liquid chamber and a part or an entirety of the discharge common liquid chamber, the nozzles communicating with the supply common liquid chamber form a nozzle row by arranging the nozzles in a second direction orthogonal to the first direction, the supply common liquid chamber and the discharge common liquid chamber extend in the second direction, and the first portion has a portion that is not overlapped with the case in a plan view as seen in the first direction.

7. The liquid ejecting head according to claim 1, wherein the substrates include a case that defines a part or an entirety of the supply common liquid chamber and a part or an entirety of the discharge common liquid chamber, the nozzles communicating with the supply common liquid chamber form a nozzle row by arranging the nozzles in a second direction orthogonal to the first direction, the supply common liquid chamber and the discharge common liquid chamber extend in the second direction, and an entirety of the first portion is overlapped with the case in a plan view as seen in the first direction.

8. The liquid ejecting head according to claim 2, further comprising:

second-individual flow paths respectively communicating with second-nozzles configured to eject liquid in the first direction;

a second-supply common liquid chamber that extends in a direction intersecting the first direction and communicates with the second-individual flow paths to supply liquid to the second-individual flow paths;

a second-discharge common liquid chamber that extends in a direction intersecting the first direction and communicates with the second-individual flow paths and through which liquid discharged from the second-individual flow paths flows; and a second-bypass flow path coupling the second-supply common liquid chamber to the second-discharge common liquid chamber, wherein the second-supply common liquid chamber and the second-discharge common liquid chamber are formed in the same layer among the substrates, the second-bypass flow path has a second-first portion formed in a layer different from the second-supply common liquid chamber and the second-discharge common liquid chamber, among the substrates, and a second-second portion that couples the second-supply common liquid chamber to one end of the second-first portion and extends from the second-supply common liquid chamber in the opposite direction of the first direction, the substrates include a first-case that defines a part or an entirety of the supply common liquid chamber, a part or an entirety of the discharge common liquid chamber, and a part of the second portion, a second-case that defines a part or an entirety of the second-supply common liquid chamber, a part or an entirety of the second-discharge common liquid chamber, and a part of the second-second portion, and a first flow path member that defines the first portion, the second-first portion, a part of the second portion, and a part of the second-second portion, and an average flow path resistance per unit length of the part of the second portion defined by the first flow path member is greater than an average flow path resistance per unit length of the part of the second portion defined by the first-case.

9. The liquid ejecting head according to claim 8, wherein a length of the second portion defined by the first flow path member with respect to the first direction is longer than a length of the second portion defined by the first-case with respect to the first direction.

10. The liquid ejecting head according to claim 1, further comprising:

second-individual flow paths respectively communicating with second-nozzles configured to eject liquid in the first direction;

a second-supply common liquid chamber that extends in a direction intersecting the first direction and communicates with the second-individual flow paths to supply liquid to the second-individual flow paths;

a second-discharge common liquid chamber that extends in a direction intersecting the first direction and communicates with the second-individual flow paths and through which liquid discharged from the second-individual flow paths flows; and a second-bypass flow path coupling the second-supply common liquid chamber to the second-discharge common liquid chamber, wherein the substrates include a first-case that defines a part or an entirety of the supply common liquid chamber, a part or an entirety of the discharge common liquid chamber, and a part of the bypass flow path, a second-case that defines a part or an entirety of the second-supply common liquid chamber, a part or an entirety of the second-discharge common liquid chamber, and a part of the second-bypass flow path, a first flow path member stacked with respect to the first-case and second-case in an opposite direction of the first direction, and a second flow path member stacked with respect to the first flow path member in the opposite direction, the liquid ejecting head further comprises a distribution flow path for distributing and supplying liquid to the supply common liquid chamber and the second-supply common liquid chamber, and the first portion, the second-first portion, and the distribution flow path are formed between the first flow path member and the second flow path member.

11. The liquid ejecting head according to claim 1, further comprising:

second-individual flow paths respectively communicating with second-nozzles configured to eject liquid in the first direction;

a second-supply common liquid chamber that extends in a direction intersecting the first direction and communicates with the second-individual flow paths to supply liquid to the second-individual flow paths;

a second-discharge common liquid chamber that extends in a direction intersecting the first direction and communicates with the second-individual flow paths and through which liquid discharged from the second-individual flow paths flows; and a second-bypass flow path coupling the second-supply common liquid chamber to the second-discharge common liquid chamber, wherein the substrates include a first-case that defines a part or an entirety of the supply common liquid chamber, a part or an entirety of the discharge common liquid chamber, and a part of the bypass flow path, a second-case that defines a part or an entirety of the second-supply common liquid chamber, a part or an entirety of the second-discharge common liquid chamber, and a part of the second-bypass flow path, a first flow path member stacked with respect to the first-case and second-case in an opposite direction of the first direction, and a second flow path member stacked with respect to the first flow path member in the opposite direction, the liquid ejecting head further comprises a merging flow path for merging liquid discharged from the discharge common liquid chamber and the second-discharge common liquid chamber, and the first portion, the second-first portion, and the merging flow path are formed between the first flow path member and the second flow path member.

12. A liquid ejecting apparatus comprising the liquid ejecting head according to claim 1.

13. The liquid ejecting apparatus according to claim 12, further comprising a circulation mechanism for circulating liquid supplied into the liquid ejecting head.

14. The liquid ejecting head according to claim 1, wherein the nozzles form a nozzle row by arranging the nozzles in a second direction orthogonal to the first direction, and the first portion and the nozzle row cross each other when viewed in the first direction.

15. The liquid ejecting head according to claim 1, wherein the first portion extends a direction that the supply common liquid chamber and the discharge common liquid chamber are arranged when viewed in the first direction.

16. The liquid ejecting head according to claim 1, wherein the first portion overlaps the individual flow path when viewed in the first direction.

17. The liquid ejecting head according to claim 1, wherein the first portion is located in a direction opposite to a direction that the nozzle opens with respect to the supply common liquid chamber.

18. The liquid ejecting head according to claim 14, wherein the first portion is located between two nozzles located at both ends in the second direction among the nozzle row, when viewed in the first direction.

19. The liquid ejecting head according to claim 1, wherein the layer in which the first portion is formed is different from a layer in which the individual frow paths are formed, among the substrates.

20. The liquid ejecting head according to claim 1, wherein the supply and discharge common liquid chambers and the individual flow paths are formed in a communication plate, and the first portion is formed in a substrate different from the communication plate.

* * * * *